US008479931B1

(12) United States Patent
Richards et al.

(10) Patent No.: US 8,479,931 B1
(45) Date of Patent: Jul. 9, 2013

(54) MULTI-PURPOSE DRAPERY ROD SYSTEM

(76) Inventors: Jeniece Mayhugh Richards, Las Vegas, NV (US); Clinton Henry Richards, Las Vegas, NV (US)

( * ) Notice: Subject to any disclaimer, the term of this patent is extended or adjusted under 35 U.S.C. 154(b) by 0 days.

(21) Appl. No.: 13/385,041

(22) Filed: Jan. 30, 2012

(51) Int. Cl.
*A47H 1/02* (2006.01)
*A47H 1/122* (2006.01)
*A47H 1/022* (2006.01)
*A47H 2001/0205* (2006.01)

(52) U.S. Cl.
USPC ..... 211/105.2

(58) Field of Classification Search
USPC ..... 211/182, 105.1–105.6, 123, 16, 6, 211/88.04; 248/251
See application file for complete search history.

(56) References Cited

U.S. PATENT DOCUMENTS 1,409,056 A * 3/1922 Michaels ..... 211/123
1,799,558 A * 4/1931 Howard ..... 248/213.4
2,622,743 A * 12/1952 Ross ..... 211/123
3,766,597 A 10/1973 Ford
3,881,218 A 5/1975 Palmer
3,946,978 A 3/1976 Evans
4,120,474 A 10/1978 Hurley
4,140,294 A 2/1979 Zwarts
4,179,091 A 12/1979 Bidney
4,465,198 A * 8/1984 Martin ..... 211/105.3
4,714,222 A * 12/1987 Kiesel et al. ..... 248/282.1
4,825,611 A * 5/1989 Bassett ..... 52/222
4,978,094 A 12/1990 Ford
5,186,427 A * 2/1993 Semchuck ..... 248/251
5,217,123 A * 6/1993 Riley et al. ..... 211/105.1
5,259,520 A 11/1993 Roggio
5,529,273 A 6/1996 Benthin
D383,632 S * 9/1997 Goodman ..... D6/549
5,662,297 A * 9/1997 Christensen et al. ..... 211/105.1
5,690,237 A * 11/1997 Marzec ..... 211/105.1
5,711,434 A * 1/1998 Adams ..... 211/86.01
5,860,538 A * 1/1999 Duero et al. ..... 211/123
5,931,427 A * 8/1999 Pan ..... 248/224.7
5,983,556 A * 11/1999 Zaloga ..... 43/57.1
D429,587 S * 8/2000 Chen ..... D6/549
6,199,808 B1 * 3/2001 Lin ..... 248/222.14
6,220,460 B1 * 4/2001 Pan ..... 211/87.01
6,305,558 B1 * 10/2001 Bates ..... 211/105.1
6,345,797 B1 * 2/2002 Ming-Hsiao ..... 248/309.2
6,367,638 B1 * 4/2002 Gougian ..... 211/105.1
6,382,295 B1 5/2002 Nicholson
6,430,759 B1 * 8/2002 Beltran ..... 4/576.1
6,499,186 B1 * 12/2002 Arentsen ..... 16/87 R
6,499,708 B1 12/2002 Cowen
6,588,060 B1 * 7/2003 Arentsen et al. ..... 16/87 R
D478,446 S * 8/2003 Solowiej ..... D6/549

(Continued)

*Primary Examiner* — Jennifer E Novosad

(57) ABSTRACT

Multi-purpose drapery rod system uses unique rod and bracket construction to provide superior platform for single and layered drapery. A single-drapery rod cooperates with bracket to attach to surfaces at nearly any angle to the rod. The single-drapery rod is easily converted to a Type 1 dual-drapery rod which layers accent drapery to the side and in front of primary drapery without a view-obstructing front rod, or to a Type 2 rod which layers fully-drawable primary drapery in front and to the sides of secondary drapery. Both types are easily converted to the other due to their modular construction, and both display drapery from the back, front, and along the sides by connecting the back and front with curved sections between them. System also includes a unique motorized assembly which easily mounts to a wall, connects to an existing traverse rod, and converts to a dual-drapery rod when desired.

14 Claims, 45 Drawing Sheets

U.S. PATENT DOCUMENTS

| | | | | |
|---|---|---|---|---|
| 6,651,830 | B2 * | 11/2003 | Pan | 211/105.1 |
| 6,688,479 | B2 * | 2/2004 | Nei | 211/105.2 |
| 6,983,853 | B1 * | 1/2006 | Fickett | 211/18 |
| 7,322,552 | B1 | 1/2008 | Lin | |
| 7,360,576 | B2 | 4/2008 | Lin | |
| 7,424,993 | B2 * | 9/2008 | Bell | 248/262 |
| D589,778 | S * | 4/2009 | Pratt | D8/317 |
| 7,648,111 | B2 | 1/2010 | Goldstein | |
| 7,861,989 | B2 | 1/2011 | Cross | |
| 7,967,522 | B2 * | 6/2011 | Goad | 403/292 |
| 8,231,093 | B2 * | 7/2012 | Tran | 248/262 |
| 2002/0088764 | A1 * | 7/2002 | Pan | 211/105.1 |
| 2006/0162877 | A1 | 7/2006 | Chou | |
| 2007/0170134 | A1 * | 7/2007 | Bishop et al. | 211/105.1 |

* cited by examiner

MULTI-PURPOSE DRAPERY ROD SYSTEM

CROSS-REFERENCE TO RELATED APPLICATIONS

This is a substitute application for application Ser. No. 13/269,558, filed Oct. 8, 2011, now abandoned.

BACKGROUND OF THE INVENTION

1. Field of the Invention

The present invention generally relates to window drapery hardware, and more specifically to drapery rods and their mounting brackets.

2. Prior Art

Drapery is used as a window enhancement for decorative purposes as well as for insulation, to provide privacy, and to control natural light. Drapery rods of a variety of shapes and sizes have been designed to support drapery or the structures to which the drapery is attached. Traverse rods, for example, are rectangular and hold drapery pins and hooks while drapery rings are frequently used with circular rods. The rods may consist of a single bar or a plurality of typically telescoping bars, and like the drapery they support, may be designed for aesthetic appeal as well as functionality. Designers and inventors have adorned the rods with decorative hardware, modified their surfaces, used attractive materials, and created innovative methods of enhancing aesthetics while maintaining functionality. U.S. Pat. No. 6,499,708 and U.S. Pat. No. 5,259,520, for example, offer rods that function smoothly despite the presence of decorative material on their surface, U.S. Pat. No. 3,730,249 conceals center-support brackets, and U.S. Pat. No. 3,881,218 allows the use of plastic materials while maintaining the aesthetic features that have been designed for drapery rods.

Drapery rods are most often mounted to a substantially parallel vertical support surface such as a wall. A first member base plate typically engages the wall while a third member engages the rod with what is generally some sort of clip or socket structure. A second member connects the two, establishes the distance between the wall and the rod, and may engage the under surface of the rod. The needs for easy horizontal adjustment of the second member and vertical adjustment of the base plate have long been addressed by inventors in the industry (e.g., U.S. Pat. No. 4,140,294 and U.S. Pat. No. 4,179,091). More recently, inventors have turned their attention to making brackets more adaptable rather than more adjustable. U.S. Pat. No. 6,382,295 offers a bracket adaptable to either mini-blinds or curtain rods, and U.S. Pat. No. 7,322,552 offers one adaptable to both the roman shade and the crisscross curtain singularly and in combination. Another recent invention, U.S. Pat. No. 7,861,989, offers a bracket which can mount to a wall, ceiling, or opposing surfaces by adding or removing some parts of the bracket. This is significant since the mounting of a rod to opposing surfaces previously required a bracket like U.S. Pat. No. 3,946,978 quite different from those used for ceiling or wall mounting. However, a multi-purpose bracket that does not require parts to be changed out for different surfaces would be preferred, and for reasons to be described, a multipurpose bracket is also needed that prevents circular rods from rotating. U.S. Pat. No. 7,861,989 does not fulfill these needs.

Inventors have achieved considerable success in improving the aesthetics of single-drapery rods and the functionality of mounting brackets, with some noted limitations, but the layering of drapery continues to be plagued by long standing problems. These problems are inherent in the standard double-traverse rod and the generally more decorative double rod and bracket system used for layering drapery. The standard double-traverse system supports two parallel traverse rods behind aesthetically unappealing front and side panels. The double rod and bracket system consists of two parallel traverse or non-traverse rods with exposed ends supported by a double-bracket. For aesthetic reasons, the ends of the rods are often adorned with expensive hardware and the double brackets are often decoratively constructed. Both the standard double-traverse rod and the double rod and bracket system are used to layer primary drapery in front of what is typically sheer secondary drapery, but the more decorative double rod and bracket system is favored when layering secondary accent drapery in front of primary drapery. It, too, has aesthetic problems however. The front rod may be made in a variety of appealing shapes and colors, often at great expense, but it still unnecessarily obstructs the view of the primary drapery. And the exposed ends of the two rods and the gaps between them are difficult if not impossible to make aesthetically appealing, particularly when viewed from the side.

The aesthetic problems encountered in supporting layered drapery have led the industry to market extensive and expensive collections of decorative hardware; designers to use additional drapery to hide the ends of the rods and the gaps between them; and contractors to build custom valences in front and to the side of the rods. The approaches are costly and fail to solve the inherent problems they try to hide. Inventors have likewise failed to develop an aesthetically appealing alternative support structure that layers drapery without the need for an obtrusive front rod, aesthetically unappealing panels, or the exposed ends of two rods. U.S. Pat. No. 7,648,111 allows additional drapery rods to be supported on the main brackets of a main drapery rod installation and U.S. Pat. No. 4,120,474 offers a bracket which can be adapted to support a single or double drapery rod, but although both ease installation concerns, they maintain the essential features of the double rod and bracket system. U.S. Pat. No. 3,766,597 and U.S. Pat. No. 4,978,094 offer intrinsically different systems, but are not appropriate for layering accent drapery in front of primary drapery or for layering primary drapery in front of secondary drapery. U.S. Pat. No. 3,766,597 provides a single aesthetically appealing rod which encases two rods, but their close proximity is inappropriate for the layering of drapery. U.S. Pat. No. 4,978,094 suffers a similar problem, arraying multiple rods in an inappropriate spatial relationship of close vertical and horizontal proximity. The resulting unsatisfied desire to layer accent drapery to the side and in front of primary drapery without a view-obstructing front rod has led some in desperation to hang accent drapery to the side and on the same rod as primary drapery, but this too obviously fails to provide an appropriately layered look.

A dual-drapery rod is needed which layers accent drapery to the side and in front of primary drapery without an obtrusive front rod and without the exposed ends of two rods or unattractive front and side panels to mar the aesthetic appeal of the drapery. The aim is to display the drapery—not the rods. A dual-drapery rod is also needed which layers fully drawable primary drapery in front of secondary drapery. Ideally one type of dual-drapery rod would be easily assembled from the other or from an existing single-drapery rod. A single-drapery rod assembly is also needed that can be easily mounted to a ceiling or to a parallel or opposing vertical support surface using an inconspicuous bracket requiring little or no modification to adapt to differently-angled support surfaces.

Another need relates to the motorization of drapery rods. Electric remote controlled mechanisms for operating traverse rods have appeared on the market in increasing numbers of late, but the functionally effective ones are expensive and difficult to install. The small light-weight motors deemed necessary are themselves very expensive, and few can be attached to an existing rod. Operational inefficiency has also been a problem. US 2006/0162877 A1 and U.S. Pat. No. 7,360,576 B2 can be attached to existing traverse rods, and the latter does improve the functioning of the drive pulley with a more complex double wheel system. But the performance of both inventions, like that of previous art, is still hindered by redirections of the traverse rod's transmission cord. The cord is redirected from a horizontal direction to a vertical one before engaging the drive pulley system, then redirected back from vertical to horizontal before returning to the traverse rod. Structural complexity and cost are increased as well as wear and tear and slippage of the transmission cord. Operational efficiency and effectiveness continue to decrease over time as the cord becomes smoother and smoother. A motorized assembly is needed which is structurally simpler, does not require the redirection of transmission cords done in prior art, is easy to install on existing traverse rods, and can support and utilize a relatively inexpensive motor effectively and aesthetically.

The present invention offers a multi-purpose drapery rod system which provides a superior platform for single and layered drapery that is easily convertible from one to the other and is made possible by unique rod and cooperating bracket construction. The single-drapery rod has a flexible bracketing system which can attach the rod to not only substantially parallel support surfaces such as walls, but also to ceilings and to opposing support surfaces such as those found with recessed windows. The ends of the rod can also be attached at different heights on opposed or parallel vertical support surfaces, making it adaptable to non-rectangular windows, recessed or not. The single-drapery rod is easily converted to a dual-drapery rod which provides a continuous platform for drapery from the back to the front, thereby eliminating the need for side panels or the display of the exposed ends of a separate front and back rod. The dual-drapery rod doesn't require a view-obstructing front bar when layering accent drapery in front of primary drapery but does provide one for layering primary drapery in front of what is typically sheer or more translucent secondary drapery. The back, front, and curved sections which connect the substantially straight front and back sections are secured in a horizontal plane by unique brackets which unobtrusively but efficiently and effectively engage the rod and support surfaces.

The present invention also provides a motorized assembly which can be attached to an existing traverse rod and integrated with a dual-drapery rod when desired. The easy to install assembly is structurally simple, does not require redirection of transmission cords, and can aesthetically and more effectively utilize a bigger and heavier but less expensive motor than available alternatives.

3. Objects and Advantages

The multi-purpose drapery rod system offers:

1) a dual-drapery rod assembly comprised of a uniquely constructed dual-drapery rod and bracket, which cooperate to more aesthetically and economically layer primary and secondary drapery;
2) modular Type 1 and Type 2 embodiments that layer drapery from the front, back, and sides and easily convert from one to the other, Type 1 rods layering accent drapery in front of primary drapery without an obstructing front rod and Type 2 rods layering secondary drapery behind fully drawable primary drapery;
3) modular Type 1 and Type 2 embodiments that easily convert existing engageable single-drapery rods into dual-drapery rods;
4) a single-drapery rod with unique cooperating mounting brackets that can be inconspicuously affixed to surfaces lying at nearly any angle to the rod;
5) modular embodiments that easily convert this unique single-drapery rod into Type 1 or Type 2 embodiments;
6) and a conversion assembly that motorizes a single traverse rod and can convert it into a dual-drapery rod when desired.

SUMMARY

The multi-purpose drapery rod system offers a dual-drapery rod for layering drapery that 1) supports drapery on the front, back, and sides, thereby eliminating the need to expose the ends of two separate rods or cover them with side panels; and 2) makes a view-obstructing front bar unnecessary when layering accent drapery in front of primary drapery but provides one for layering fully drawable primary drapery in front of secondary drapery. The dual-drapery rod is secured in a horizontal plane by brackets which attach easily and unobtrusively to a support surface and the rod.

The multi-purpose drapery rod system also provides an improved single-drapery rod assembly with a flexible bracketing system which can attach the rod to substantially parallel support surfaces such as walls, to ceilings, or to opposing support surfaces such as those found with recessed windows. The ends of the rod can also be attached at different heights on opposed or parallel vertical support surfaces, making the rod adaptable to non-rectangular windows whether or not they are recessed.

The multi-purpose drapery rod system also provides components which can convert the single-drapery rod assembly, or any telescopically compatible single-drapery rod, into a dual-drapery rod assembly. Finally, a conversion assembly motorizes a traverse rod and converts it into a dual-drapery rod when desired.

DRAWINGS

Together with the detailed description, the accompanying drawings serve to explain and illustrate the principles and implementations of the multi-purpose drapery rod system and make its nature, objects, and advantages more apparent to those skilled in the art. The drawings, although not drawn to scale, illustrate multiple embodiments of the single-drapery rod as well as the Type 1 and Type 2 dual-drapery rod embodiments. Also shown are two embodiments of adjustable and non-adjustable mounting brackets, as well as a motorized conversion assembly.

FIG. 16A shows the preferred Type 1 and FIG. 16B shows the preferred Type 2 dual-drapery rod embodiments that use non-slip brackets.

Figure 26:
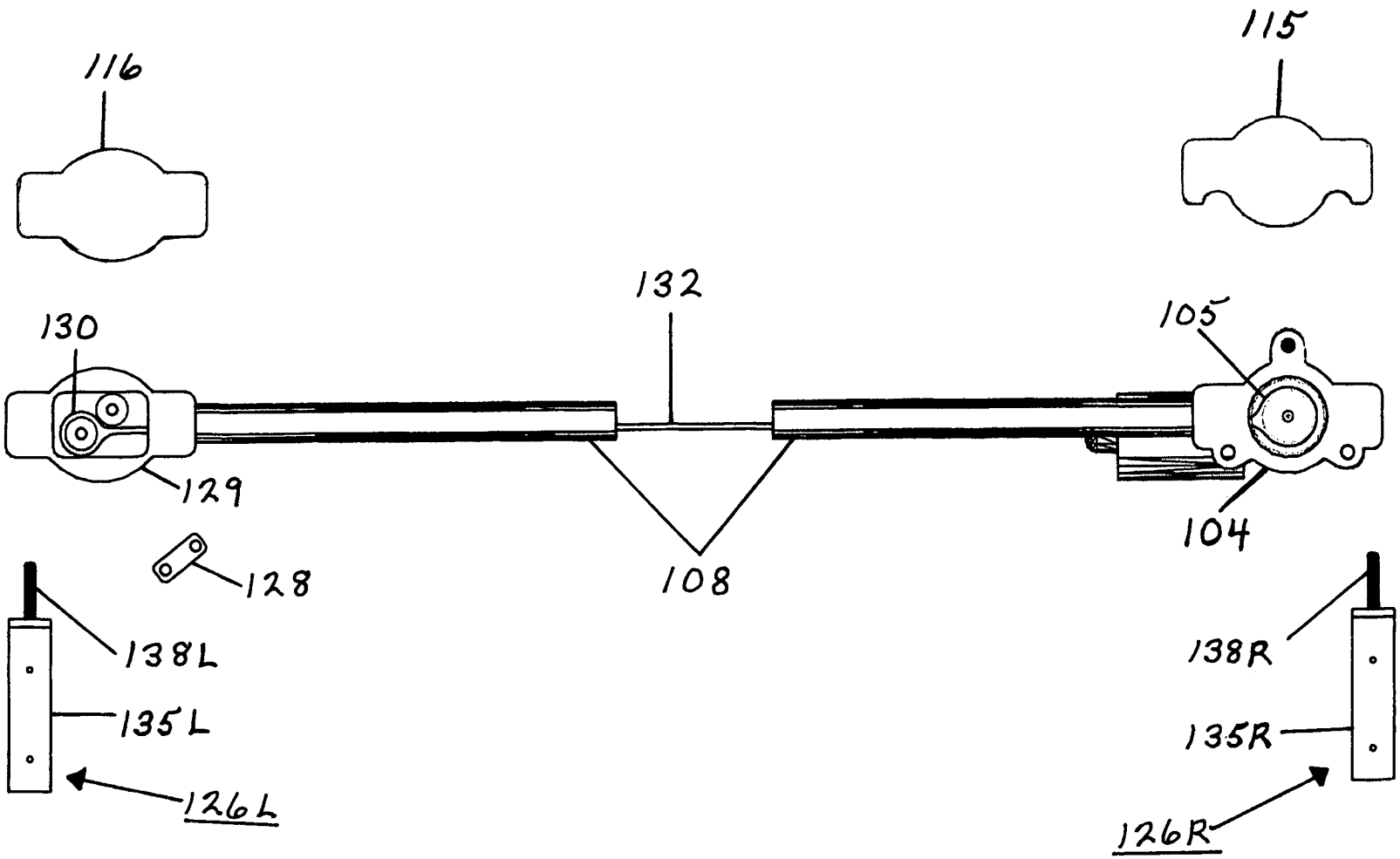

FIG. 26 provides a front view of take-up and drive pulley housings with key components and a traverse rod between them.

Figure 27:
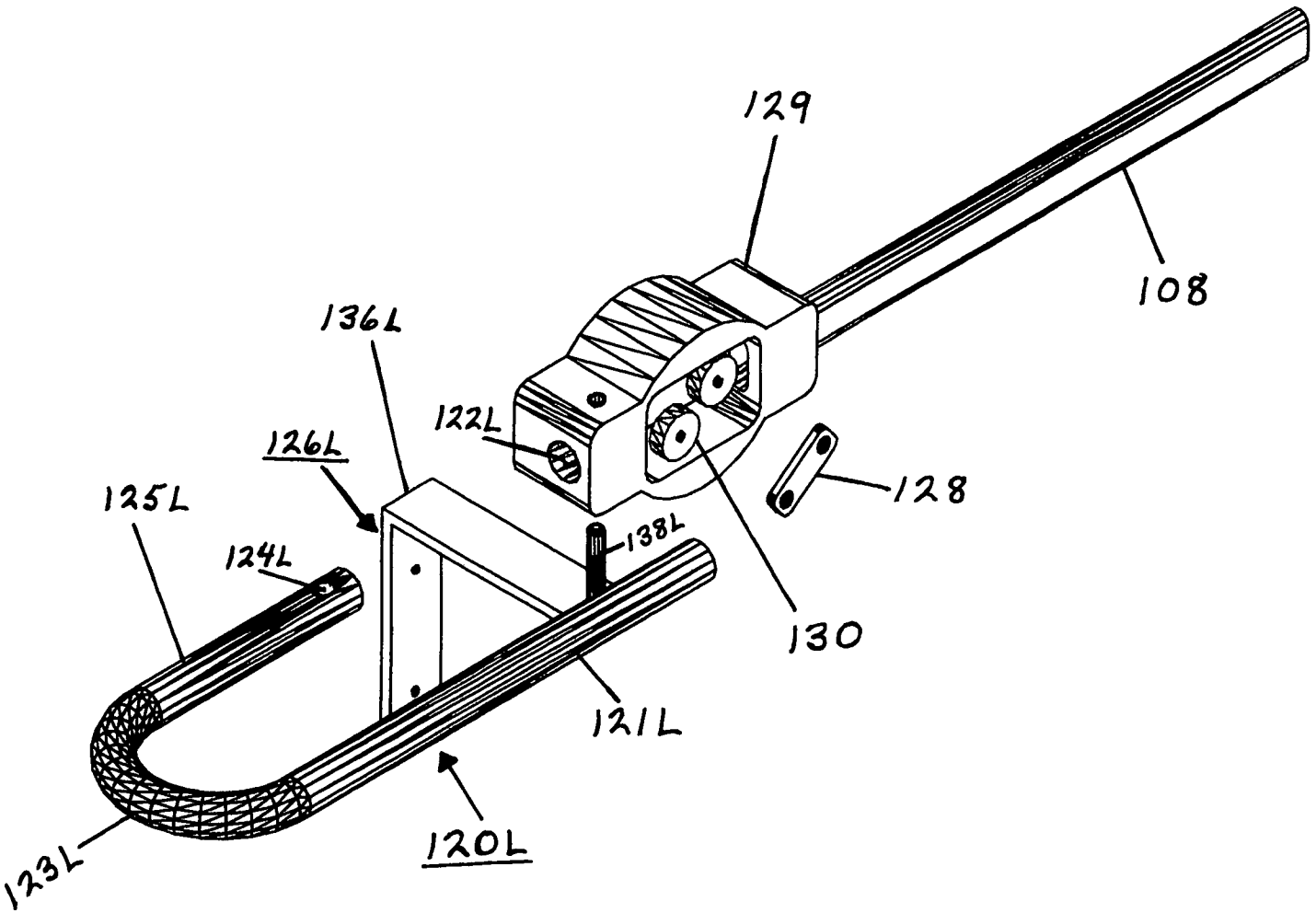

FIG. 27 is a front perspective partial view of the take-up pulley housing attached to a traverse rod along with a view of a separated dual-drapery rod and mounting bracket.

Figure 28:
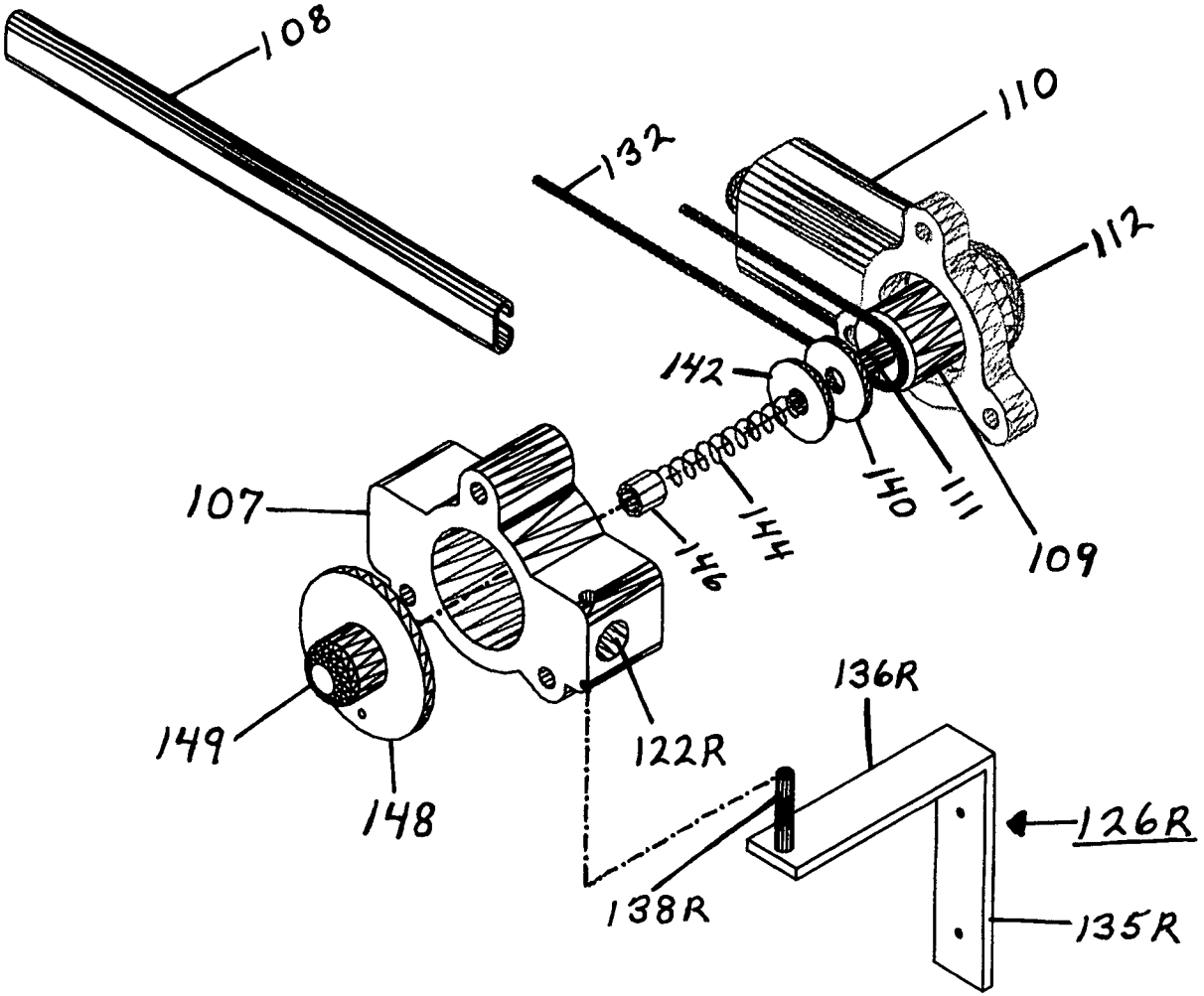

FIG. 28 is a perspective front view of a second embodiment of the drive pulley apparatus along with other key components of the conversion assembly and a partial view of a cooperating traverse rod.

DETAILED DESCRIPTION OF INVENTION

Those of ordinary skill in the art will realize that the following detailed description of the present invention is illustrative only and not intended to be in any way limiting. Other embodiments not shown here will readily suggest themselves to such skilled persons having the benefit of this disclosure. Only two adjustable and two non-adjustable mounting brackets are shown, but similar ones will suggest themselves to those familiar with the art, and some will be described although they are not shown. Other types of brackets could also be used, but they would require substantial modification of the rod itself and would not retain the advantages of the preferred brackets. Additional configurations of component rods are also possible, although a number are shown here that have specified advantages. Component rods could also be inter-engaged by connectors and clamps of various types rather than telescopically, but telescopic engagement allows major adjustment in the span of the rod.

Reference will now be made to implementations of the present invention as illustrated in the embodiments shown in the accompanying drawings. In the interest of brevity and clarity, the drawings focus on the non-routine features of the invention and therefore do not show many routine features well known to those skilled in the art. Not shown or detailed, for example, are any of number of means well known in the industry for securing mounting brackets to support surfaces, providing center support for rods, using set screws, finishing the edges of telescopically inter-engaged rods, and using structural ribs, ridges, and the like to increase the strength of components.

Figure 1A:
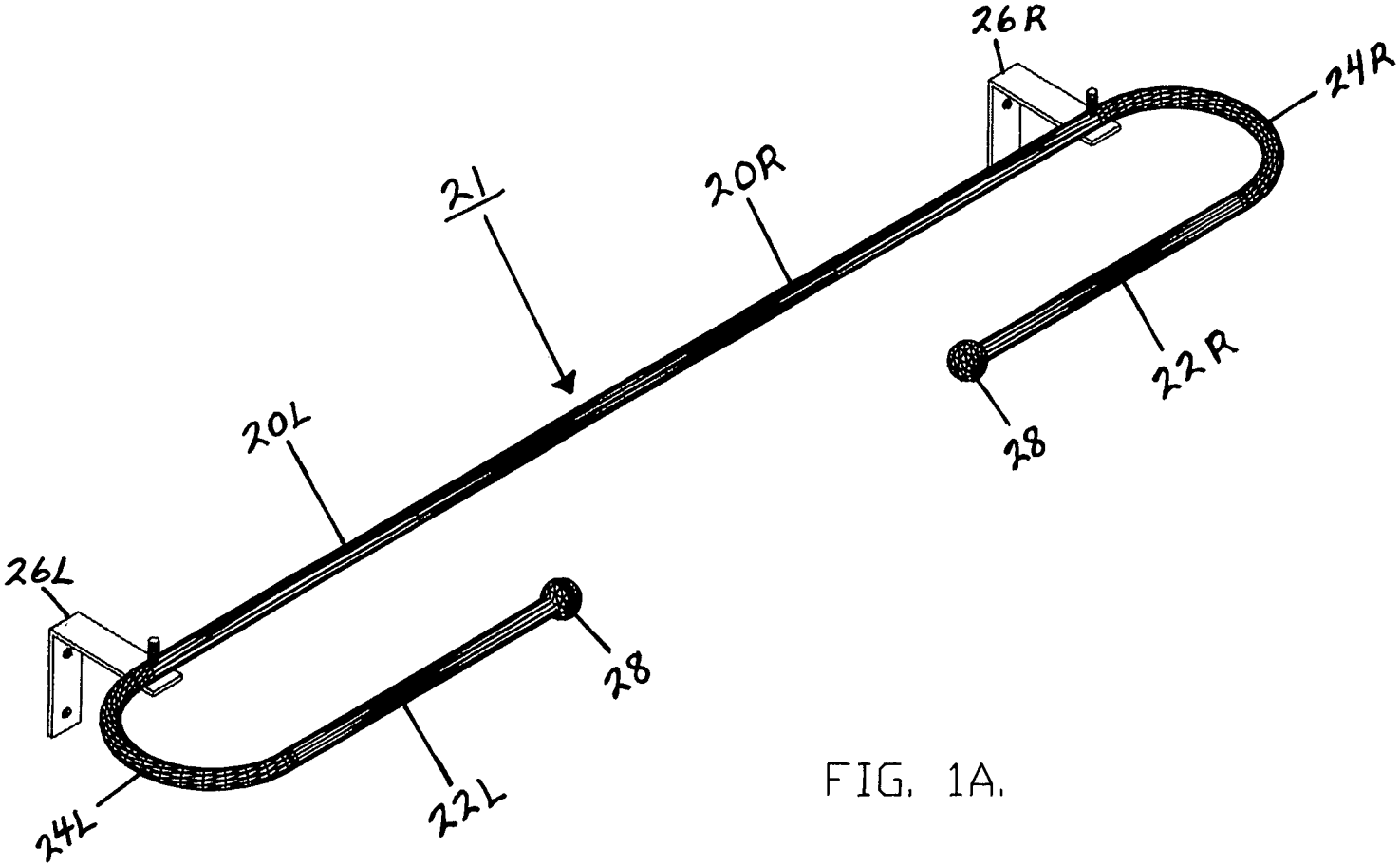
FIG. 1A is a perspective view from above of the preferred Type 1 embodiment of the dual-drapery rod assembly designed to layer secondary accent drapery in front and to the side of primary drapery.

FIG. 1A is a perspective view from above of the preferred Type 1 embodiment of the dual-drapery rod mounted on a (not shown) wall or other substantially vertical support structure. Recall that Type 1 embodiments layer accent drapery in front and to the side of primary drapery without an obstructing front rod to hinder the view of the primary drapery. The dual-drapery rod is made of a rigid material, has a top and bottom surface, and includes curved left and right intermediate sections 24L and 24R sandwiched between substantially straight inter-engaging left and right back sections 20L and 20R and left and right front sections 22L and 22R. Intermediate sections 24L and 24R curve toward each other approximately 180° over a predetermined distance in substantially the same plane, thereby positioning front sections 22L and 22R in a substantially straight line substantially parallel to and at a desired distance from left and right back sections 20L and 20R, which engage to form back section 21. Wall mounting brackets 26L and 26R attach to a wall or other substantially vertical support surface with anchoring bolts or other common attachment means (not shown), and attach to 21 by engaging back sections 20L and 20R (see FIGS. 2-3) at points substantially adjacent to intermediate sections 24L and 24R, securing the rod in a substantially horizontal plane. Finials 28 are attached to the left end of 22L and right end of 22R.

Primary drapery (not shown) is supported by 21 between 26L and 26R. Secondary accent drapery (also not shown) is supported by the remainder of the rod, which consists primarily of intermediate sections 24L and 24R and front sections 22L and 22R but also includes any part of 21 lying to the left of 26L or right of 26R. Brackets attach to 21 at points substantially but not immediately adjacent to 24L and 24R. Reserving some of 21 for accent drapery so a small amount can curve around 24L and 24R and hang substantially parallel to the wall enhances the aesthetic appeal of the accent drapery, particularly when viewed from the side.

Figure 1B:
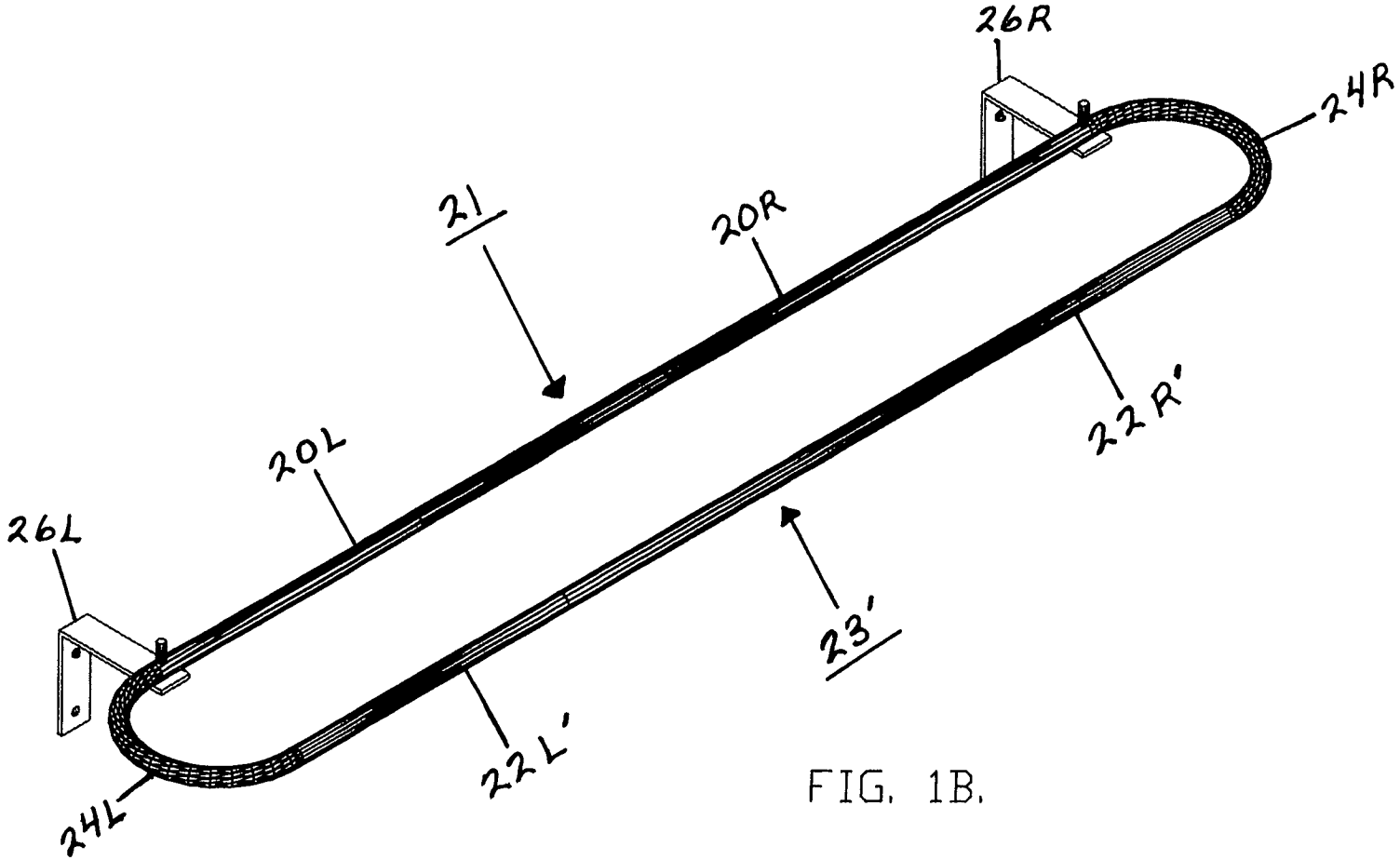
FIG. 1B is a perspective view from above of the preferred Type 2 embodiment of the dual-drapery rod assembly designed to layer primary drapery in front and to the side of secondary drapery.

FIG. 1B is a perspective view from above of the preferred Type 2 dual-drapery rod mounted on a wall or other substantially vertical support structure. Recall that Type 2 embodiments are designed to layer secondary drapery behind primary drapery that can be fully drawn. Front sections 22L' and 22R' of the Type 2 drapery rod therefore extend and inter-engage to form front section 23'.

With the exception of the much longer 22L' and 22R' replacing 22L and 22R, the drapery rods of FIGS. 1A and 1B are nearly identical. In both, 24L and 24R curve toward each other approximately 180° over a predetermined distance and are sandwiched between 20L and 22L and 20R and 22R; and in both 26L and 26R attach to 20L and 20R at points substantially adjacent to 24L and 24R. However, since front sections 22L' and 22R' meet to form 23, the Type 2 rod of FIG. 1B has no finials. Secondary drapery would be hung from back section 21 between 26L and 26R, with the primary drapery hung from the remainder of the rod.

FIGS. 1A and 1B display the different sections of the two types of dual-drapery rod embodiments and the spatial relationships among them, but the figures don't identify all the inter-engaging component rods which may comprise the rods, nor do they provide a detailed view of the preferred mounting bracket and its engagement with those rods. The non-adjustable and adjustable versions of the preferred wall mounting bracket are detailed in FIGS. 2A and 2B. FIG. 3 shows the bracket of FIG. 2A engaging the left back section of the preferred dual-drapery rod of FIG. 1A. FIGS. 4-7 show embodiments comprised of different configurations of telescopically inter-engaging component rods which assemble into Type 1 or 2 dual-drapery rod embodiments. All are designed to use the preferred wall mounting bracket of FIG. 2A or 2B. The bracket can also be used to mount embodiments onto ceilings, but some adjustment is needed in the bracket or the rods in order to mount the dual-drapery rod to a ceiling. Although not shown, the needed adjustments will be discussed.

Figure 2A:
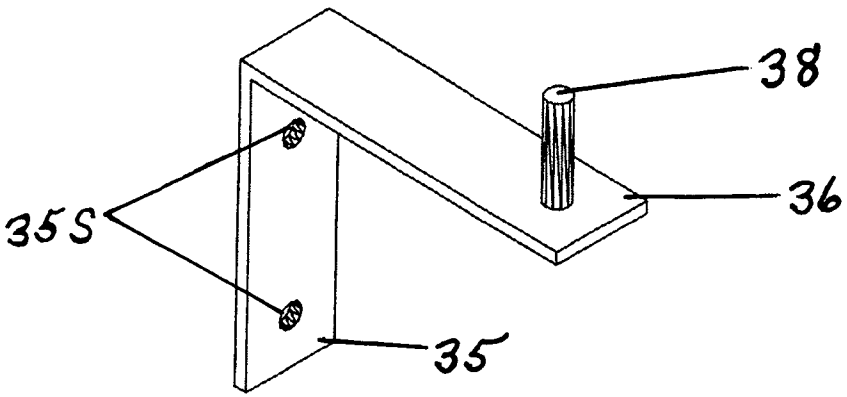
FIG. 2A is a perspective view from above of the preferred non-adjustable wall mounting bracket of the multi-purpose drapery rod system.
Figure 3:
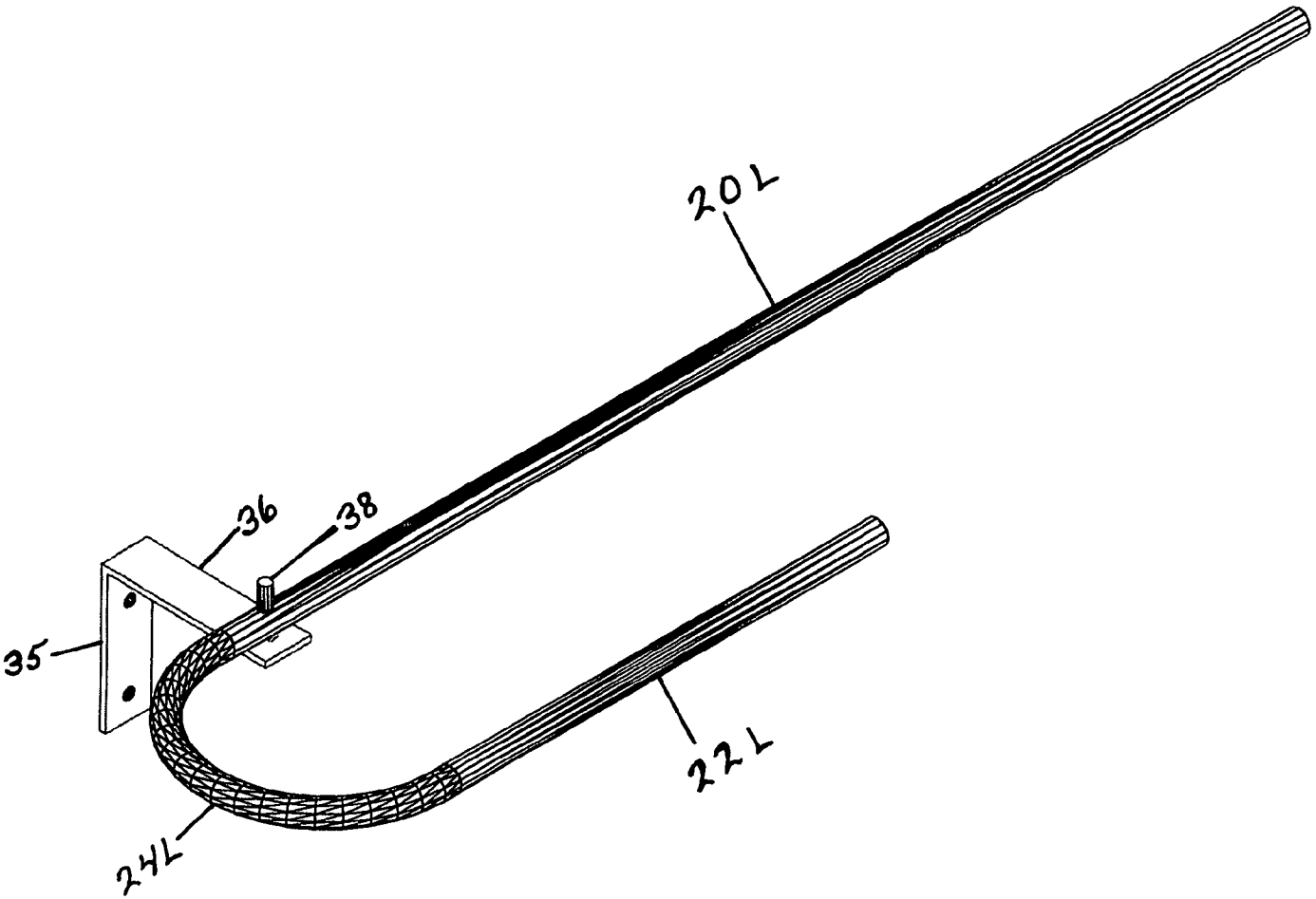
FIG. 3 is a perspective partial view from above of the left back section of the dual-drapery rod engaged with the preferred non-adjustable wall mounting bracket of FIG. 2A.

FIG. 2A is a perspective view from above of the preferred non-adjustable wall mounting bracket. The wall mounting bracket includes a first member comprised of a base plate 35 with a vertically elongated body, a second member 36 with a horizontally elongated body extending substantially perpendicularly from 35, and a third member 38 with a vertically elongated cylindrical body extending upwardly and substantially perpendicularly from 36. Members 35 and 36 can be formed from a single elongated plate made of metal or a similarly strong material that is bent approximately 90 degrees, or two such plates can be attached by welding, brazing, or fusing them together. Third member 38 cannot be simply an angled extension of the second member since the two are shaped very differently. It is attached to 36 by some method such as welding, brazing, or fusion.

The first and second members of the wall mounting bracket are familiar from prior art. The third member's structure and operation are not. Base plate 35 has screw holes 35S penetrating it, and a surface adapted to engage and attach to a vertical support structure using screws, wall anchors, or other similar attachment means (not shown) while second member 36 engages the bottom surface of the drapery rod (see FIG. 3). Third member 38 is sized and shaped to fit into circular apertures penetrating the rod's top and bottom surfaces at an angle substantially perpendicular to the plane of the intermediate sections of the rod, engaging the surrounding surfaces of the apertures (see FIG. 3). An advantage to using cylindrical third members is that their surrounding surfaces can be strengthened by the insertion of easily manufactured tubular reinforcements (not shown) into the apertures of what are frequently hollow telescoping rods. The fact that cylindrical third members can rotate within the apertures also has distinct advantages when used with single-drapery rods, those advantages to be identified when describing the mounting of single-drapery rods in connection with FIGS. 8-11.

Figure 2B:
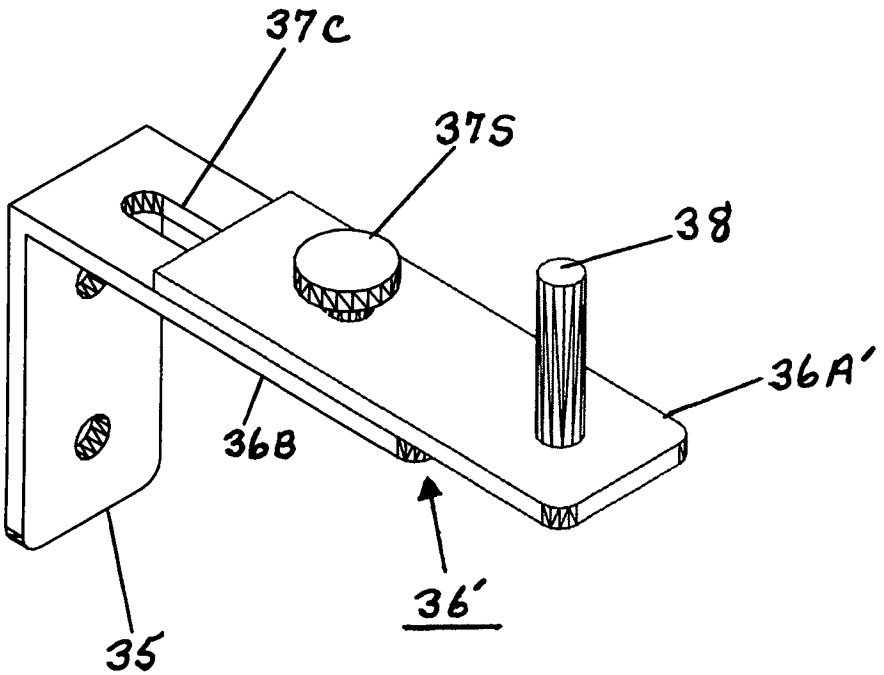
FIG. 2B is a perspective view from above of the preferred adjustable wall mounting bracket.

FIG. 2B is a perspective view from above of the preferred adjustable wall mounting bracket. The base plate and third member are as described with the non-adjustable bracket. The adjustable second member 36' is similar to horizontally adjusting members shown for some time in prior art (e.g., U.S. Pat. No. 4,120,474). It is comprised of lower member 36B' and sliding upper member 36A'. Longitudinally extending channel or slot 37C in 36B' cooperates with an adjustment screw (not shown) operated with an attached head 37S to adjust 36' for desired clearance from the support surface without the need for tools. 37S is turned to loosen the screw and allow 36A' to be extended or retracted along 37C, with the range of motion being determined by the length of 37C. 37S is turned to tighten the screw at the appropriate point for desired clearance from the support structure.

The preferred wall mounting brackets of FIGS. 2A and 2B can also be adapted to adjust vertically by using vertically elongated channels or slots rather than screw holes on the base plate. Although useful, they are well known in prior art and therefore not shown. The focus in these drawings is on the non-routine features of the multi-purpose drapery rod system. However, it should be recognized that the addition of such a vertical adjustment mechanism is within the scope of the present invention.

The preferred wall mounting brackets of FIGS. 2A and 2B can also be used to mount the dual-drapery rod to a ceiling, but the cooperating apertures in the dual-drapery rod would have to penetrate through the rod horizontally rather than perpendicularly since third member 38 would extend horizontally in a ceiling mount. A collar or pin at the end of 38 would be advisable in that case to keep the rod from slipping off of 38. Alternatively, the bracket could be modified to create a ceiling mount with a third member extending downward rather than horizontally from the second member. This would require the use of a collar or pin at the end of 38 to secure the rod, but would then not require a change in the disposition of the cooperating apertures on the drapery rod.

FIG. 3 is a perspective partial view from above of left back section 20L engaged with the preferred non-adjustable wall mounting bracket of FIG. 2A. Second member 36 engages the bottom surface of 20L at points substantially adjacent to 24L to support the rod vertically. Third member 38 engages the surrounding surfaces of the corresponding aperture in 20L. The aperture penetrates the rod's top and bottom surfaces at a substantially perpendicular angle in order to prevent the rod from rotating out of a substantially horizontal plane. Cylindrical third member 38 is attached to second member 36 at a pre-determined distance from first member 35 to establish the desired distance between the wall and the opposing surface of the drapery rod. (This distance is adjustable with the wall mounting bracket of FIG. 2B.)

FIGS. 4-7 show embodiments having different configurations of telescopically inter-engaging component rods made of rigid material with top and bottom surfaces. Component rods are inter-engaged telescopically so that the span of the dual-drapery rod can be easily adjusted, but other inter-engaging methods employing various kinds of connectors or clamps or even using methods such as welding, brazing, or fusion are possible.

All of the configurations of component rods shown in FIGS. 4-7 include two rods with segments that curve approximately 180 degrees. All are also designed to be used with the preferred wall mounting bracket and therefore have circular apertures penetrating the top and bottom surfaces of the appropriate component rod(s) at a substantially perpendicular angle. As previously noted, when mounted on a ceiling, the apertures would have to be horizontally rather than perpendicularly disposed to cooperate with the preferred mounting bracket. Alternatively, the bracket could be modified to extend the third member downward rather than horizontally so that the disposition of the apertures did not have to be changed.

FIGS. 4A-7A display embodiments comprised of four configurations of component rods that telescopically inter-engage to form the Type 1 dual-drapery rod shown in FIG. 1A. FIGS. 4B-7B display embodiments comprised of four configurations of component rods that telescopically inter-engage to form the Type 2 dual-drapery rod shown in FIG. 1B. Three of the four Type 1 and Type 2 embodiments incorporate a single-drapery rod. The other component rods of these embodiments can therefore be used in converting telescopically engageable single-drapery rods currently available on the market into dual-drapery rods. However, it may be preferable to include a new single-drapery rod among the components for quality control reasons.

Figure 4A:
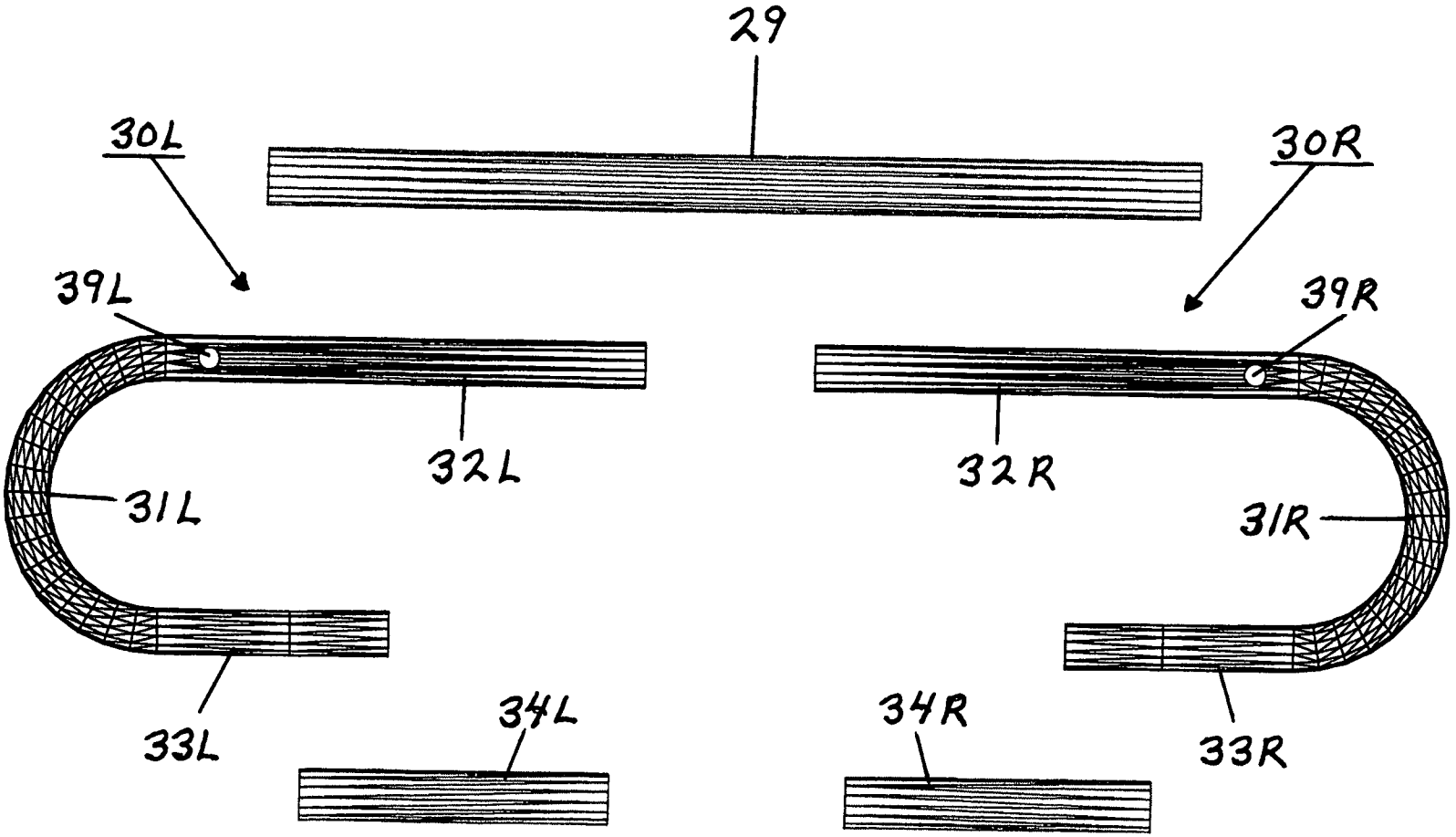
FIG. 4A is a top view of the preferred configuration of component rods that assemble into a Type 1 dual-drapery rod designed to layer accent drapery in front and to the side of primary drapery.

FIG. 4A is a top view of the preferred configuration of component rods that assemble into a Type 1 dual-drapery rod designed to layer accent drapery in front and to the side of primary drapery. This configuration is the preferred embodiment for two reasons. First, the component rods can be assembled into a Type 2 dual-drapery rod with the simple addition of one more component rod. Second, back center rod 29 can be any compatible unitary single-drapery rod, of which there are many available and in use. Single-drapery rods are also included in the second and third Type 1 and Type 2 embodiments shown in FIGS. 5A-6B. However, those single-drapery rods are less common and are themselves comprised of two or more components.

Component rods of the preferred embodiment shown in FIG. 4A include substantially straight back center rod 29 and left and right front rods 34L and 34R as well as left and right curved rods 30L and 30R. Back center rod 29 may be an existing engageable single-drapery rod or a new one provided with the other component rods. Circular apertures 39L and 39R penetrate rods 30L and 30R and are sized to receive the third member of the preferred wall mounting bracket. 30L and 30R are comprised of curved segments 31L and 31R sandwiched between substantially straight back segments 32L and 32R and front segments 33L and 33R. Back segments 32L and 32R are substantially longer than front segments 33L and 33R. Curved segments 31L and 31R are curved toward each other approximately 180 degrees over a predetermined distance, thereby positioning back segments 32L and 32R in a substantially straight line substantially parallel to and at a desired distance from 33L and 33R.

Apertures 39L and 39R penetrate the top and bottom surfaces of 32L and 32R at points substantially adjacent to 31L and 31R and at an angle substantially perpendicular to the planes of curved rods 30L and 30R to create two sets of rigid circular surfaces vertically disposed from each other in substantially perpendicular fashion. Tubular reinforcements (not shown) can be inserted through the apertures to strengthen the surrounding surfaces when needed.

The dual-drapery rod is assembled by telescopically inter-engaging 29 with 32L and 32R without covering apertures 39L and 39R, and telescopically inter-engaging 33L and 33R with 34L and 34R while keeping 30L in the same plane as 30R. The back section of the rod is therefore formed by rod 29 and back sections 32L and 32R, the intermediate section by curved segments 31L and 31R, and the front sections of the dual-drapery rod by left and right front rods 34L and 34R along with left and right front segments 33L and 33R.

Figure 4B:
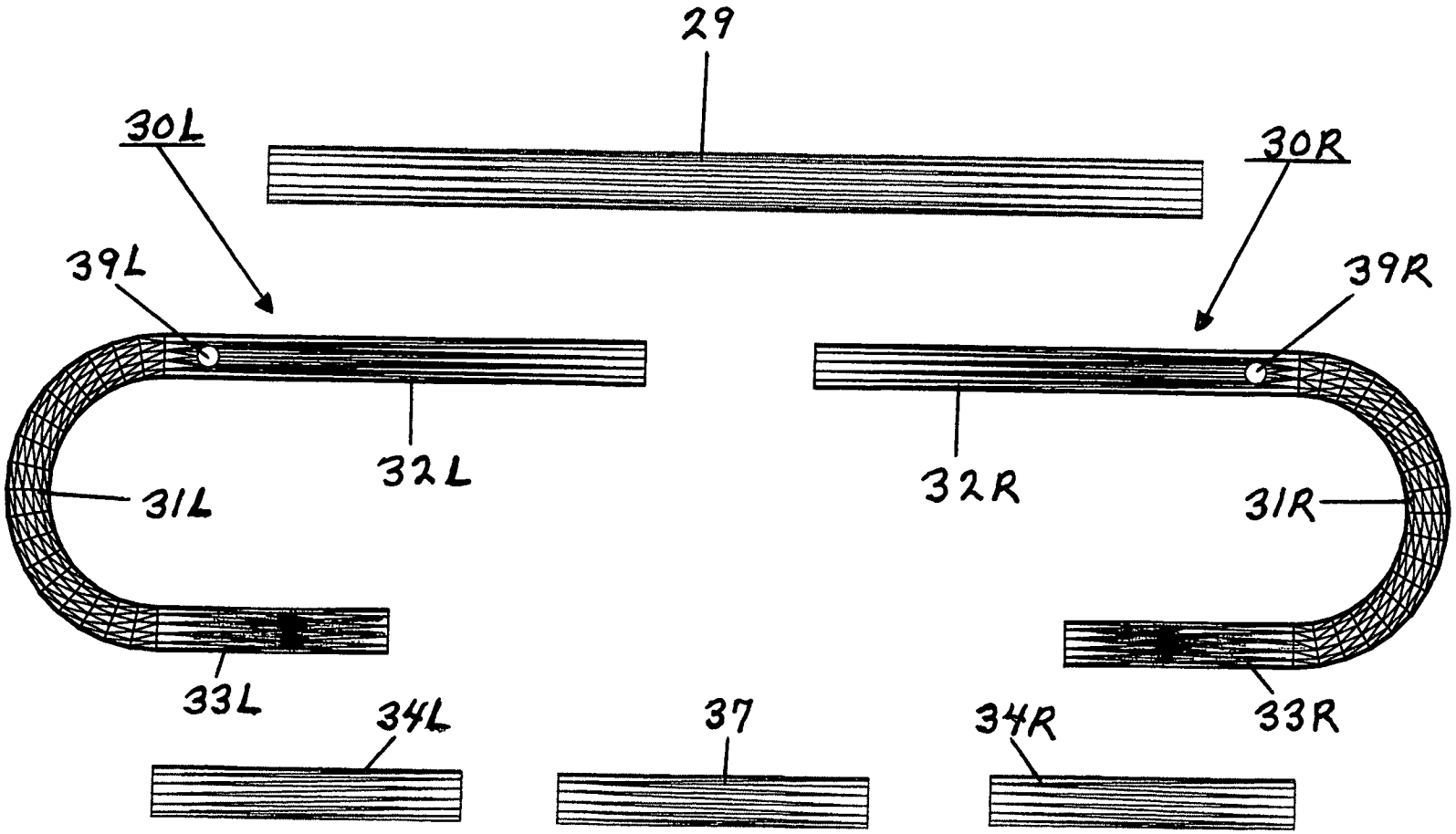
FIG. 4B is a top view of the preferred configuration of component rods that assemble into a Type 2 dual-drapery rod to layer primary drapery in front and to the side of secondary drapery.

FIG. 4B is a top view of the preferred configuration of component rods that assemble into a Type 2 dual-drapery rod to layer primary drapery in front and to the side of secondary drapery. Component rods include front center rod 37 plus the component rods shown in FIG. 4A. The Type 1 embodiment of FIG. 4A is converted into the Type 2 embodiment of FIG. 4B by telescopically inter-engaging 37 between 34L and 34R so that the left and right front sections of the dual-drapery rod inter-engage to form a continuous front section capable of supporting fully drawn primary drapery.

Figure 5A:
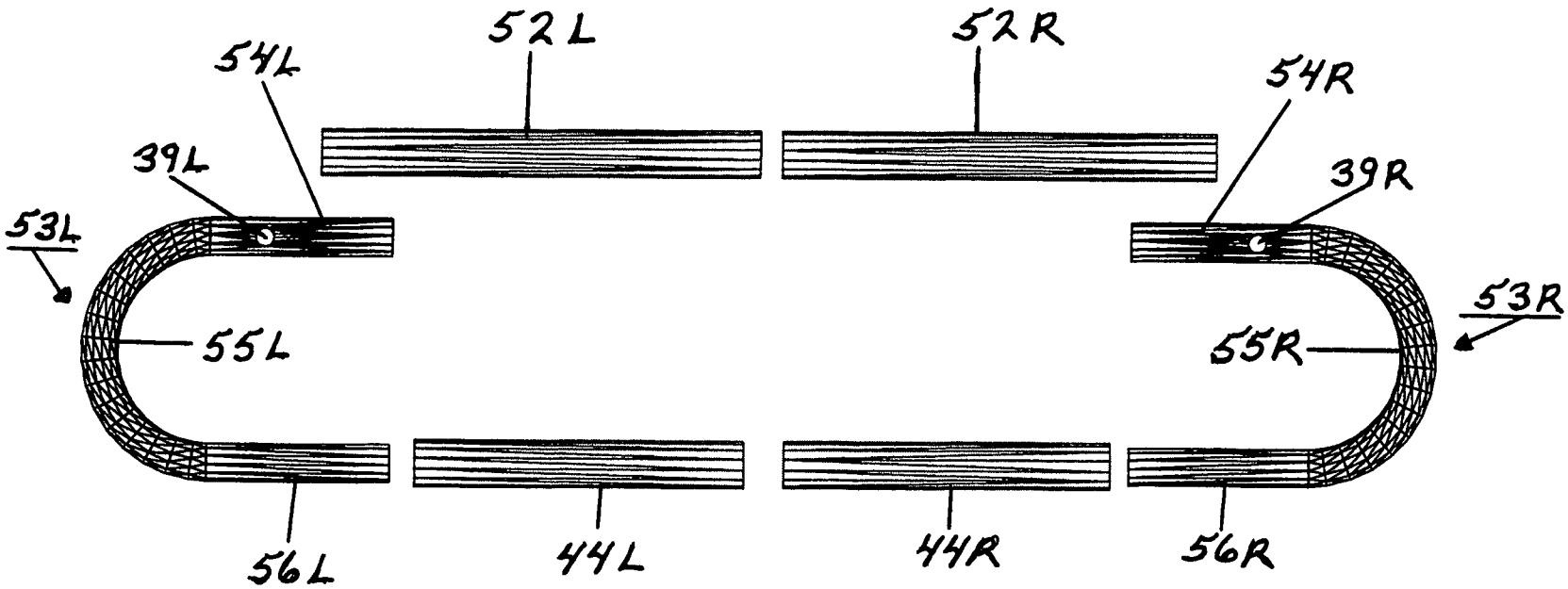
FIG. 5A is a top view of the component rods of a second Type 1 embodiment that includes a single-drapery rod.

FIG. 5A is a top view of the primary components of the second Type 1 embodiment that includes a single-drapery rod. This embodiment includes more drapery rod components than the preferred embodiment and requires the replacement of two rods rather than a simple addition of one when converting to a Type 2 embodiment, but the span of the rod is still adjustable.

The embodiment shown in FIG. 5A includes a binary single-drapery rod comprised of substantially straight back center rods 52L and 52R; substantially straight left and right front rods 44L and 44R; and curved rods 53L and 53R comprised of curved segments 55L and 55R sandwiched between substantially straight back segments 54L and 54R and front segments 56L and 56R. Apertures 39L and 39R penetrate perpendicularly through the top and bottom surfaces of 53L and 53R at points substantially adjacent to 55L and 55R. The drapery rod is assembled by telescopically inter-engaging 52L and 52R with each other and with 54L and 54R of rods 53L and 53R without covering apertures 39L and 39R, and telescopically engaging 44L and 44R with 56L and 56R while keeping rods 53L and 53R in substantially the same plane. The back section of the rod is therefore formed by 54L, 52L, 52R, and 54R; the intermediate section by 55L and 55R; the left front section by 44L and 56L, and the right front section by 44R and 56R.

Figure 5B:
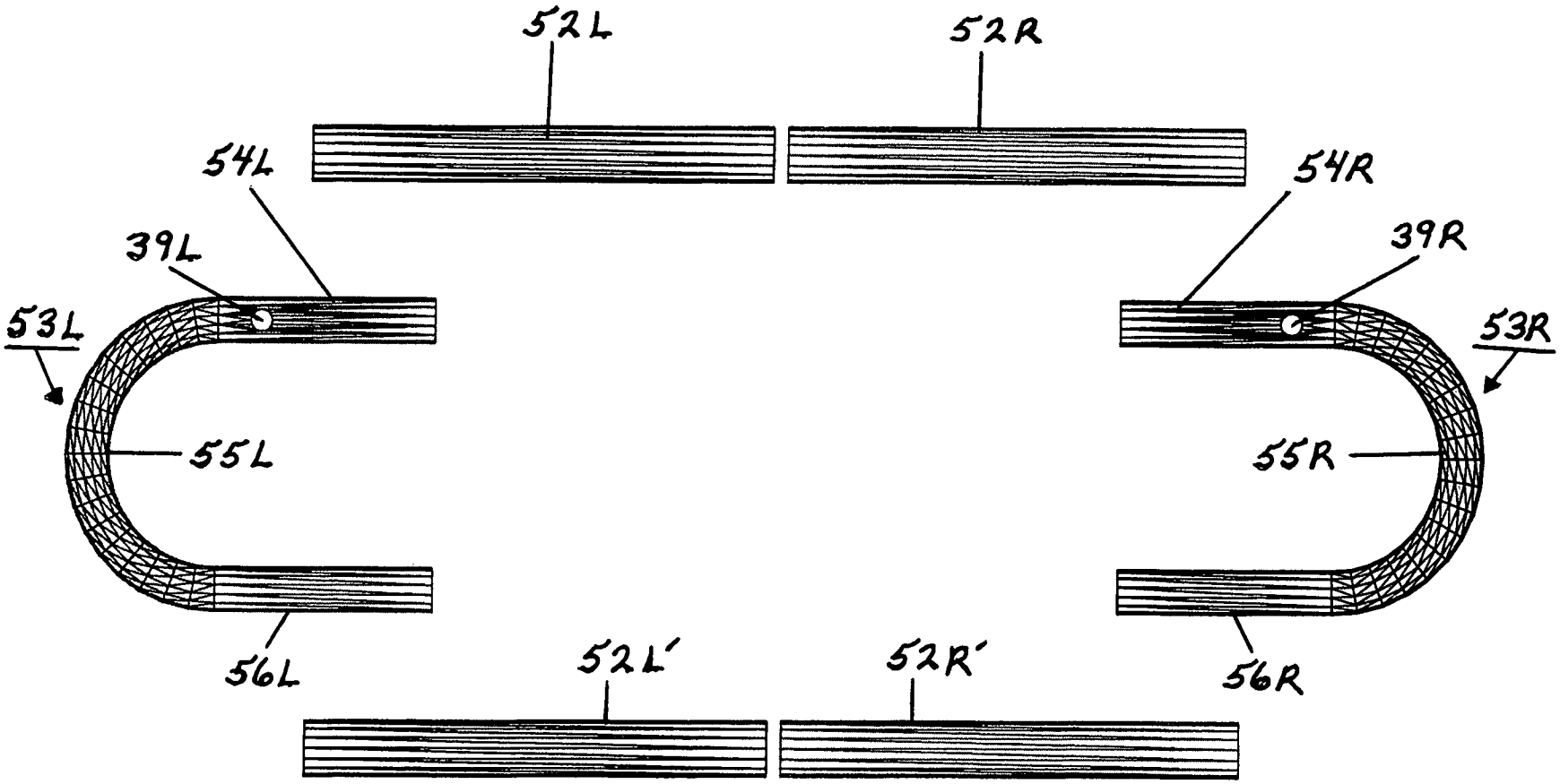
FIG. 5B is a top view of the component rods of a second Type 2 embodiment that includes a single-drapery rod.

FIG. 5B is a top view of the component rods of the second Type 2 embodiment that includes a single-drapery rod. This Type 2 embodiment, like the Type 1 embodiment shown in FIG. 5A, includes rods 52L, 52R, 53L and 53R. However, front left and right rods 44L and 44R are replaced with front center rods 52L' and 52R'. 52L' and 52R' have substantially the same dimensions as 52L and 52R, but the former are telescopically engaged with 56L and 56R while the latter are, as before, telescopically engaged with 54L and 54R without covering apertures 39L and 39R. The back section and intermediate sections are formed as before with the embodiment of FIG. 6A, but left and right front sections formed by 56L and 52L' and by 56R and 52R' telescopically inter-engage to form a continuous front section capable of supporting fully drawn primary drapery.

Figure 6A:
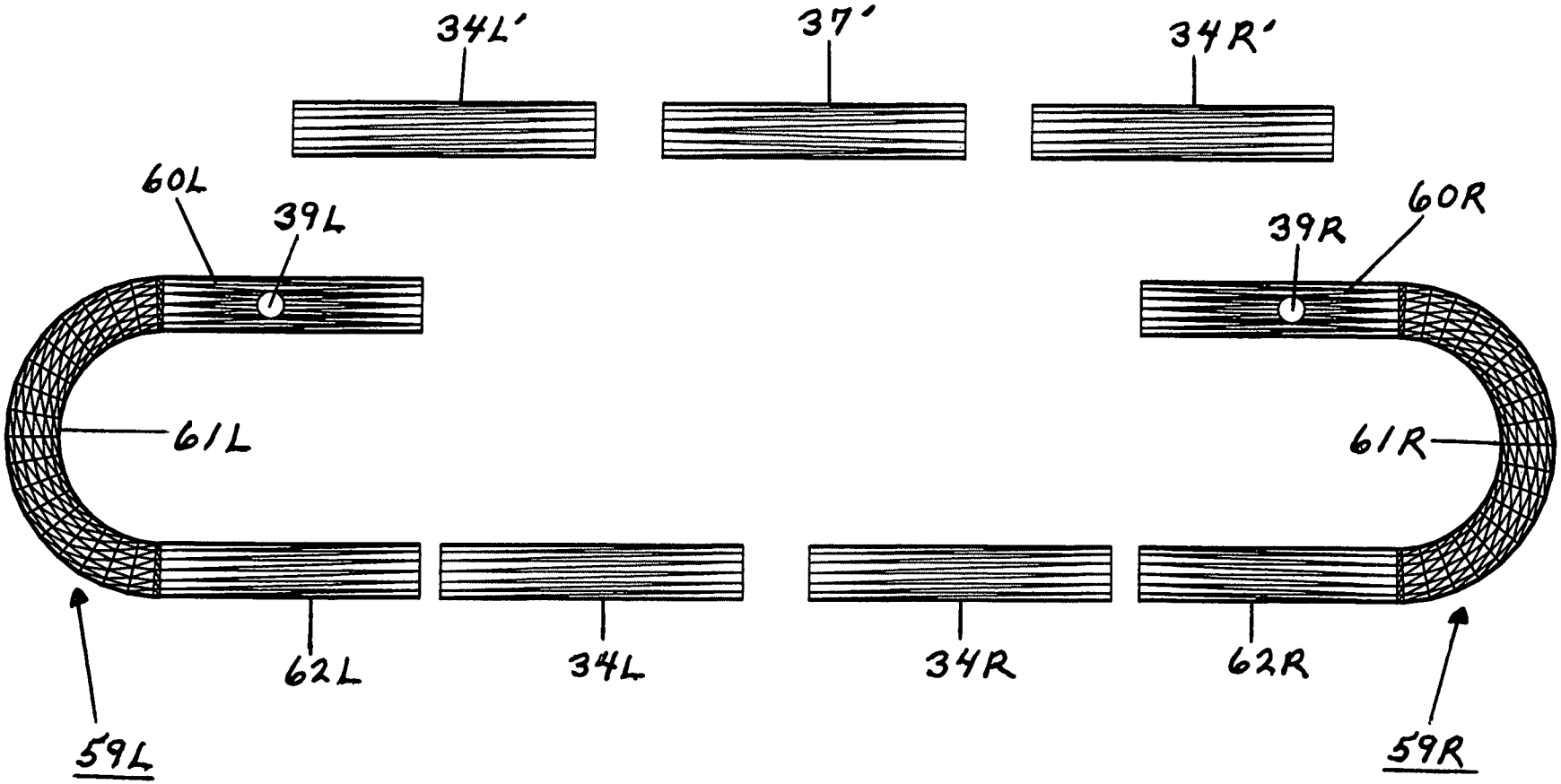
FIG. 6A is a top view of the primary components of a third Type 1 embodiment that includes a single-drapery rod.

FIG. 6A is a top view of the component rods of a third Type 1 embodiment that includes a single-drapery rod. This single-drapery rod is comprised of three telescopically inter-engaging rods. While not as common as the binary or unitary single-drapery rod, the three-piece rod is less reliant on center-support brackets and the strength of each component rod. It may therefore be preferred when heavy drapes must be supported over wide expanses. Additional component rods include back center rod 37', front rods 34L and 34R, and curved rods 59L and 59R comprised of left and right curved segments 61L and 61R sandwiched between substantially straight back segments 60L and 60R and front segments 62L and 62R. Back center rod 37' is telescopically inter-engaged with left and right back rods 34L' and 34R' and 34L' and 34R' are telescopically engaged with 60L and 60R without covering apertures 39L and 39R while keeping curved rods 59L and 59R in the same plane. Left and right front rods 34L and 34R (equivalent to those in the embodiment of FIG. 4A assuming the single-drapery rods of that embodiment and this one are telescopically compatible) are telescopically engaged with 62L and 62R. 34L', 37', 34R', 60L, and 60R form the back section of the dual-drapery rod; curved sections 61L and 61R form the intermediate section; 62L and 34L form the left front section; and 62R and 34R form the right front section. Rods 34L' and 34R' are identical to 34L and 34R except in their placement. This Type 1 embodiment, like the one shown in FIG. 4A, is easily converted to a Type 2 embodiment with the simple addition of a front center rod as shown in FIG. 6B.

Figure 6B:
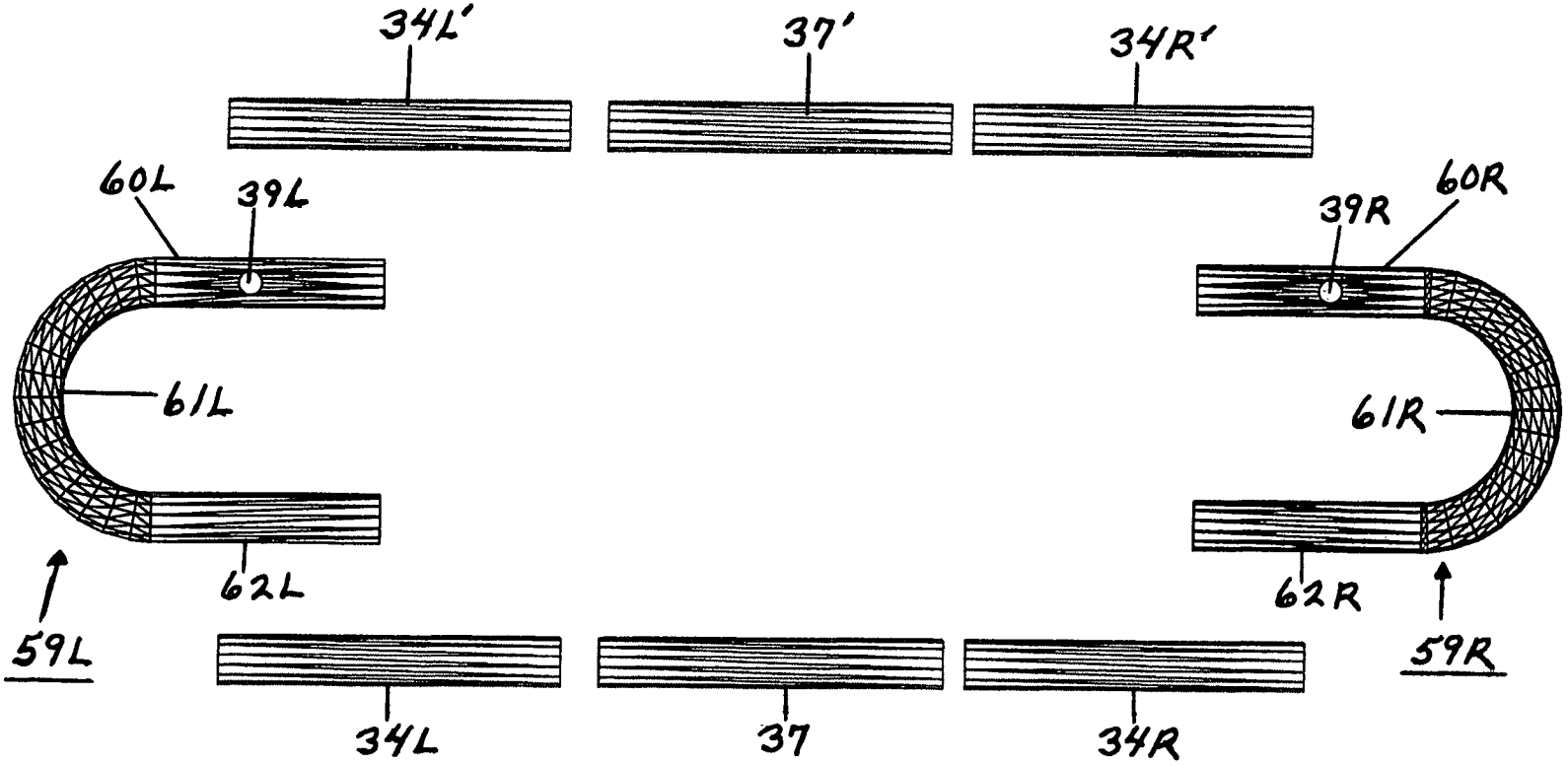
FIG. 6B is a top view of the component rods of a third Type 2 embodiment that includes a single-drapery rod.

FIG. 6B is a top view of the component rods of the third Type 2 embodiment that includes a single-drapery rod. Components include front center rod 37 plus the components of the Type 1 rod shown in FIG. 6A. 37 is telescopically inter-engaged between 34L and 34R to form a continuous front section that can support fully drawn primary drapery.

Figure 7A:
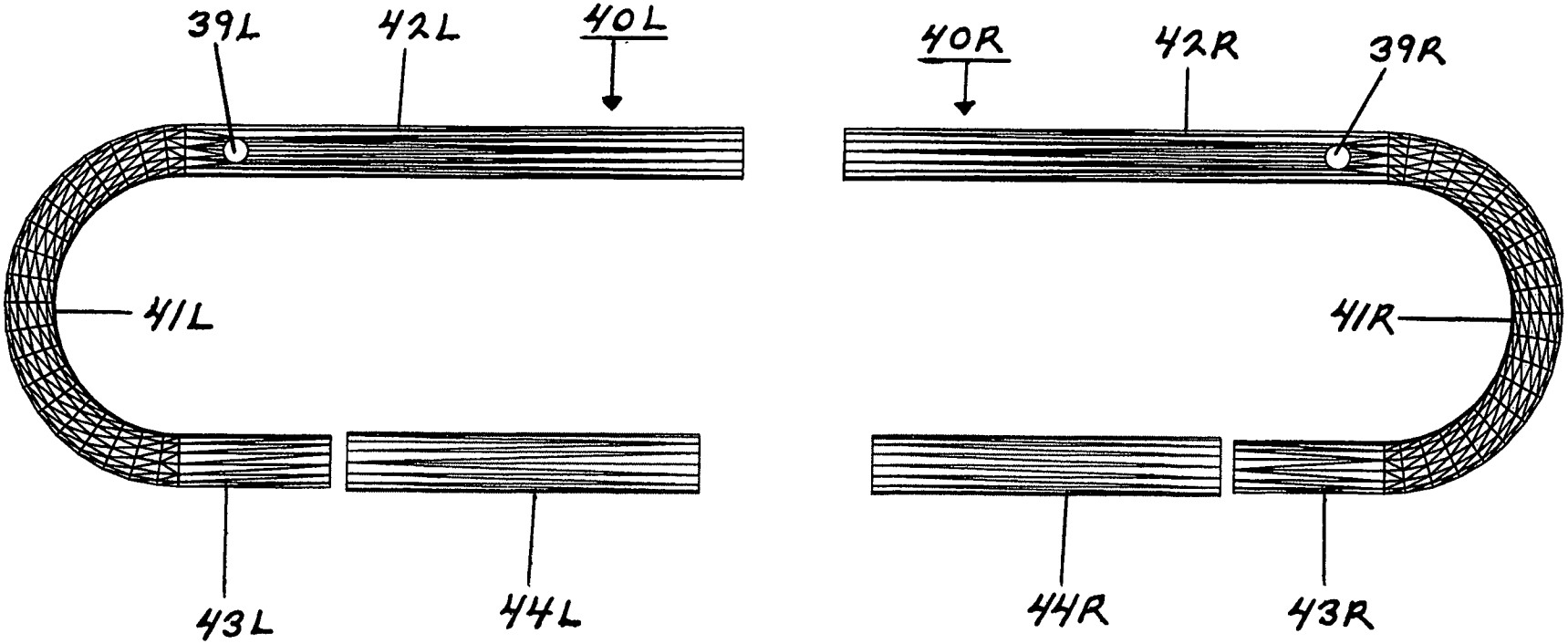
FIG. 7A is a top view of the primary components of a fourth Type 1 embodiment, which doesn't include a single-drapery rod.

FIG. 7A is a top view of the primary components of a fourth Type 1 embodiment. Unlike the others, it does not include a single-drapery rod or convert an existing one into a dual-drapery rod. It is comprised of fewer components than the others, however, so it may be less expensive to manufacture, inventory, and/or package when using some processes and facilities.

The components of this embodiment include telescopically inter-engaging left and right main rods 40L and 40R and left and right front rods 44L and 44R. Rods 40L and 40R are comprised of 180° curved segments 41L and 41R sandwiched between substantially straight back segments 42L and 42R and front segments 43L and 43R, 42L and 42R are substantially longer than 43L and 43R. Apertures 39L and 39R penetrate through 42L and 42R at points substantially adjacent to 41L and 41R. The drapery rod is assembled by telescopically inter-engaging 42L with 42R, 43L with 44L, and 43R with 44R while keeping rods 40L and 40R in substantially the same plane. The left and right back sections of the rod are formed by 42L and 42R, the intermediate section by 41L and 41R, the left front section by 43L and 44L, and the right front section by 43R and 44R.

Figure 7B:
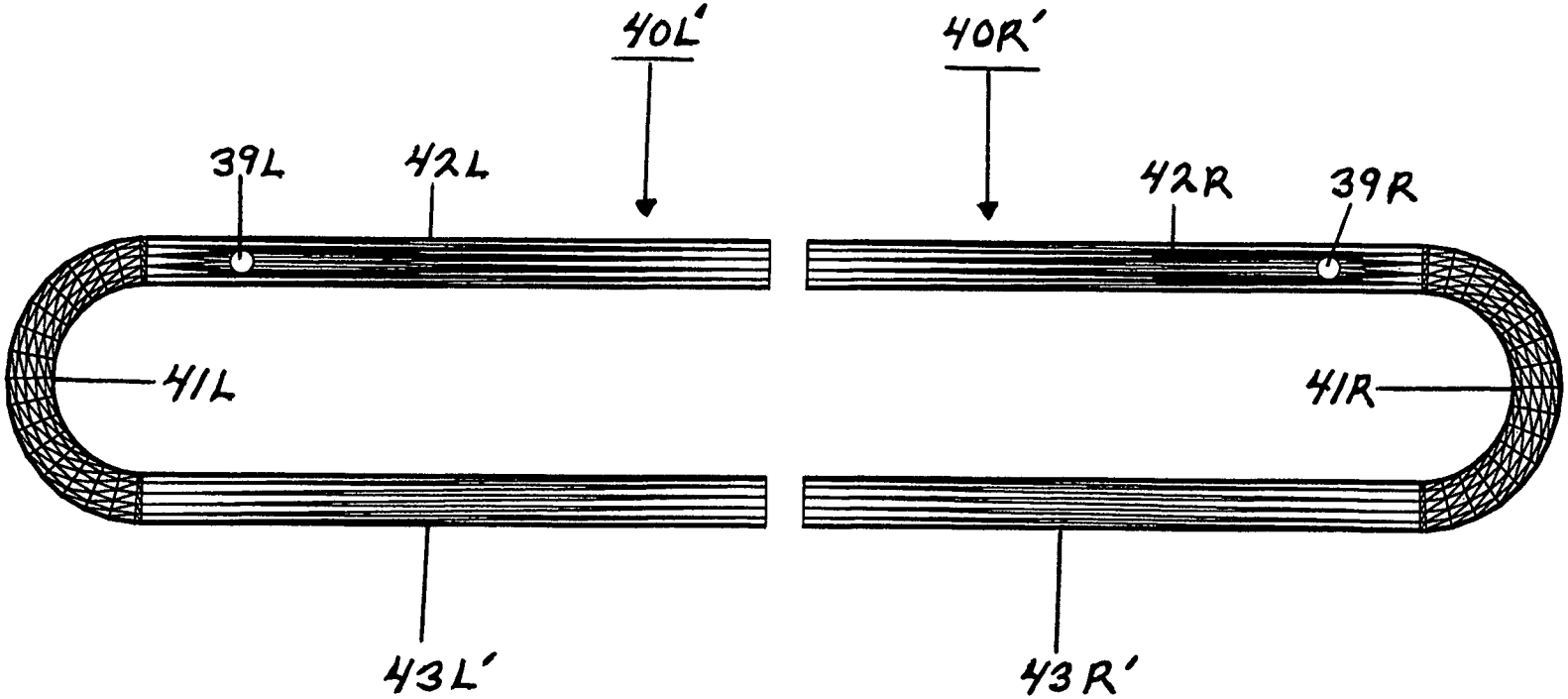
FIG. 7B is a top view of the primary components of a fourth Type 2 embodiment, which doesn't include a single-drapery rod.

FIG. 7B is a top view of the primary components of a fourth Type 2 embodiment, which doesn't include a single-drapery rod. Like its Type 1 counterpart, this embodiment is comprised of fewer components than the other Type 2 embodiments. Component rods do not include left and right front rods, only left and right main rods 40L' and 40R'. Rods 40L' and 40R' are comprised of the same curved segments 41L and 41R and back segments 42L and 42R of rods 40L and 40R shown in FIG. 7A, but front segments 43L' and 43R' are modified versions of 43L and 43R that are approximately as long as back segments 42L and 42R. As before, apertures 39L and 39R penetrate through 42L and 42R at points substantially adjacent to 41L and 41R and are not covered up when the rods are telescopically inter-engaged. The back section and intermediate sections are formed as in FIG. 7A. However, left and right front sections formed by 43L' and 43R' extend and telescopically inter-engage to form a continuous front section capable of supporting fully drawn primary drapery.

FIGS. 8-11 show single-drapery rods mounted with the preferred non-adjustable mounting bracket of FIG. 2A onto opposing vertical support surfaces like that found surrounding recessed windows. This contrasts with previous figures which show or assume wall-mounting. Since the cylindrical shape of the third member allows it to rotate 360 degrees within the perpendicularly disposed receiving aperture, the base plate of the bracket can actually be attached to vertical support surfaces lying at nearly any angle from the single-drapery rod as long as the third member is further from the base plate than from the end of the rod at that angle. The brackets shown in FIGS. 2A and 2B could also be used to attach the single-drapery rods to the ceiling with the simple addition of a collar at the end of the bracket's third member.

Figure 8:
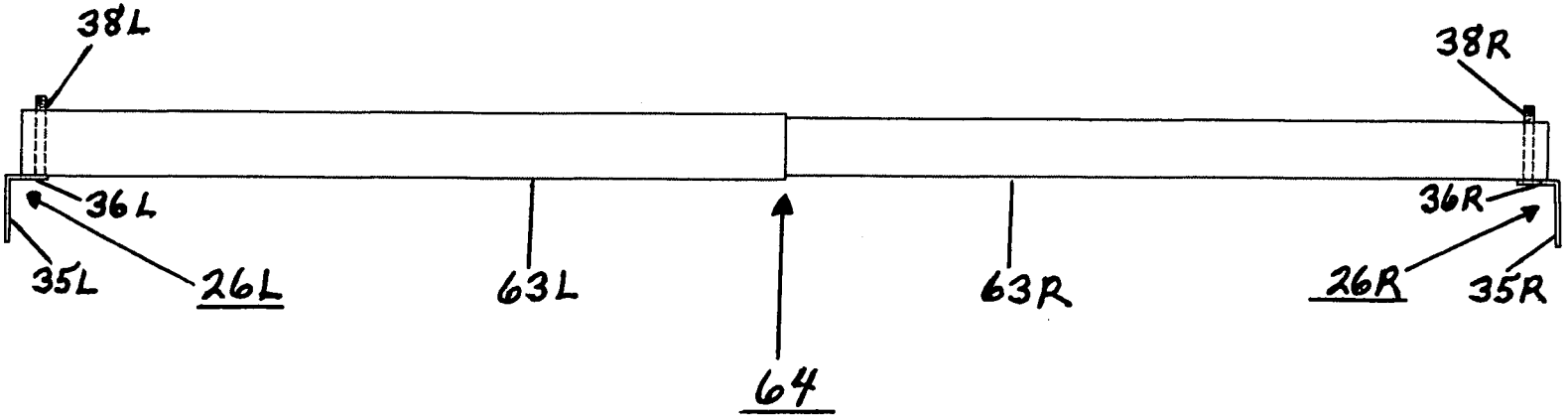
FIG. 8 is a side view of the preferred embodiment of the single-drapery rod mounted on opposing vertical support surfaces.

FIG. 8 is a side view of the preferred embodiment of the single-drapery rod mounted on opposing vertical support surfaces. Single-drapery rod 64 is comprised of telescopically inter-engaging left and right rods 63L and 63R. Apertures penetrate the rod's top and bottom surfaces in a substantially perpendicular direction at points substantially adjacent to the left end of 63L and right end of 63R. Third members 38L and 38R of mounting brackets 26L and 26R fit through the apertures and engage the surfaces surrounding the apertures while second members 36L and 36R engage the bottom surfaces of 63L and 63R and 35L and 35R engage the opposing support surfaces.

Figure 9:
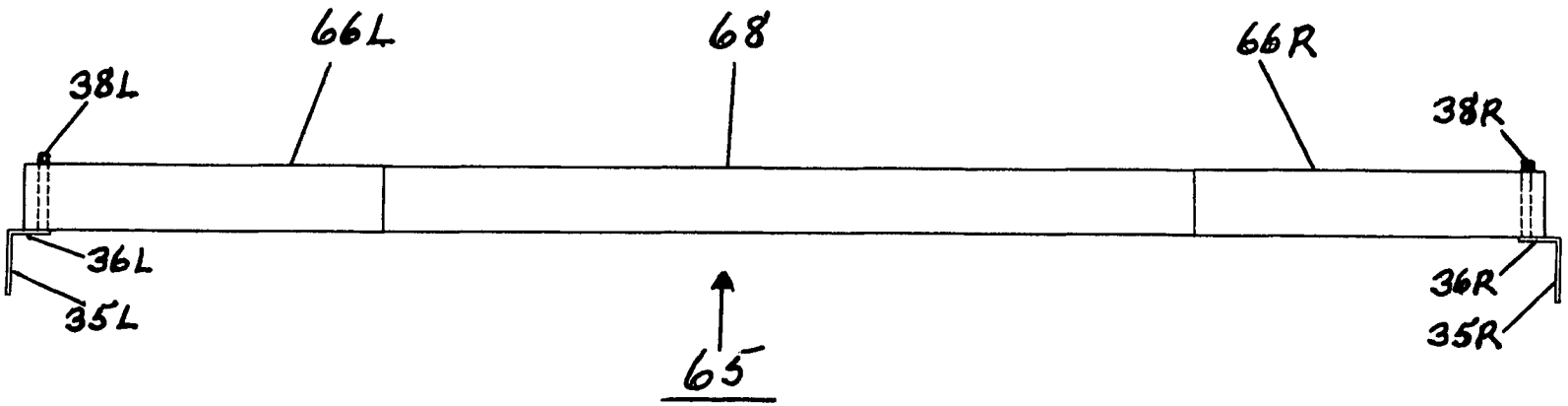
FIG. 9 is a side view of a second embodiment of the single-drapery rod mounted on opposing vertical support surfaces.

FIG. 9 is a side view of a second embodiment of the single-drapery rod and bracket. This embodiment has more component rods than the first, but is less reliant on center support brackets and the strength of each of the component rods to prevent the rod from sagging under the weight of a wide expanse of drapery. In this embodiment, single-drapery rod 65 is comprised of center rod 68 telescopically inter-engaged between left and right rods 66L and 66R. Third members 38L and 38R engage the surfaces surrounding the apertures penetrating rods 66L and 66R as in FIG. 8 while second members 36L and 36R engage the bottom surfaces of 66L and 66R and base plates 35L and 35R engage the opposing support surfaces.

Figure 10:
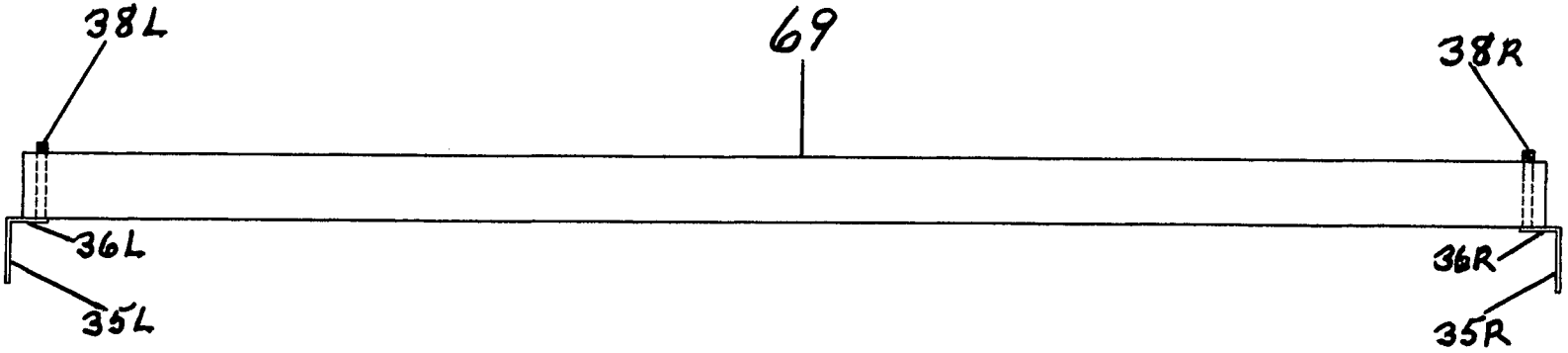
FIG. 10 is a side view of a single-drapery rod comprised of a single rod rather than a plurality of telescoping rods mounted on opposing vertical support surfaces.

FIG. 10 is a side view of a single-drapery rod comprised of a single rod 69 rather than a plurality of telescoping rods. Members 35, 36, and 38L and 38R operate as in FIGS. 8-9.

Figure 11:
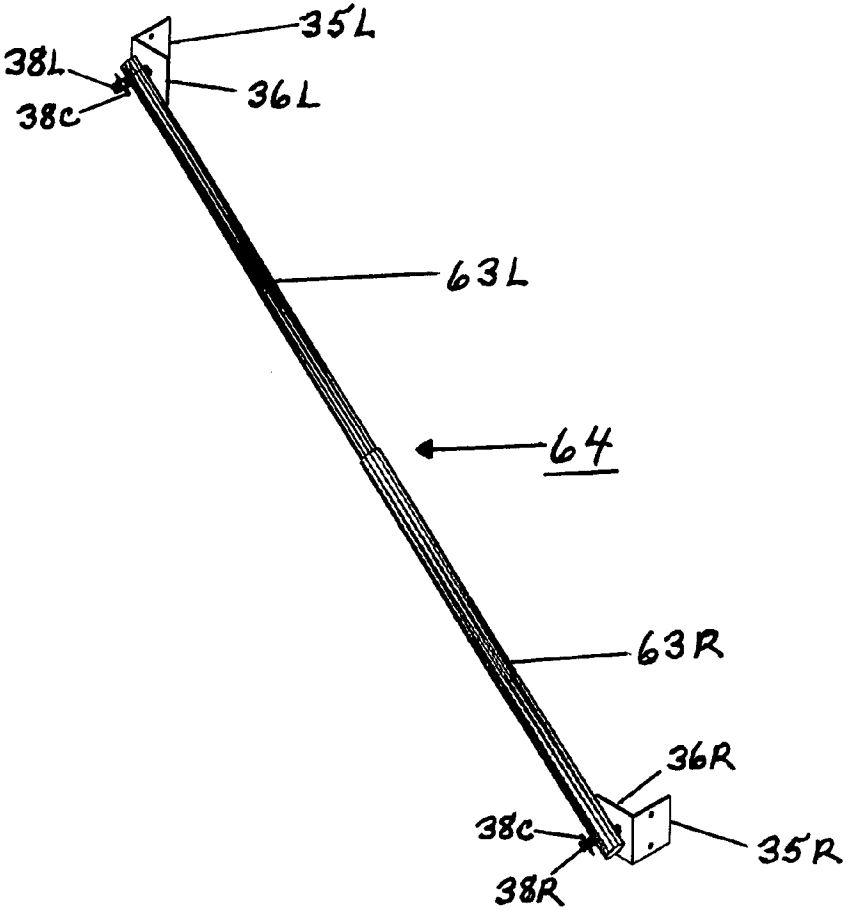
FIG. 11 is a perspective view from above and to the right of the preferred embodiment of the single-drapery rod mounted to opposing surfaces at a substantially non-perpendicular angle.

FIG. 11 is perspective view from above and to the right of the preferred embodiment of the single-drapery rod. As in FIGS. 8-10, base plates 35L and 35R are shown as if mounted on a perpendicularly disposed support surface (not shown) like that found surrounding recessed windows. However, 35L and 35R have been mounted at substantially different heights on the opposing support surfaces. This is possible if second members 36L and 36R are sufficiently elongated since cylindrical third members 38L and 38R can rotate within their receiving apertures and rods 63L and 63R can also be rotated. Collars 38C fitting tightly over 38L and 38R are an appropriate means of securing the rod to the brackets when their third members are substantially horizontal as in FIG. 11.

FIGS. 12-15 show embodiments of component rods that assemble into Type 1 or 2 dual drapery rods incorporating one of the single-drapery rods shown in FIGS. 8-10. All are designed to be mounted on a wall with the preferred wall mounting bracket of FIG. 2A or 2B, and of course all include two rods with segments curved approximately 180 degrees over a pre-determined distance and sandwiched between substantially straight segments. FIGS. 12A-15A show Type 1 and FIGS. 12B-15B show Type 2 components combined with one of the single-drapery rods of FIGS. 8-10. All of the embodiments employ perpendicularly disposed circular apertures 39L and 39R penetrating the appropriate component rods in order to match the perpendicularly extending third member of the preferred wall mounting bracket. Mounting the rods to a ceiling would require the adjustments previously discussed (following the description of FIG. 2B and before the descriptions of FIGS. 4-7).

Figure 12A:
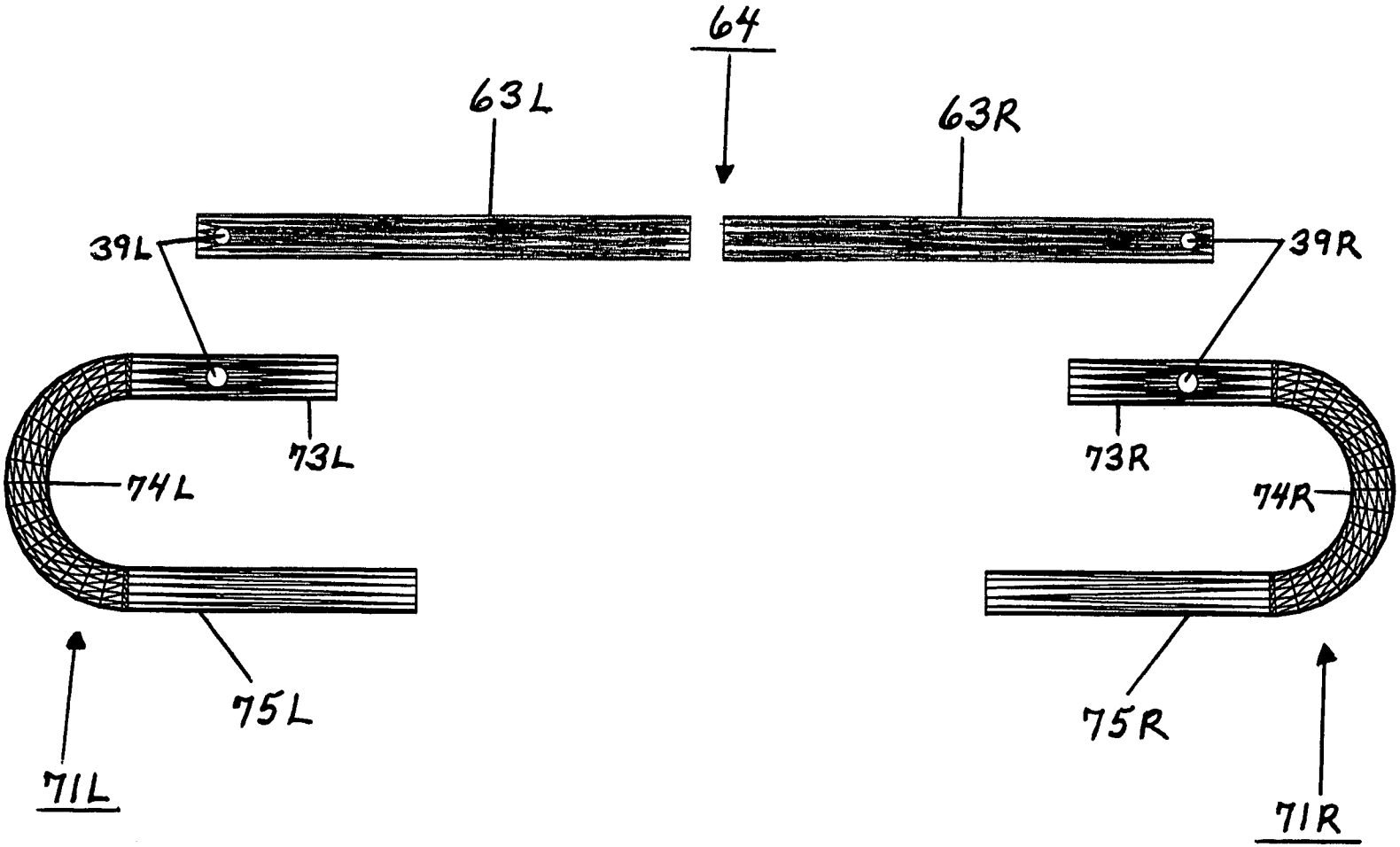
FIG. 12A is a top view of Type 1 component rods that combine dual-drapery rod components with the preferred single-drapery rod of FIG. 8.

FIG. 12A is a top view of Type 1 component rods that combine dual-drapery rod components with the preferred single-drapery rod of FIG. 8. Single-drapery rod 64 is comprised of telescopically engaged back center rods 63L and 63R. Left and right curved rods 71L and 71R are comprised of curved segments 74L and 74R sandwiched between substantially straight left and right back segments 73L and 73R and left and right front segments 75L and 75R, the latter sized appropriately to just support accent drapery and leave an unobstructed view of the primary drapery in back. The dual-drapery rod is assembled by telescopically inter-engaging 63L with 73L while aligning apertures 39L and telescopically inter-engaging 63R with 73R while aligning apertures 39R, keeping rods 71L and 71R in substantially the same plane. The back section of the assembled rod is comprised of 73L, 63L, 63R, and 73R; the intermediate sections by 74L and 74R; and the front sections by 75L and 75R.

Figure 12B:
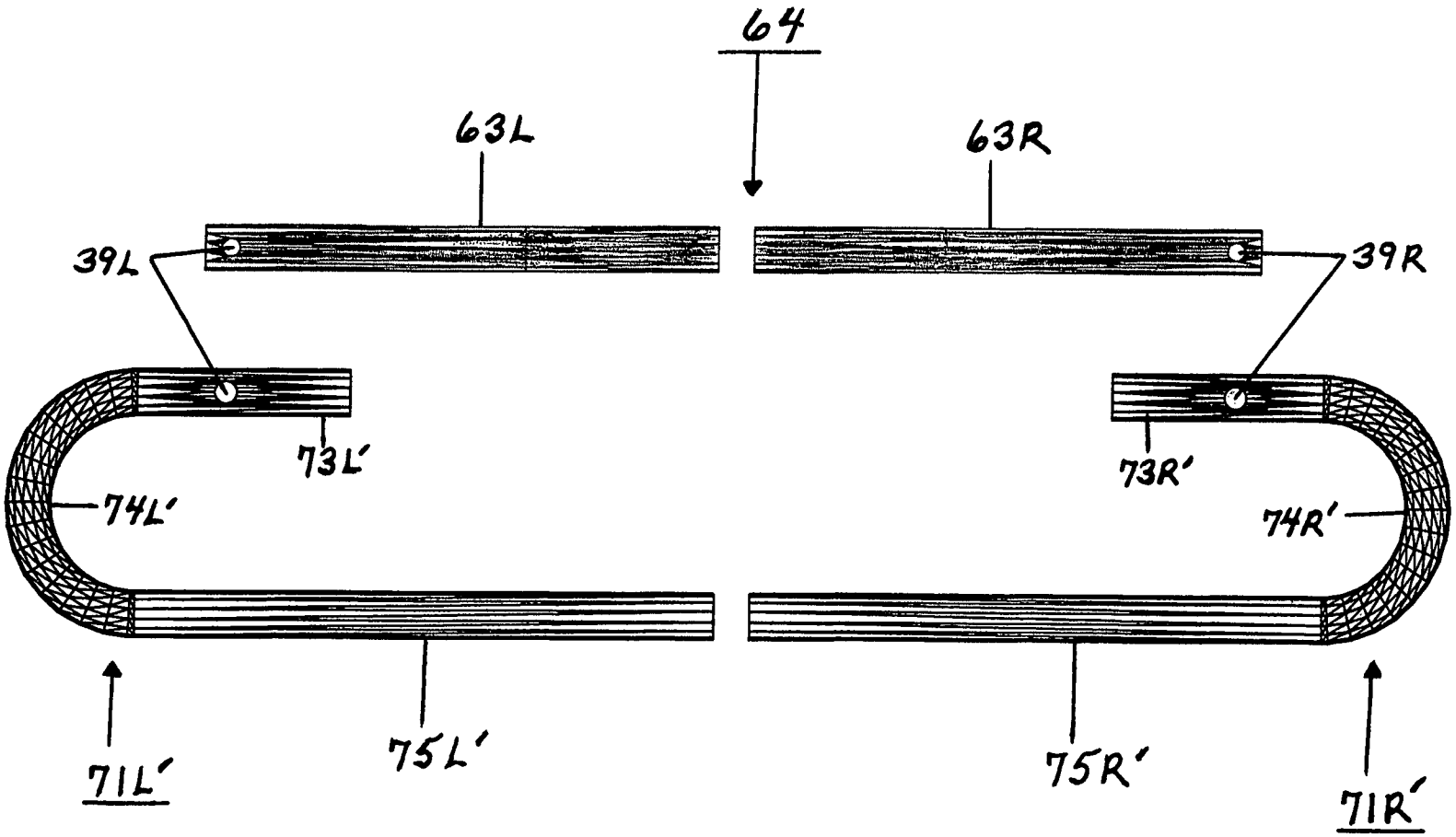
FIG. 12B is a top view of Type 2 component rods that combine dual-drapery rod components with the preferred single-drapery rod of FIG. 8.

FIG. 12B is a top view of Type 2 component rods that also combines the single-drapery rod shown in FIG. 8 with dual-drapery rod components having curved segments sandwiched between substantially straight back and front segments. However, front segments 75L' and 75R' of 71L' and 71R' are extended so they engage when 73L' and 73R' are telescopically engaged with inter-engaged rods 63L and 63R and apertures are properly aligned.

The embodiments of FIGS. 13-15 combine one of the single-drapery rods shown in FIGS. 8-10 with dual-drapery rod components similar or identical to those included in the embodiments of FIGS. 5-6.

Figure 13A:
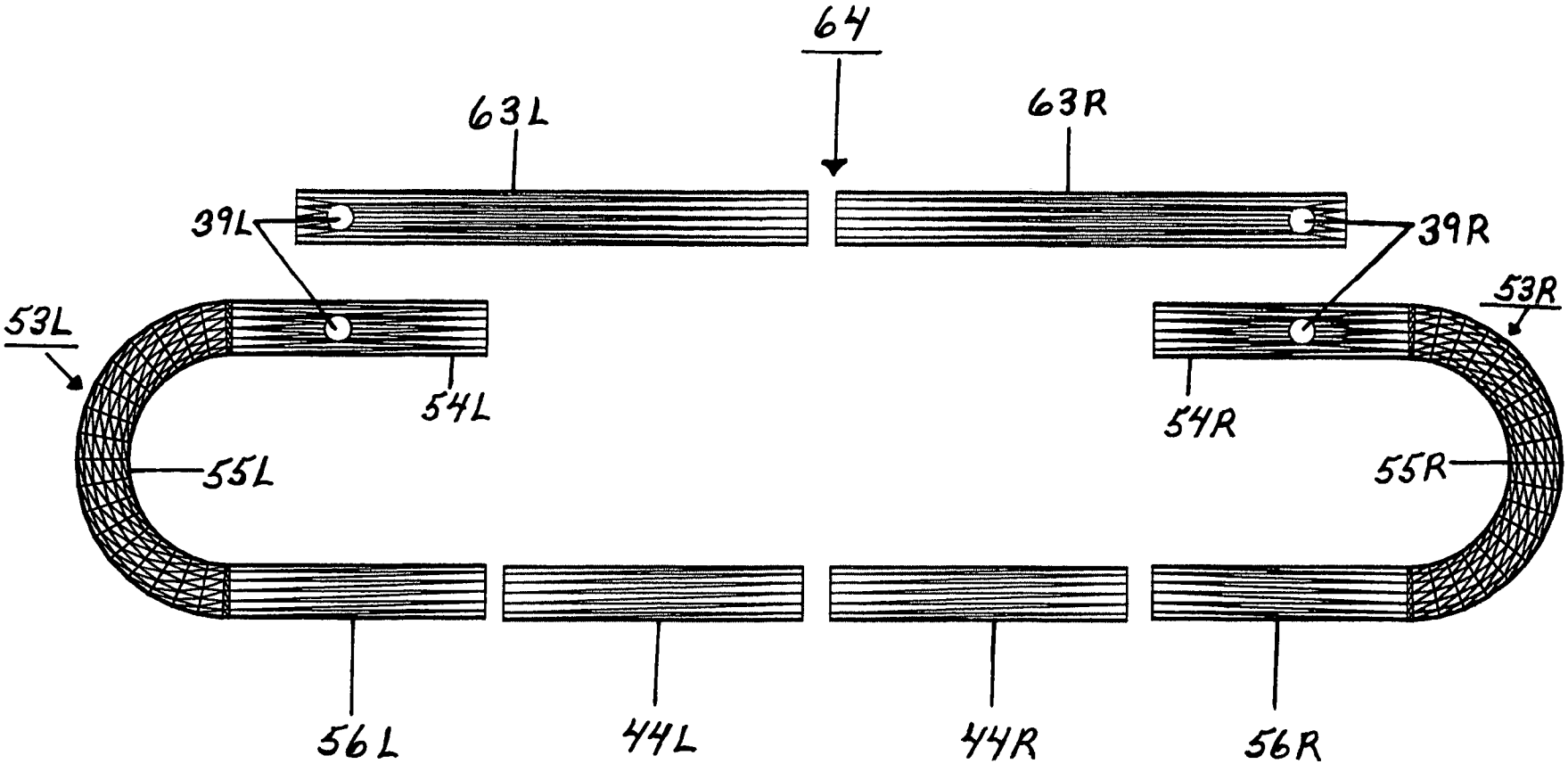
FIG. 13A is a top view of Type 1 component rods that combine the preferred single-drapery rod of FIG. 8 with dual-drapery rod components similar or identical to those shown in FIG. 5A.

FIG. 13A is a top view of Type 1 component rods that combine the preferred single-drapery rod of FIG. 8 with dual-drapery rod components similar or identical to those shown in FIG. 5A. The embodiment of FIG. 13A, like 5A, includes curved rods 53L and 53R comprised of left and right curved segments 55L and 55R sandwiched between substantially straight back segments 54L and 54R and front segments 56L and 56R as well as left and right front rods 44L and 44R. Single drapery rod 64, comprised of back center rods 63L and 63R, is similar to 52L and 52R in FIG. 5A but with apertures. Back center rods 63L and 63R are assumed to have the same inside and outside circumferences as back center rods 52L and 52R of FIG. 5A and thus are assumed to be telescopically equivalent.

The drapery rod of FIG. 13A is assembled by telescopically engaging 63L with 54L while aligning apertures 39L; telescopically engaging 63R with 54R while aligning apertures 39R; and telescopically engaging 56L with 44L and 56R with 44R. The back section of the assembled dual-drapery rod is comprised of 54L, 63L, 63R, and 54R; the intermediate sections are comprised of 55L and 55R; and the left and right front sections are comprised of 56L and 44L and 56R and 44R.

Figure 13B:
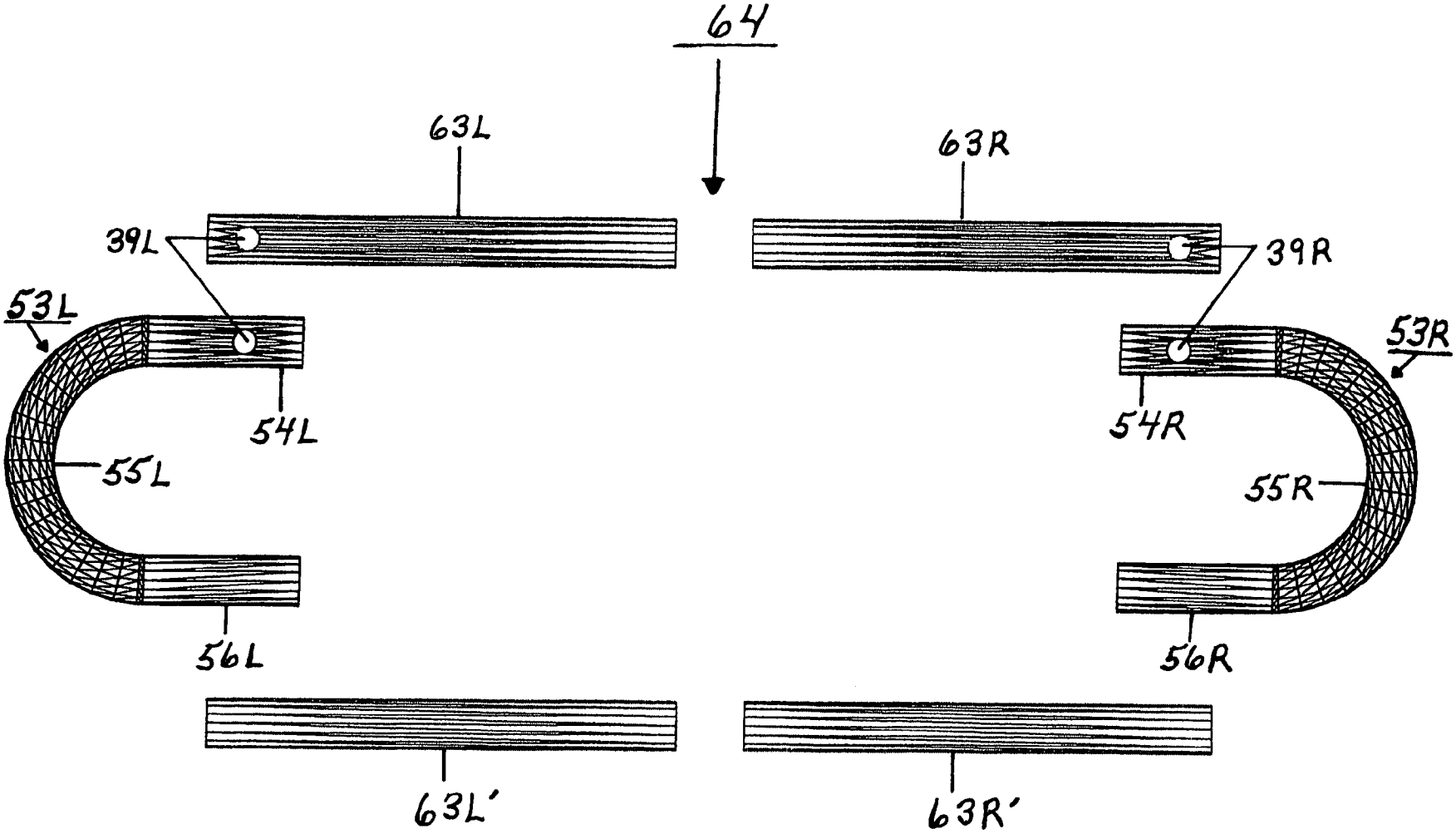
FIG. 13B is a top view of Type 2 component rods that combine the preferred single-drapery rod of FIG. 8 with dual-drapery rod components similar or identical to those shown in FIG. 5B.

FIG. 13B is a top view of Type 2 component rods that combine the preferred single-drapery rod of FIG. 8 with dual-drapery rod components similar or identical to those shown in FIG. 5B. Front rods 44L and 44R of FIG. 13A are replaced with 63L' and 63R', which are identical to 52L' and 52R' in FIG. 5B and similar to 63L and 63R in FIG. 13B but have no apertures. 63L' and 63R' telescopically engage each other and 56L and 56R to form a continuous front section capable of supporting fully drawn primary drapery.

Figure 14A:
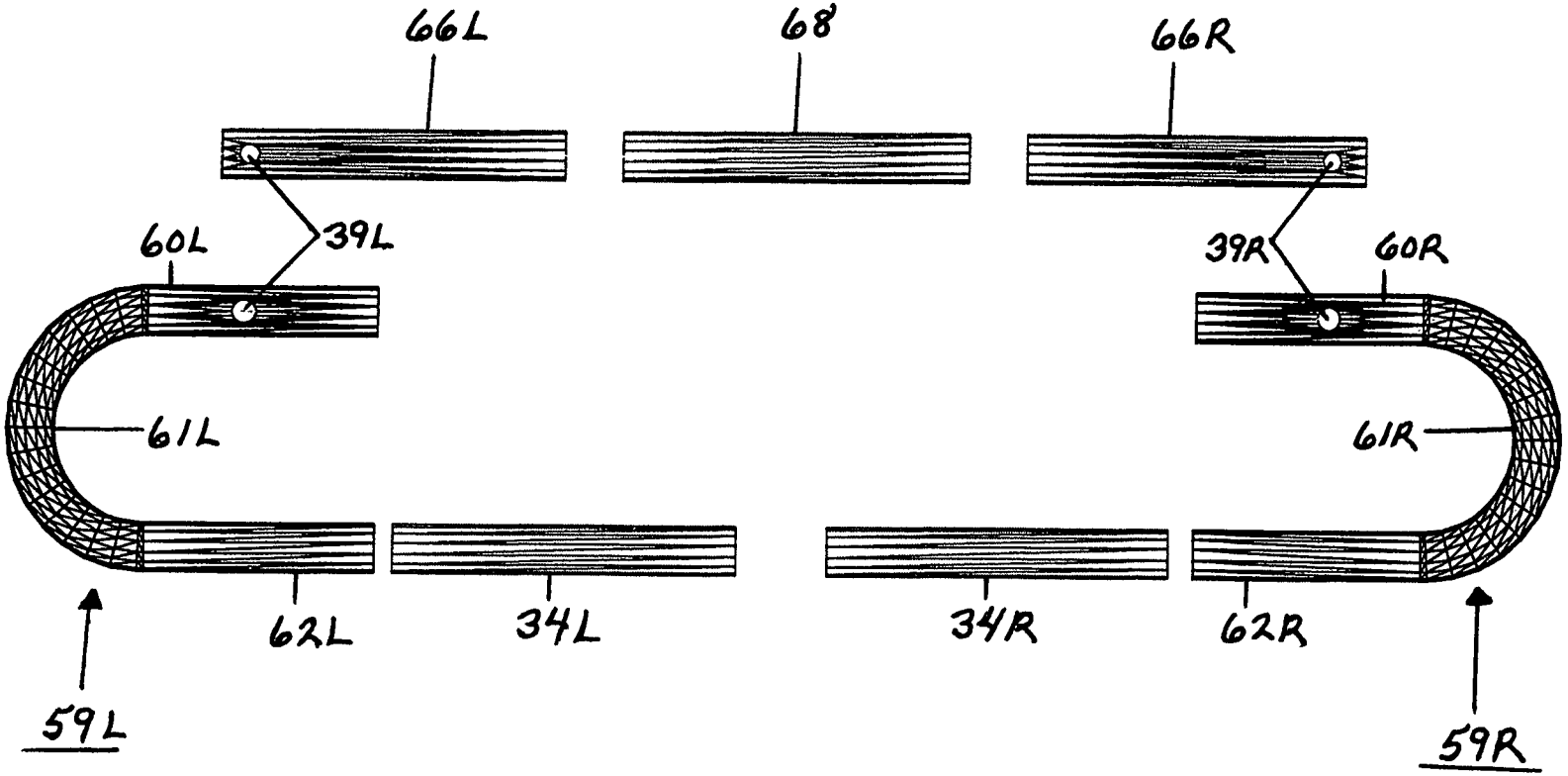
FIG. 14A is a top view of Type 1 component rods that combine the single-drapery rod of FIG. 9 with dual-drapery rod components similar or identical to those shown in FIG. 6A.

FIG. 14A is a top view of Type 1 component rods that combine the single-drapery rod of FIG. 9 with the two curved rods 59L and 59R and two substantially straight left and right front rods 34L and 34R of embodiment shown in FIG. 6A. Back center rod 68 is telescopically inter-engaged with left and right rods 66L and 66R to form the single-drapery rod of FIG. 9. The dual-drapery rod is formed by telescopically engaging 60L with 66L while aligning apertures 39L; telescopically engaging 60R with 66R while aligning apertures 39R; and telescopically engaging 34L with 62L and 34R with 62R. Rods 66L, 68, and 66R and segments 60L and 60R form the back section; curved segments 61L and 61R form the intermediate section; 62L and 34L form the left front section; and 62R and 34R form the right front section.

Figure 14B:
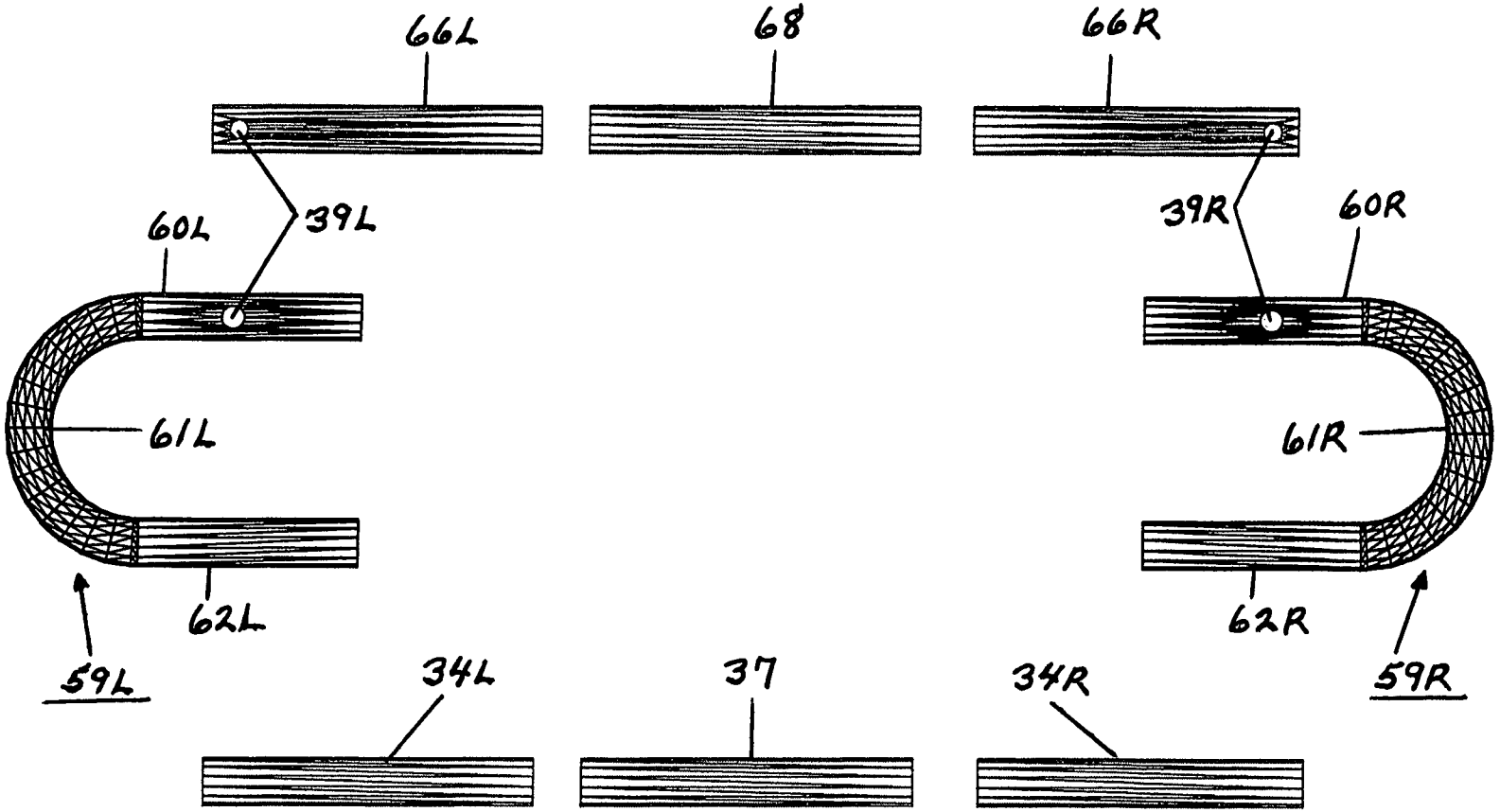
FIG. 14B is a top view of Type 2 component rods that combine the single-drapery rod of FIG. 9 with dual-drapery rod components similar or identical to those shown in FIG. 6B.

FIG. 14B is a top view of Type 2 component rods that combine the single-drapery rod of FIG. 9 with dual-drapery rod components similar or identical to those shown in FIG. 6B. This Type 2 embodiment is identical to the Type 1 embodiment of FIG. 14A except that front center rod 37 is added and telescopically inter-engaged between front rods 34L and 34R to form a continuous front section capable of supporting fully drawn primary drapery.

Figure 15A:
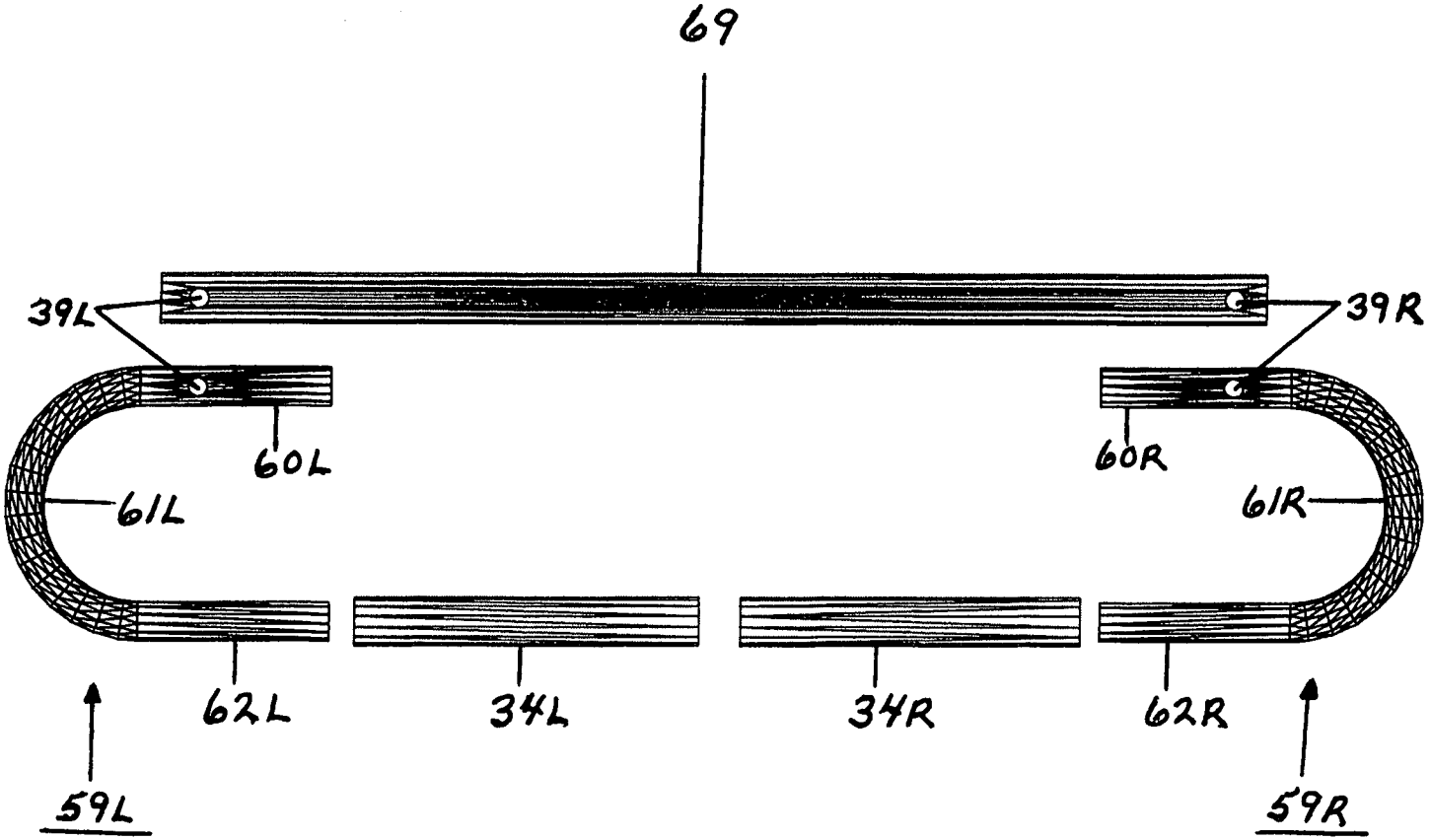
FIG. 15A is a top view of Type 1 component rods that combine the single-drapery rod of FIG. 10 with dual-drapery rod components similar or identical to those shown in FIG. 6A.

FIG. 15A is a top view of the components of a Type 1 dual-drapery rod that combines the single-drapery rod embodiment of FIG. 10 with the two curved rods 59L and 59R and two front rods 34L and 34R of the dual-drapery rod embodiment of FIG. 6A. Unitary single-drapery rod 69 is telescopically engaged with 60L while aligning apertures 39L in the two rods; 60R is telescoped with 69 while aligning apertures 39R; rod 34L is telescoped with segment 62L; and 34R is telescoped with 62R. The back section of the assembled rod is formed by 60L, 69, and 60R, the intermediate section by segments 61L and 61R of curved rods 59L and 59R, and the left and right front sections by 62L and 34L and 62R and 34R.

Figure 15B:
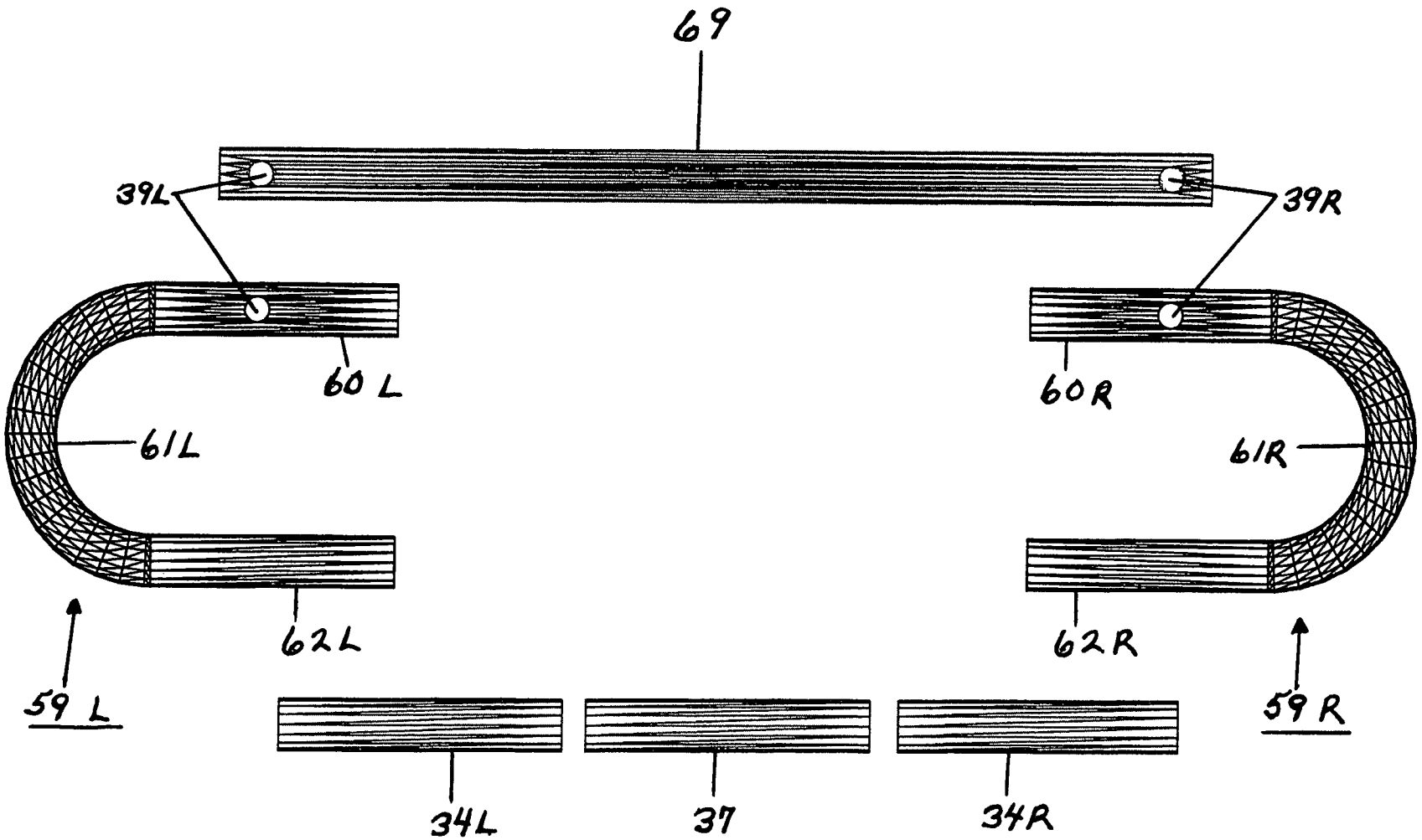
FIG. 15B is a top view of Type 2 component rods that combine the single-drapery rod of FIG. 10 with dual-drapery rod components similar or identical to those shown in FIG. 6B.

FIG. 15B is a top view of the components of a Type 2 dual-drapery rod that combines the single-drapery rod of FIG. 10 with dual-drapery rod components similar or identical to those shown in FIG. 6B. Those components are identical to the components of the Type 1 embodiment of FIG. 15A except that front center rod 37 (also included in the embodiment shown in FIG. 6B) is added. Front center rod 37 telescopes with 34L and 34R to bridge the gap between front sections and create a front section suitable for the primary drapes.

All of the above have circular apertures that cooperate with the cylindrical third members of the preferred bracket of FIGS. 2A and 2B. However, third members and corresponding apertures of different cooperating shapes are also possible, as noted, and may be preferred when apertures are formed with non-slip brackets rather than within the drapery rod itself. Although the use of non-slip brackets adds to the expense, it does provide a feasible alternative capable of effectively securing the dual-drapery rod in a horizontal plane. Embodiments shown in FIGS. 16-22 illustrate this kind of bracketing system.

Figure 16A:
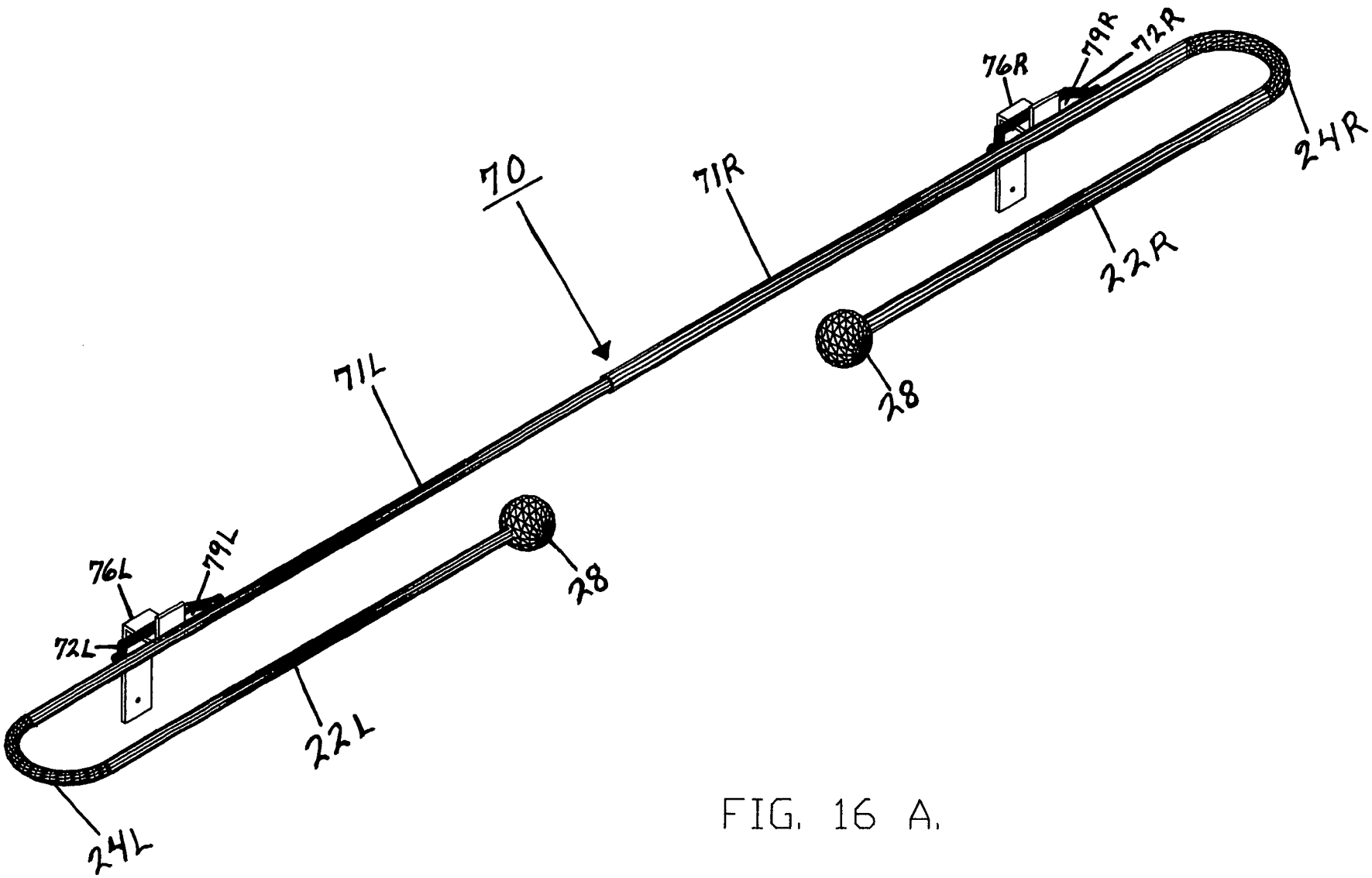
FIGS. 16A and 16B are perspective views from above of dual-drapery rod assemblies with non-slip brackets attached to the back section of the rods.
Figure 16B:
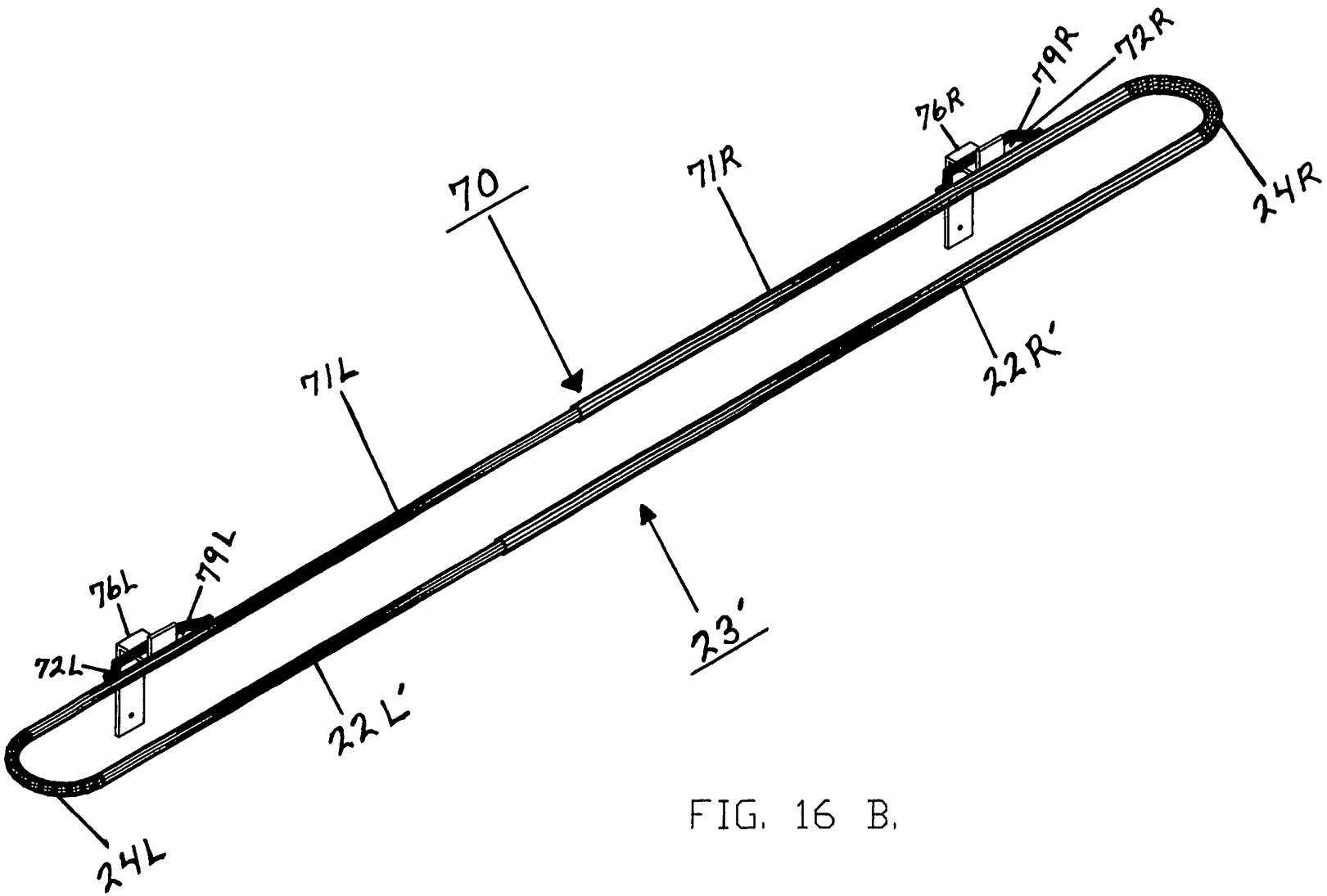

FIGS. 16A and 16B are perspective views from above of dual-drapery rod assemblies with non-slip brackets attached to the back sections of the rods by brazing, welding, or fusion. A different cooperating wall mounting bracket is required like those shown in FIGS. 17A and 17B.

In the Type 1 embodiment shown in FIG. 16A, intermediate sections 24L and 24R and front sections 22L and 22R are identical to those shown in FIG. 1A, but the apertures in the back section of that embodiment have been replaced by non-slip brackets 72L and 72R attached to back section 70 of this embodiment. Non-slip brackets arch away from and back into left and right back sections 71L and 71R in a substantially horizontal plane to form substantially perpendicularly disposed apertures 79L and 79R. Wall mounting brackets 76L and 76R attach to a wall or other substantially vertical support surface and cooperate with non-slip brackets 72L and 72R to secure the rod in a substantially horizontal plane. Finials 28 slip onto the ends. Primary drapery (not shown) is supported by back section 70 between wall mounting brackets 76L and 76R while accent drapery (not shown) is supported primarily by intermediate sections 24L and 24R and front sections 22L and 22R but also by that part of 70L to the left of 72L and to the right of 72R.

In FIG. 16B, front sections 22L' and 22R' are extended versions of 22L and 22R, which meet to form a continuous front section 23' that can accommodate fully-drawn primary drapery. Back section 70 and intermediate sections 24L and 24R are unchanged. Wall mounting brackets 76L and 76R again attach to a substantially vertical support surface and cooperate with the surrounding surfaces of apertures 79L and 79R. Since front sections 22L' and 22R' meet, there are no finials. Primary drapery (not shown) is hung from front section 23 and intermediate sections 24L and 24R while secondary drapery (not shown) is hung from back section 70. Secondary drapery (not shown) is now supported by back section 70 between wall mounting brackets 76L and 76R while primary drapery (not shown) is supported primarily by intermediate sections 24L and 24R and front section 23' but also by that part of 70L to the left of 72L and to the right of 72R.

Figure 16C:
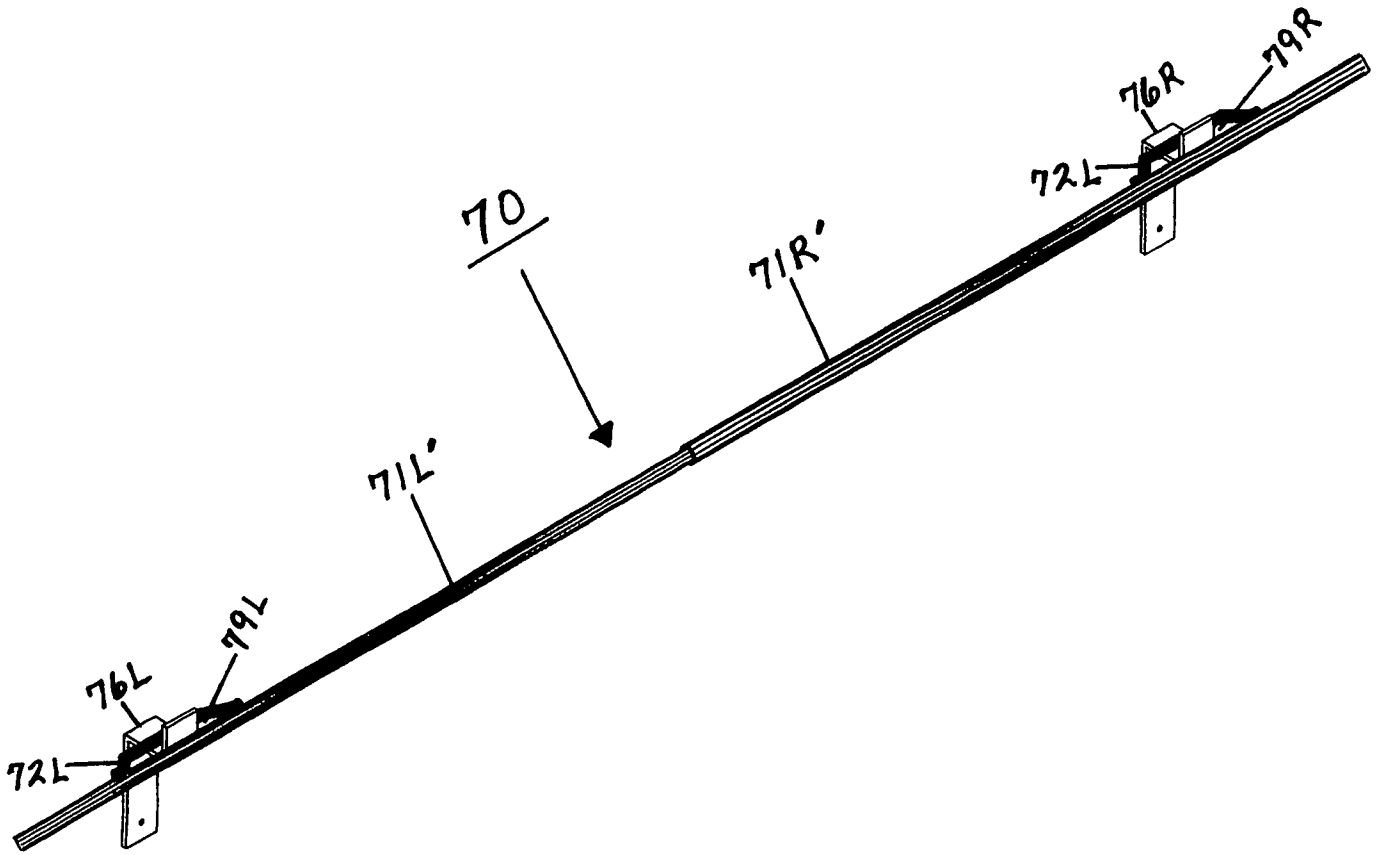
FIG. 16C shows the preferred embodiment of the single-drapery rod with non-slip brackets.

FIG. 16C shows the preferred embodiment of the single-drapery rod with non-slip brackets. The rod includes the back but not the intermediate or front sections that are part of the dual-drapery rod. Back section 70 is comprised of telescoping substantially straight rods 71L' and 71R' together. Non-slip brackets attach to 70 at points substantially adjacent to the single-drapery rod's ends. As before, non-slip brackets 72L and 72R arch away from and back into the rods to form substantially perpendicularly disposed apertures 79L and 79R. Wall mounting brackets 76L and 76R attach to a wall or other substantially vertical support surface and cooperate with the surrounding surfaces of apertures between non-slip brackets 72L and 72R and rods 71L' and 71R' to secure the single-drapery rod.

Figure 17A:
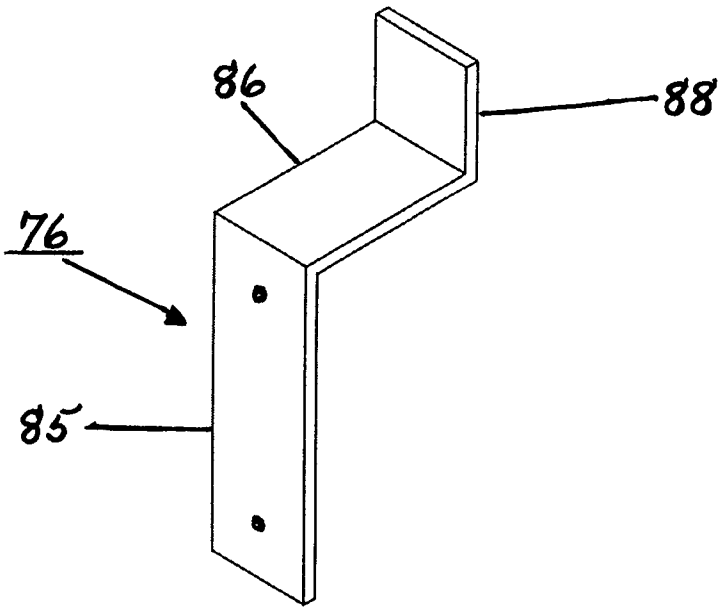
FIG. 17A is a perspective view of the non-adjustable wall mounting bracket that cooperates with non-slip brackets.
Figure 17B:
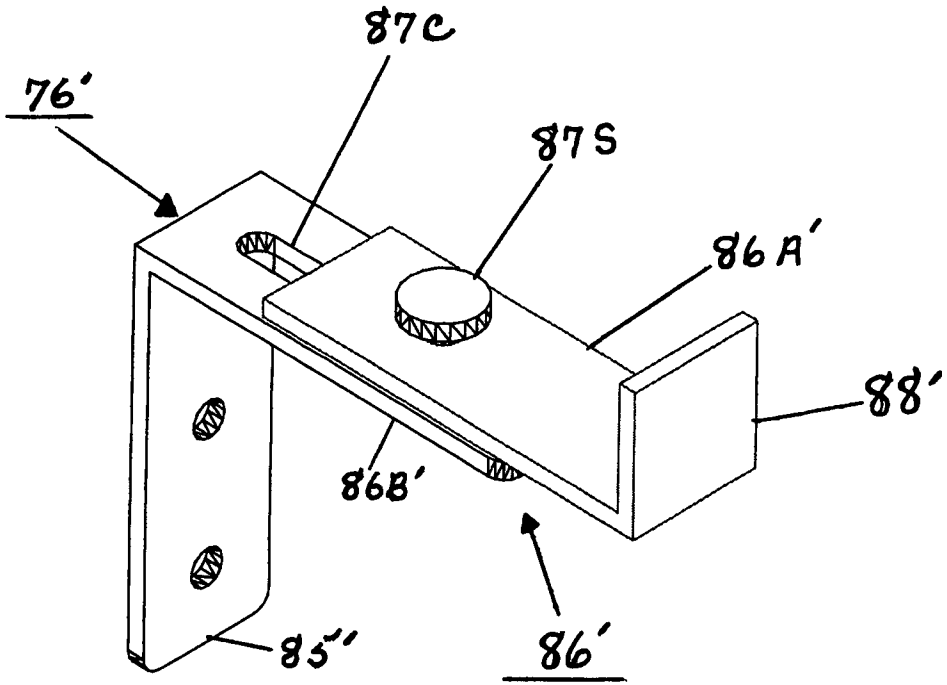
FIG. 17B is a perspective view of the adjustable bracket.
Figure 18:
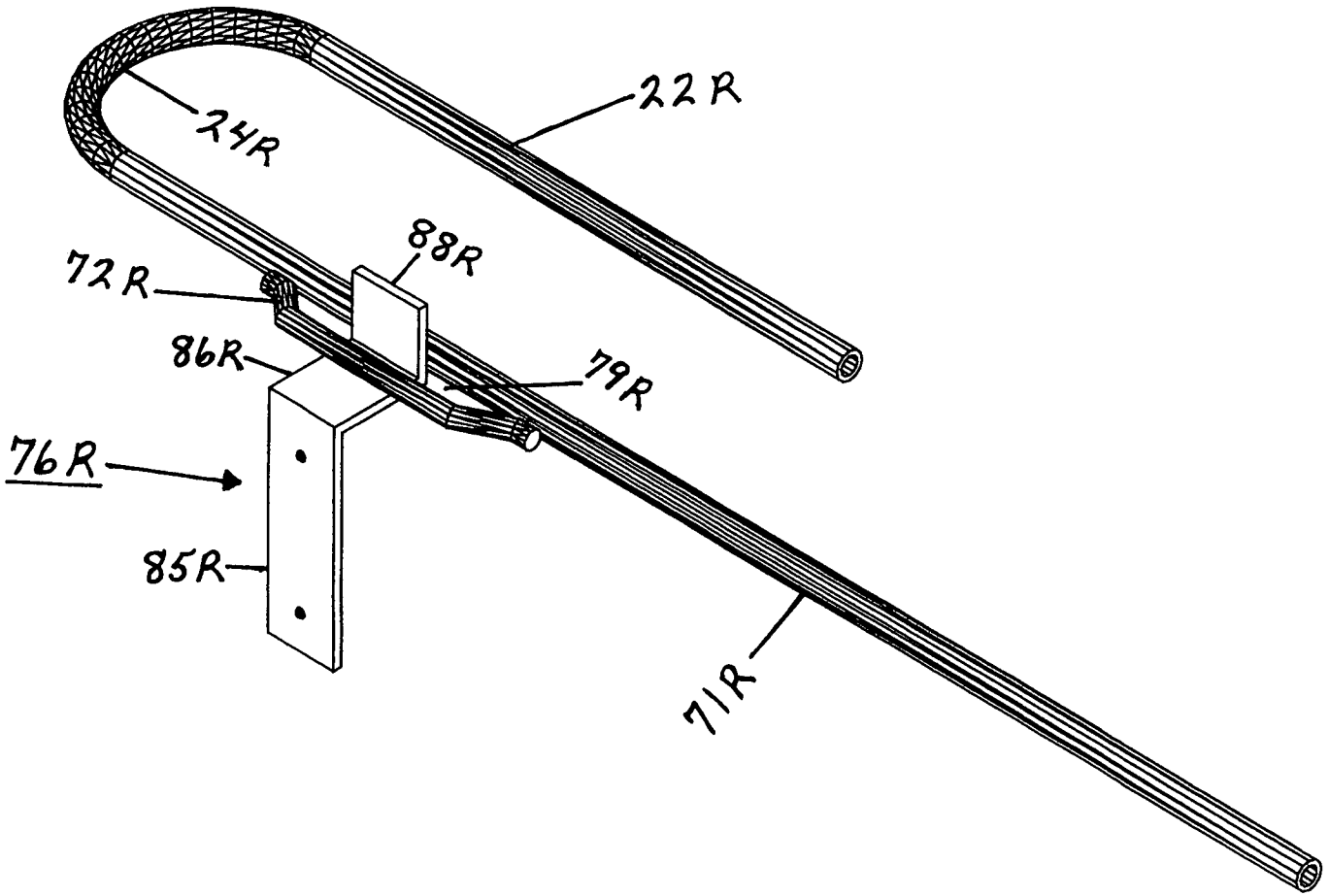
FIG. 18 is a wall-perspective partial view from above of the back section of the dual-drapery rod engaged with the wall mounting bracket of FIG. 17A.

FIGS. 16A-16B display the sections of the Type 1 and 2 dual-drapery rod embodiments but don't identify the inter-engaging component rods which may comprise them or provide a detailed view of the mounting bracket used with them. Non-adjustable and adjustable versions of the mounting bracket are shown in FIGS. 17A and 17B. FIG. 18 shows the bracket of FIG. 17A engaging the right back section of the dual-drapery rod of FIG. 16A. FIGS. 18-22 show dual-drapery embodiments which use the bracket shown in FIG. 16A but are comprised of different configurations of inter-engaging component rods.

FIG. 17A is a perspective view of the non-adjustable version of the wall mounting bracket that cooperates with the non-slip brackets. Wall mounting bracket 76 includes a first member comprised of a base plate 85 with a vertically elongated body, a second member 86 having a horizontally elongated body extending substantially perpendicularly from base plate 85, and a third member 88 having a vertically elongated body extending upwardly and substantially perpendicularly from second member 86. The three members may be formed from a single elongated plate or made from two or more plates attached together using some method such as welding, brazing, or fusion. First member 85 is adapted to attach to a wall or other vertical support surface using screws, wall anchors, or other attachment means (not shown) while second member 86 engages the bottom surface of the non-slip brackets and third member 38 engages the surrounding surfaces of the apertures created by the opposing surfaces of the non-slip bracket and drapery rod (see FIG. 18).

FIG. 17B is a perspective view of the adjustable version. Second member 86' of adjustable wall mounting bracket 76' is comprised of upper and lower second members 86A' and 86B'. Longitudinally disposed channel 87C in 86B' cooperates with an adjustment screw (not shown) operated with an attached head 87S to adjust 86' for desired clearance from the support surface without the need for tools. 87S is turned to loosen the screw and allow 86A' to be extended or retracted along 87C, with the range of motion being determined by the length of 87C. 87S is turned to tighten the screw at the appropriate point for desired clearance from the support structure.

FIG. 18 is a wall-perspective partial view from above of right back section 71R engaged with the wall mounting bracket of FIG. 17A. Non-slip bracket 72R attaches to 71R substantially adjacent to intermediate section 24R. Horizontally elongated second member 86R of bracket 76R cooperates with the bottom surface of 72R in order to support the rod vertically. Third member 88R engages the surrounding surfaces of aperture 79R, thus preventing the rod from horizontal movement or rotation out of a plane substantially perpendicular to base plate 85R. Third member 88R is attached to second member 86R at a pre-determined distance from first member 85R to establish the desired distance between the mounting surface and the opposing surface of the drapery rod. (This distance is adjustable with the wall mounting bracket of FIG. 17B.)

Dual-drapery rod embodiments using the wall mounting bracket of FIG. 17A with different configurations of component rods are shown in FIGS. 19-22. FIGS. 19A-22A show Type 1 and FIGS. 19*b*-22*b* show Type 2 embodiments similar to those shown in FIGS. 4A-7A and 4B-7B but having attached non-slip brackets rather than apertures penetrating the back section of the rods. Three of the four Type 1 and Type 2 embodiments again incorporate a single-drapery rod and therefore can be used to convert existing telescopically engageable single-drapery rods into embodiments that use non-slip brackets. When the dual-drapery rod components engage an already existing single-drapery rod, the components making up the left and right back sections of the dual-drapery rod engage that single-drapery rod. When the components include a single-drapery rod, that rod is among the components making up the left and right back sections of the dual-drapery rod assembly. As previously noted, the inclusion of a new single-drapery rod with the other components of the assembly may be preferred for quality control reasons.

Figure 19A:
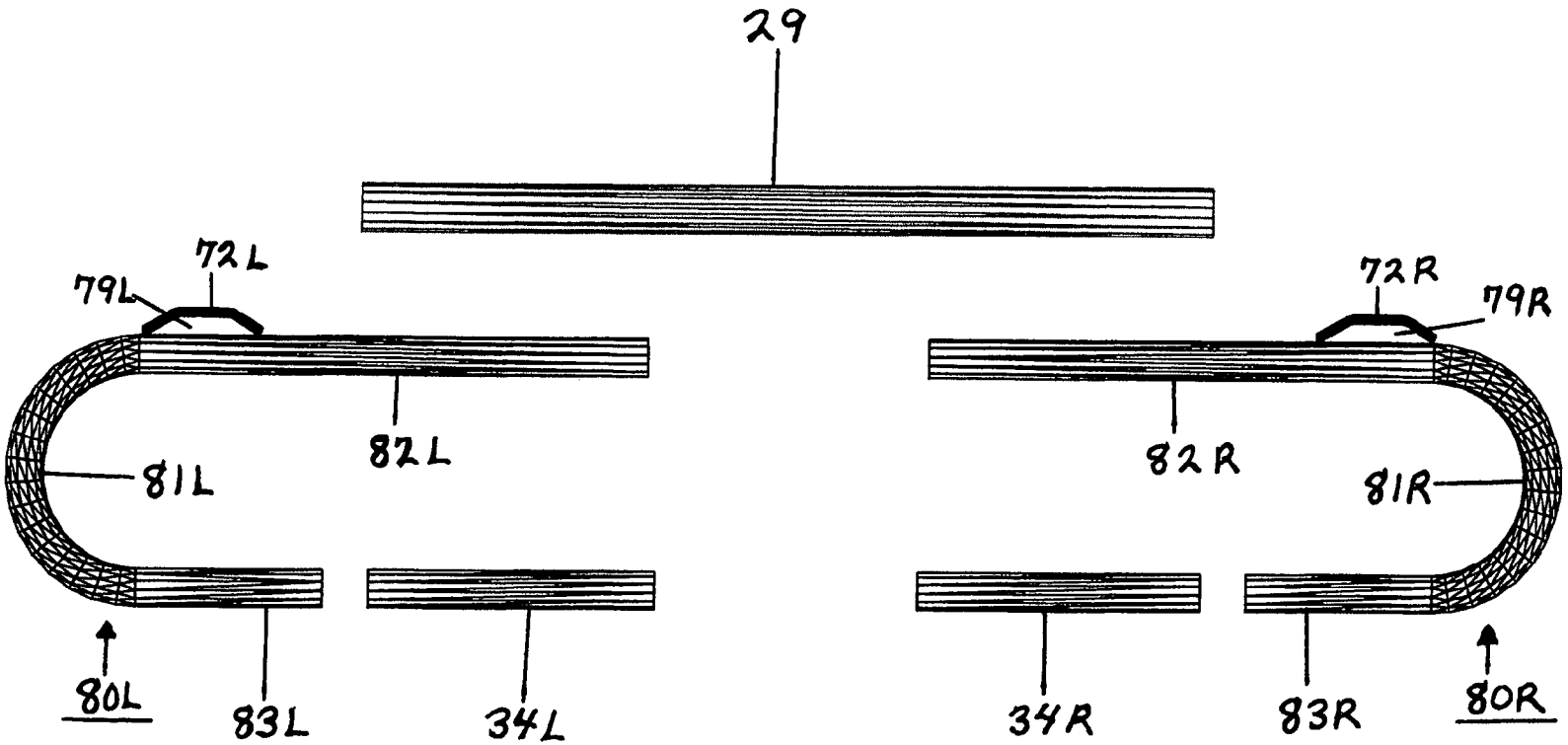
FIG. 19A is a top view of the preferred configuration of component rods of the Type 1 dual-drapery rod with non-slip brackets.

FIG. 19A is a top view of the preferred configuration of component rods of the Type 1 dual-drapery rod with non-slip brackets. Similar to the embodiment of FIG. 4A, components include back center rod 29 and left and right front rods 34L and 34R. However, non-slip brackets 72L and 72R on left and right curved rods 80L and 80R replace the apertures on curved rods 30L and 30R of FIG. 4A. Rods 80L and 80R are comprised of curved segments 81L and 81R sandwiched between substantially straight back segments 82L and 82R and front segments 83L and 83R. Back segments are substantially longer than front segments. Non-slip brackets 72L and 72R attached to segments 82L and 82R at points substantially adjacent to 81L and 81R create apertures 79L and 79R.

The components shown in FIG. 19A are assembled by telescopically inter-engaging 29 with 82L and 82R while keeping 80L and 80R in substantially the same plane and telescopically inter-engaging 83L and 83R with 34L and 34R The back section of the rod is formed by rod 29 and back segments 82L and 82R, the intermediate section by curved segments 81L and 81R, and the front sections by left and right front rods 34L and 34R and front segments 83L and 83R. Primary drapery and accent drapery are not shown, but primary drapery is hung from center rod 29 and segments 82L and 82R to the right of 72L and left of 72R. Accent drapery is hung from 81L, 83L, and 34L and from 81R, 83L and 34R—as well as any part of 82L and 82R to the left of 72L or right of 72R.

Figure 19B:
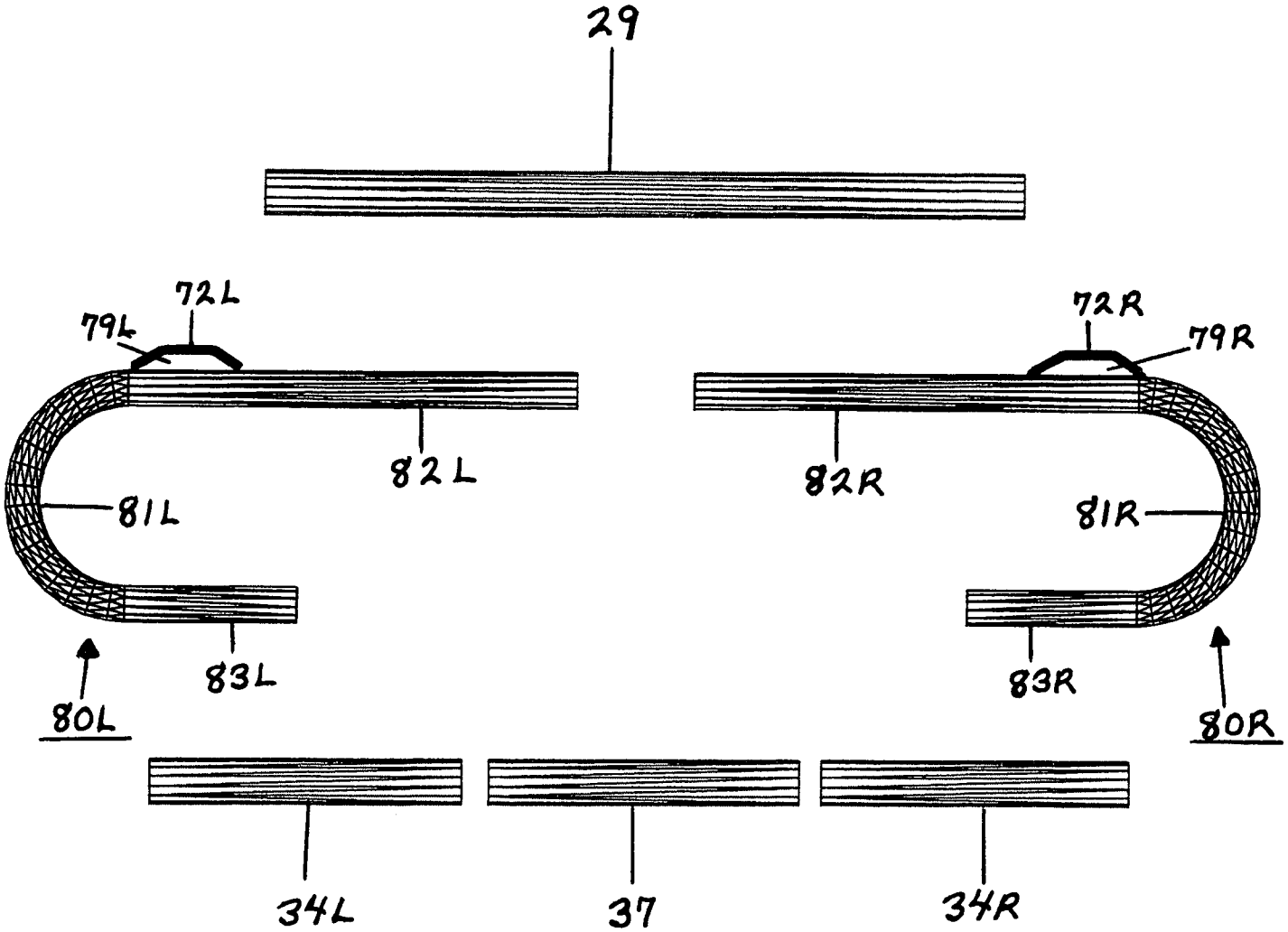
FIG. 19B is a top view of the preferred configuration of component rods of the Type 2 dual-drapery rod with non-slip brackets.

FIG. 19B is a top view of the component rods of the preferred Type 2 embodiment of the dual-drapery rod with non-slip brackets. The components of this Type 2 embodiment are identical to the components of the Type 1 embodiment of FIG. 19A except for the addition of 37 in FIG. 19B. Front center rod 37 telescopes with 34L and 34R to bridge the gap between the left and right front sections and create a continuous front section suitable for the primary drapes.

Figure 20A:
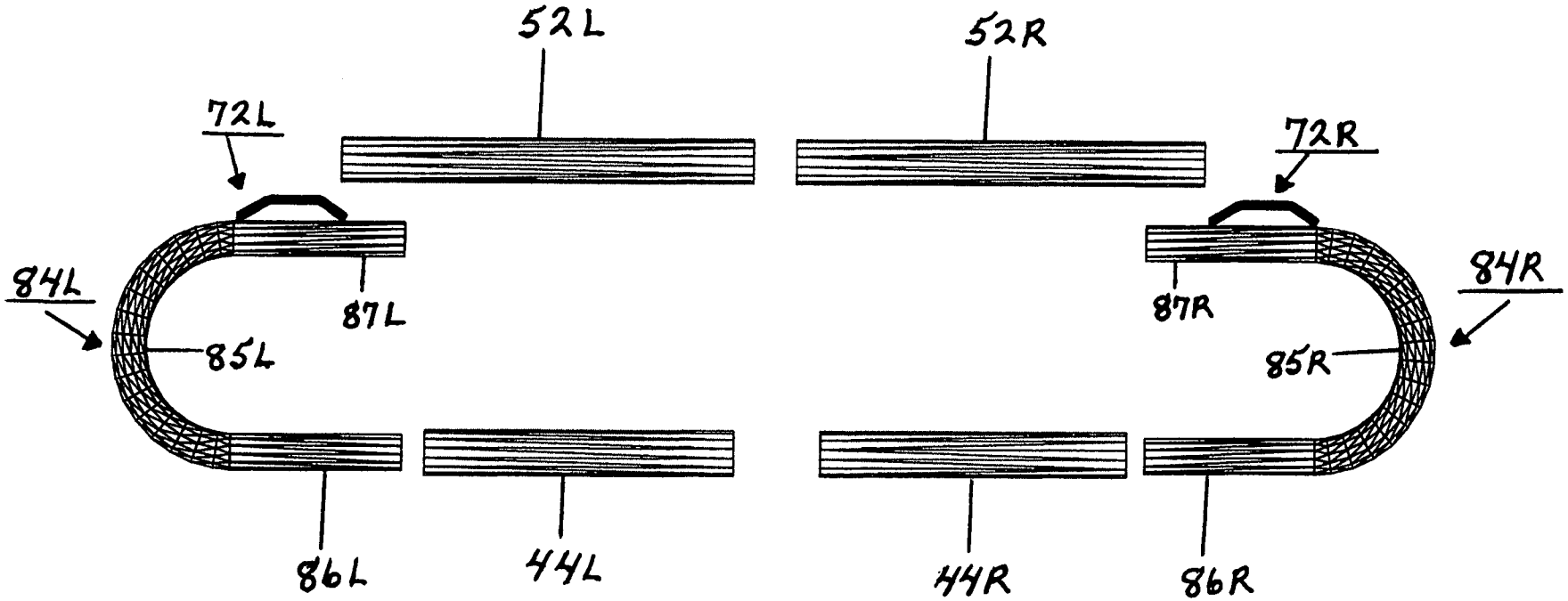
FIG. 20A is a top view of the component rods of a second Type 1 embodiment with non-slip brackets.

FIG. 20A is a top view of the component rods of a second Type 1 embodiment of the dual-drapery rod with non-slip brackets. This one is similar to the Type 1 embodiment shown in FIG. 5A, with left and right back center rods 52L and 52R and left and right front rods 44L and 44R. However, non-slip brackets attached to curved rods 84L and 84R replace the apertures of curved rods 53L and 53R in FIG. 5A. Curved rods 84L and 84R are comprised of curved segments 85L and 85R sandwiched between substantially straight back segments 87L and 87R and front segments 86L and 86R. Non-slip brackets 72L and 72R attached to segments 87L and 87R at points substantially adjacent to 85L and 85R create apertures 79L and 79R.

Figure 20B:
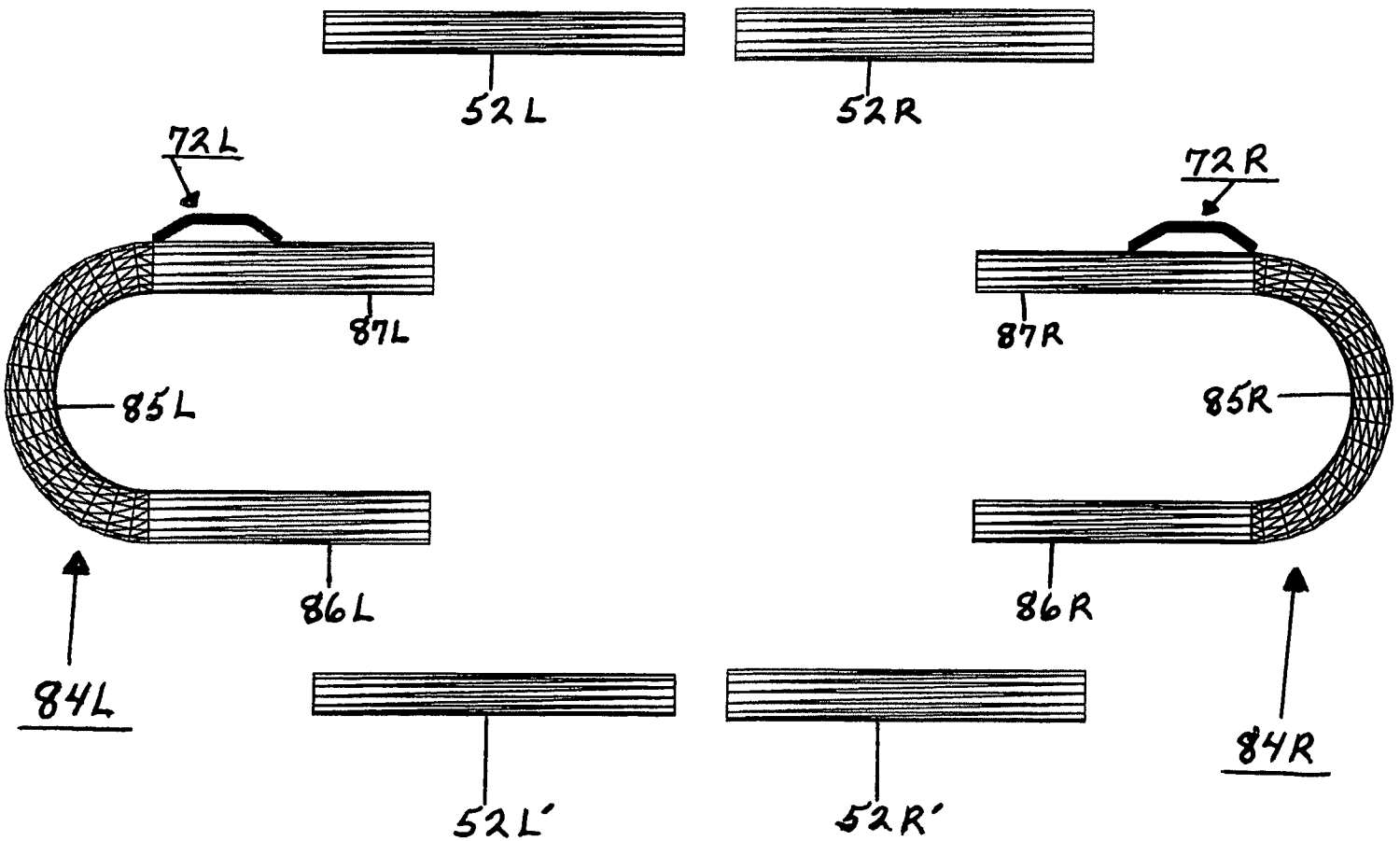
FIG. 20B is a top view of the component rods of a second Type 2 embodiment with non-slip brackets.

FIG. 20B is a top view of the component rods of a second Type 2 embodiment of the dual-drapery rod with non-slip brackets. The Type 2 embodiment is identical to the Type 1 embodiment of FIG. 20A except for the substitution of left and right front center rods 52L' and 52R' for 44L and 44R. 52L' and 52R' inter-engage with each other and with 86L and 86R to create a continuous front section suitable for the primary drapes.

Figure 21A:
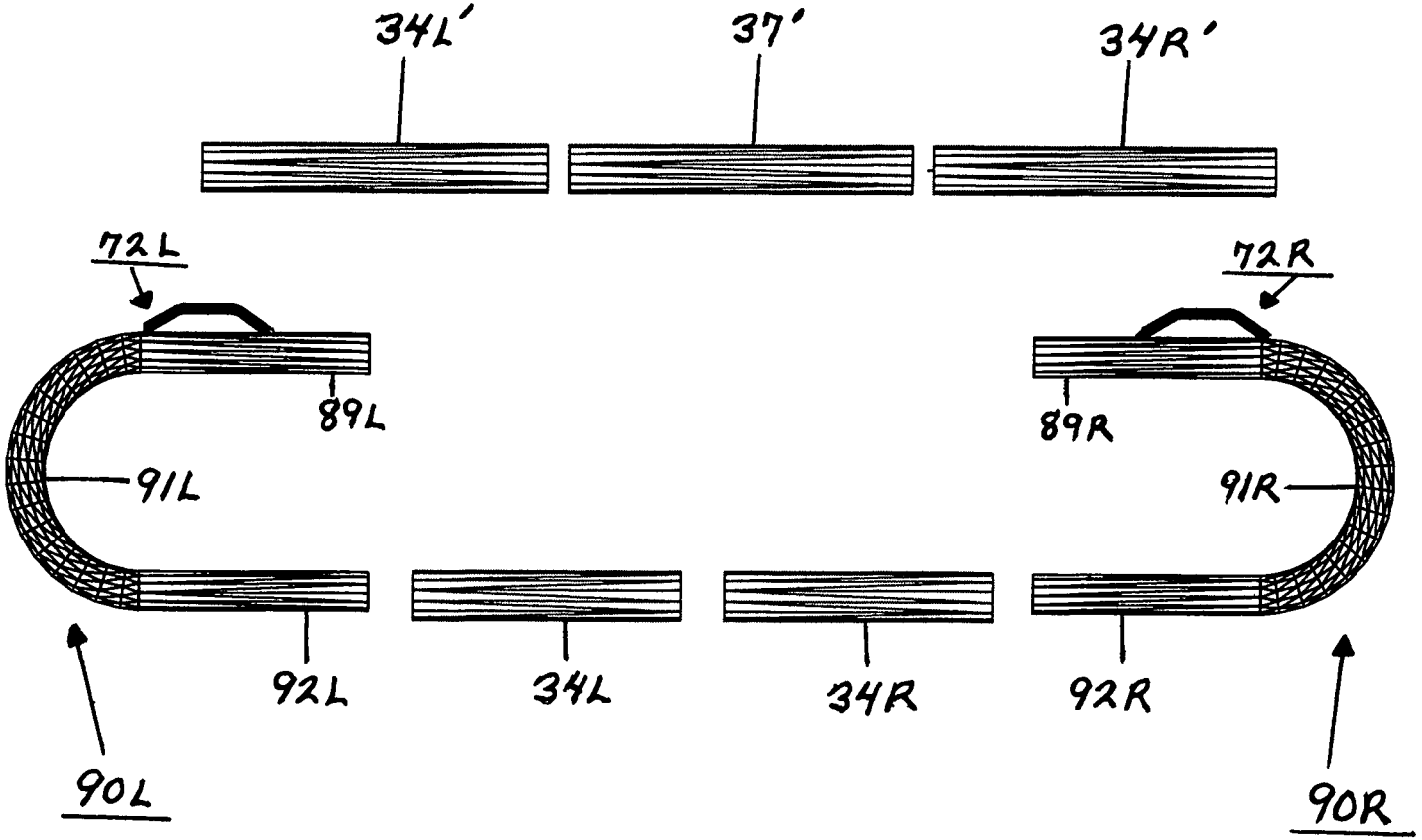
FIG. 21A is a top view of the component rods of a third Type 1 embodiment with non-slip brackets.

FIG. 21A is a top view of the component rods of a third Type 1 embodiment of the dual-drapery rod with non-slip brackets. This one is similar to the Type 1 embodiment shown in FIG. 6A, with left and right front rods 34L and 34R and a single-drapery rod comprised of back center rod 37' telescopically inter-engaged with 34L' and 34R'. Curved segments 91L and 91R and front segments 92L and 92R of curved rods 90L and 90R are identical to the curved and front segments of FIG. 6A, but non-slip brackets 72L and 72R attached to back segments 89L and 89R in FIG. 21A replace the apertures penetrating the back segments in FIG. 6A.

Figure 21B:
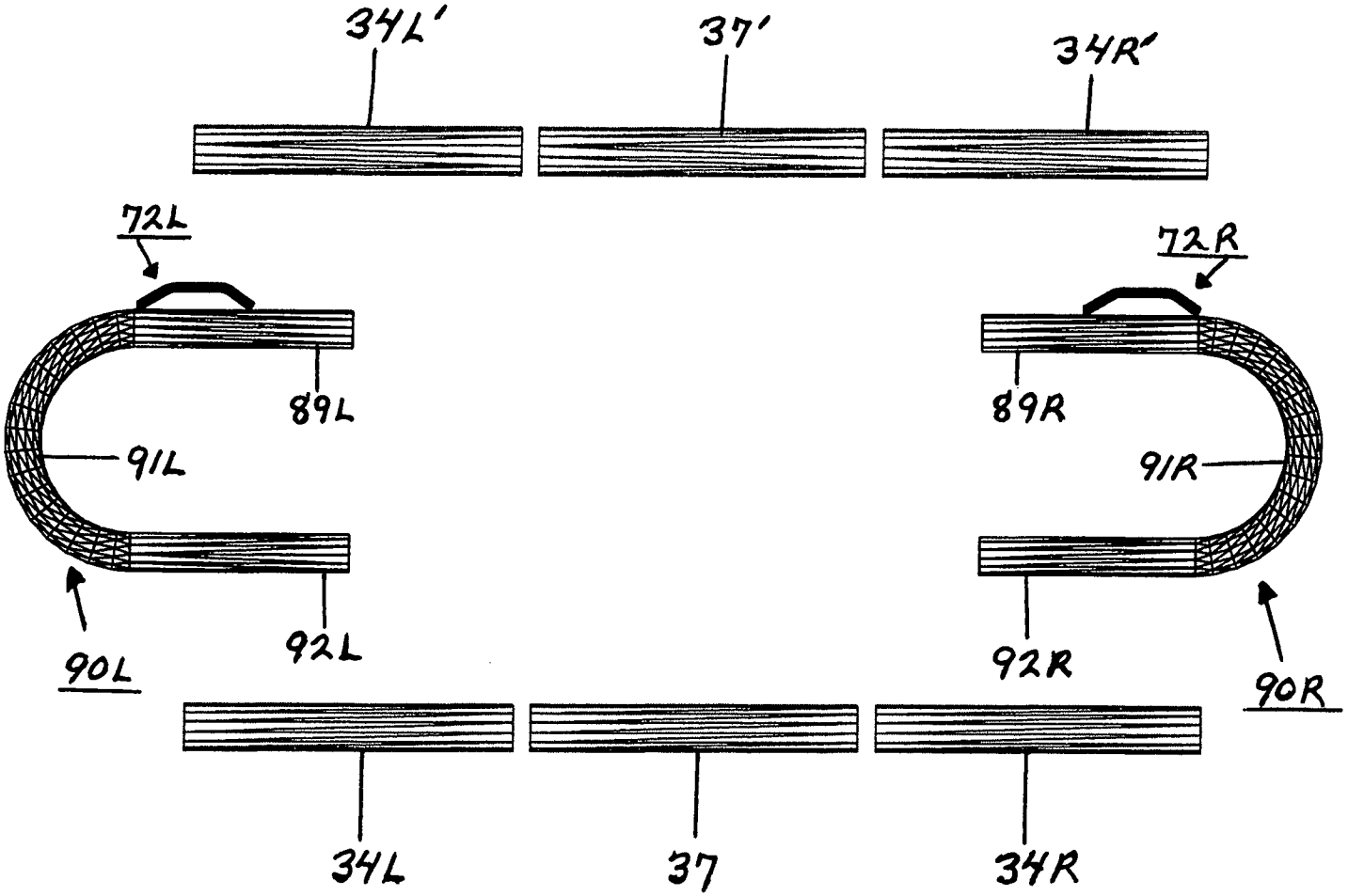
FIG. 21B is a top view of the component rods of a third Type 2 embodiment with non-slip brackets.

FIG. 21B is a top view of the component rods of a third Type 2 embodiment of the dual-drapery rod with non-slip brackets. It is identical to the Type 1 embodiment of FIG. 21A except front center rod 37 is added and inter-engaged between 34L and 34R to bridge the gap between 34L and 34R and form a front rod capable of supporting fully drawn primary drapery.

Figure 22A:
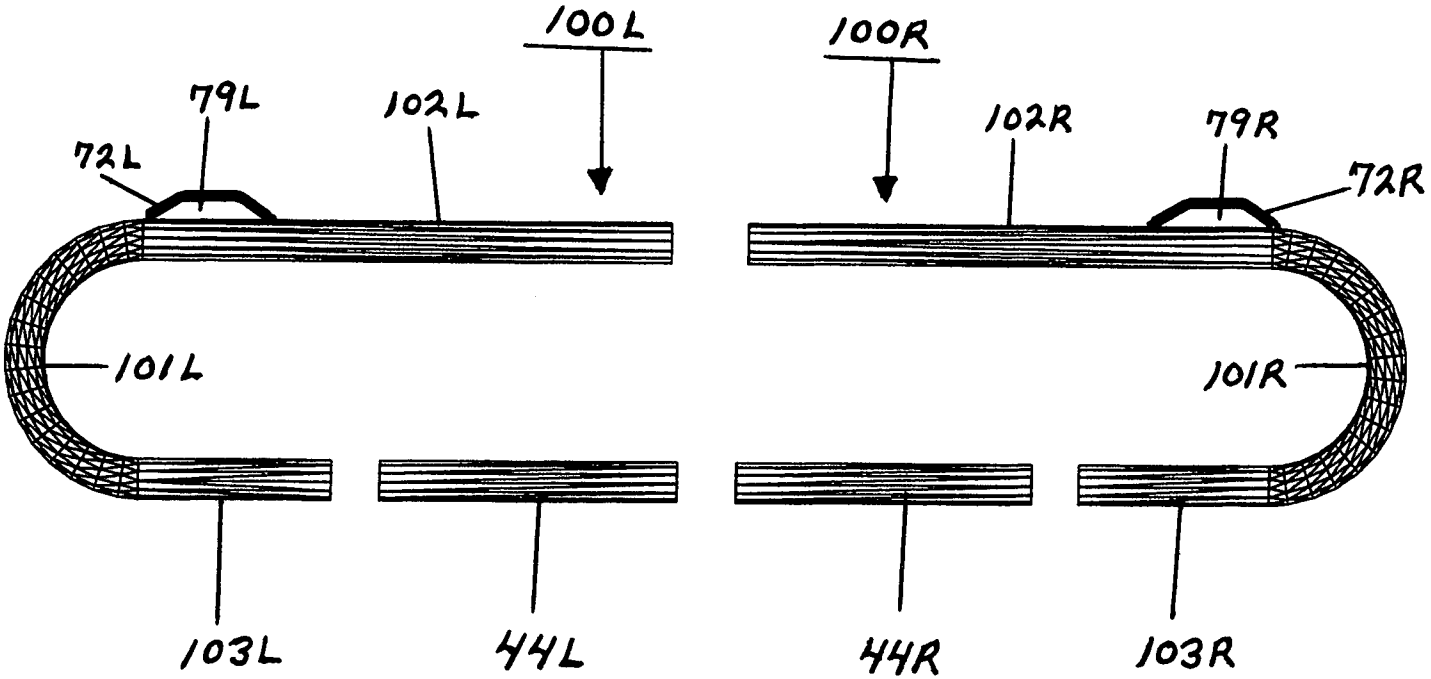
FIG. 22A is a top view of the component rods of a fourth Type 1 embodiment with non-slip brackets.

FIG. 22A is a top view of the component rods of a fourth Type 1 embodiment of the dual-drapery rod with non-slip brackets. Unlike the others, it does not include a single-drapery rod and thus the other components cannot be used to convert any existing single-drapery rod into a dual-drapery rod. However, this embodiment has the fewest components of all those shown. It is comprised of only left and right main rods 100L and 100R with left and right curved segments 101L and 101R, back segments 102L and 102R, and front segments 103L and 103R, 102L and 102R are telescopically engaged and 103L and 103R are telescopically engaged with 44L and 44R while keeping 100L and 100R in substantially the same plane.

Figure 22B:
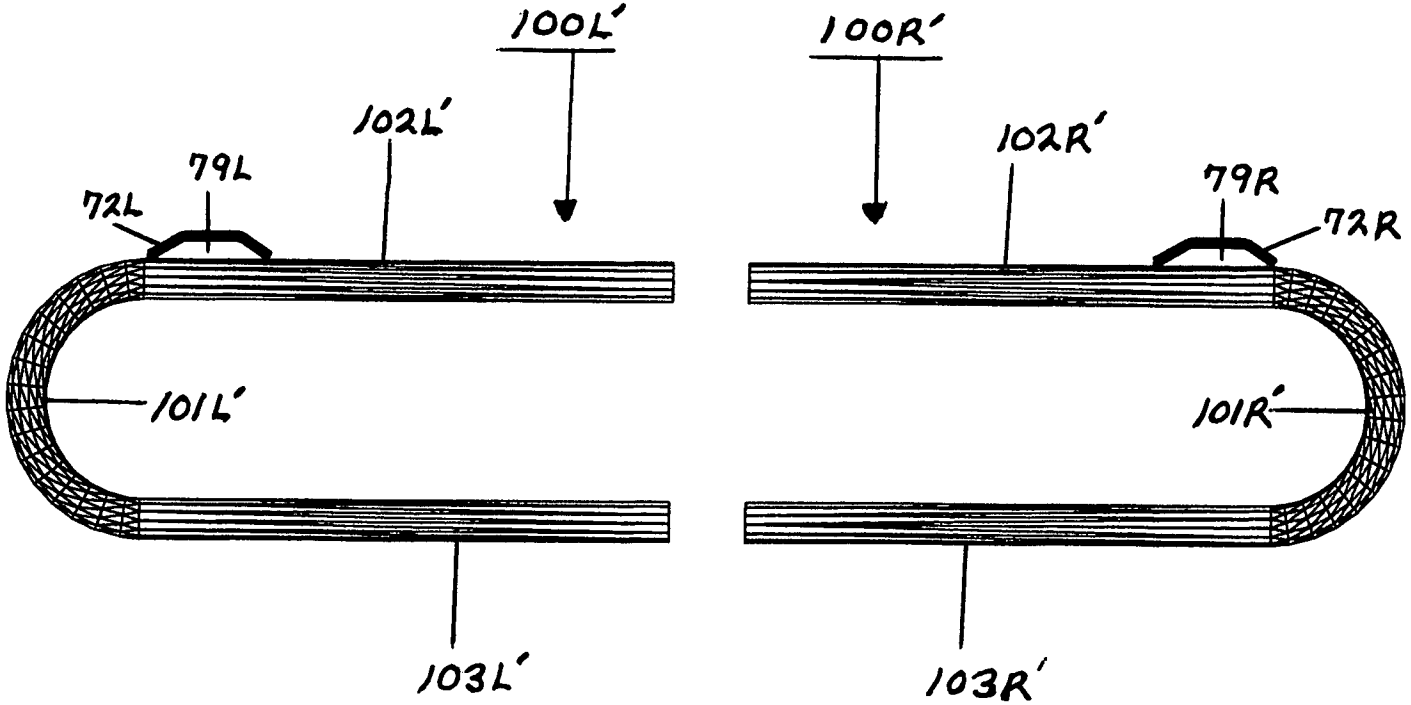
FIG. 22B is a top view of the component rods of a fourth Type 2 embodiment with non-slip brackets.

FIG. 22B is a top view of the component rods of a fourth Type 2 embodiment of the dual-drapery rod with non-slip brackets. Like the Type 1 embodiment of FIG. 22A, this embodiment does not contain a single-drapery rod. But it comprised of only of component rods, 100L' and 100R' comprised of back segments 102L' and 102R', curved segments 101L' and 101R', and front segments 103L' and 103R'. Back segments 102L' and 102R' and curved segments 101L' and 101R' are identical to 102L and 102R and 101L and 101L in FIG. 22A, but front segments 103L' and 103R' are long enough to inter-engage when 102L' and 102R' are inter-engaged.

Although many single and dual-drapery rod embodiments have been shown and described, additional ones are possible. Apertures, non-slip brackets, and cooperating third members could be reshaped, and a number of additional dual-drapery rod component configurations could be used. However, the embodiments described here should be sufficient to illustrate the principles and implementations of the non-mechanized multi-purpose drapery rod system and make its nature, objects, and advantages apparent to those skilled in the art. The embodiments displayed and described below illustrate the motorization of this system.

FIGS. 23-27 show assemblies that convert a conventional traverse rod into a motorized single or dual-drapery rod mounted on the preferred wall mounting bracket. The structure and operation of the traverse rod are described only to the extent necessary for context. Detailed descriptions of the traverse rod and its operation are available not only from early patents but also from a variety of readily available sources such as instructions that typically come with the rod and are available on how-to interne sites.

Figure 23:
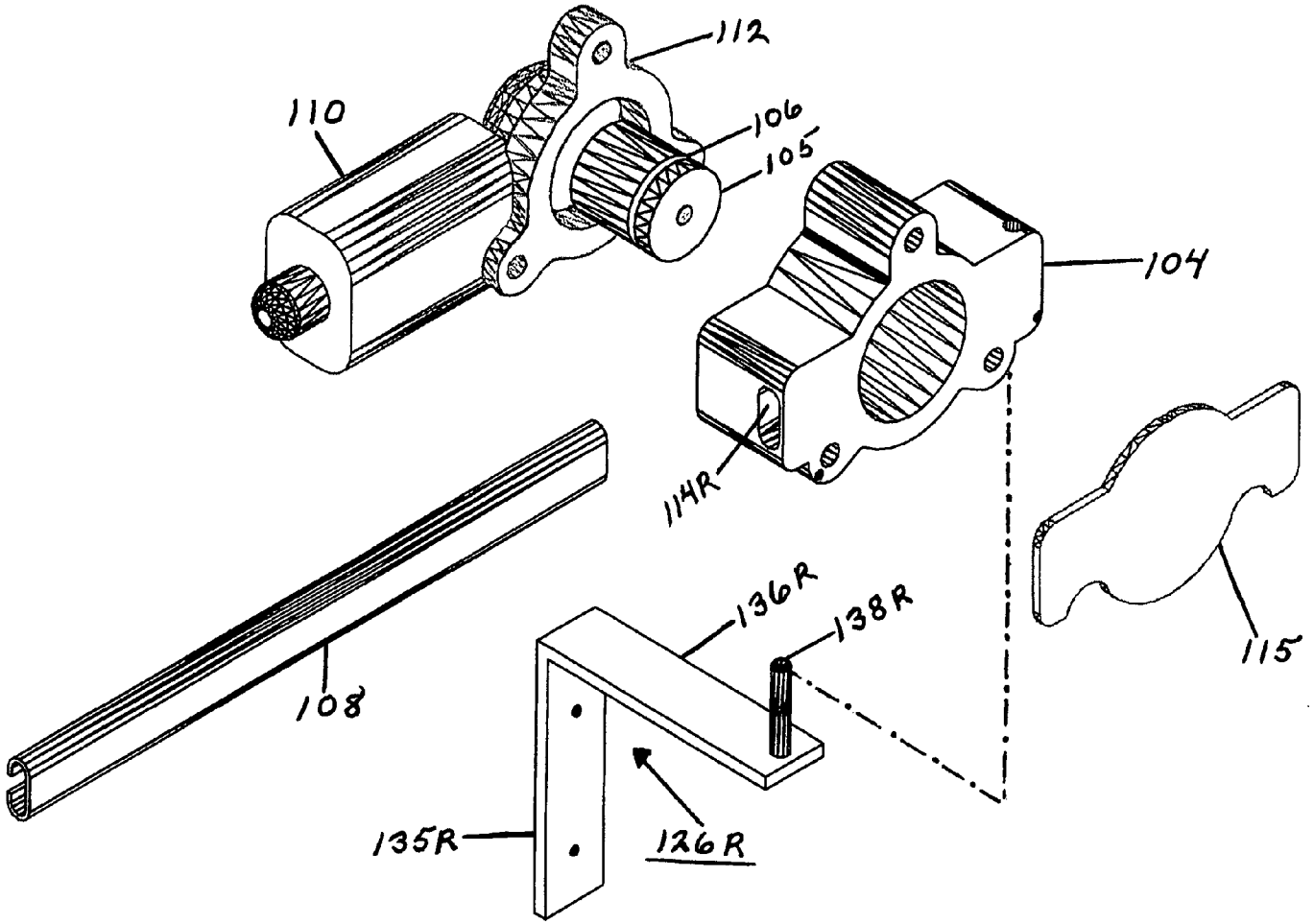
FIG. 23 is a perspective front view of the components of a right-engaging motorized single-drapery rod conversion assembly with a partial view of a cooperating traverse rod.

FIG. 23 is a perspective front view of the components of a right-engaging motorized single-drapery rod assembly with a partial view of a cooperating traverse rod. (The placement of the assembly on the right side is arbitrary. A left-engaging assembly using the same components rearranged is also possible.) The assembly is less complex structurally than prior art and does not require the transmission cord to be redirected before it is wound around the motor's wheel or drive pulley. Prior art employs multiple wheels and/or clips with channels to redirect the cord vertically before engaging a pulley wheel, then redirects it back horizontally before the cord re-enters the traverse rod (e.g., see US 2006/0162877 A1 and 7360576 B2). This increases the complexity of the assembly and may decrease efficiency and contribute to slippage. U.S. Pat. No. 7,360,576 B2 purports to combat the slippage problem, but still requires redirection of the transmission cord and appears to increase rather than decrease structural complexity.

Referring to FIG. 23, a traverse rod aperture 114R penetrates the front surface of drive pulley housing 104 which contains a drive pulley 105 with a drive pulley groove 106 to receive a transmission cord (shown in FIG. 26) from traverse rod 108. Reverse electric motor 110 is positioned in front of and coupled with right-angled drive 112 to rotate 105. Rubber (not shown) coats 106 to increase traction of the transmission cord. Traverse rod aperture 114R is sized to receive the right end of horizontally disposed traverse rod 108 while said traverse rod's transmission cord is wound around 106 of drive pulley 105 (which replaces the traverse rod's right pulley and cord tension pulley). Since 105 is directly across from the open end of traverse rod 108 when the rod is inserted horizontally into aperture 114R, the traverse rod's transmission cord does not have to be redirected before winding around 106. A set screw (not shown) tightens to hold the traverse rod in place.

Wall mounting bracket 126R cooperates with a support aperture (shown in FIG. 24) penetrating the bottom surface of 104 to support the assembly. 126R is structurally identical to the preferred wall mounting bracket shown in FIG. 2A, with a first member comprised of a base plate 135R having a vertically elongated body, a second member 136R having a horizontally elongated body extending substantially perpendicularly from 135R, and a third member 138R having a vertically elongated cylindrical body extending upwardly and substantially perpendicularly from 136R. Base plate 135R is adapted to attach to a wall or other vertical support surface while 136R engages the bottom surface of 104 and third member 138 engages the surrounding surfaces of support aperture 118R (see FIG. 24), thereby mounting the assembly and the right end of the traverse rod to a support surface. (The left end of the traverse rod is supported with a traditional traverse rod support bracket not shown). Face plate 115 attaches to the face of 104. Small apertures penetrate the face and end of 104 and intersect with like apertures penetrating its bottom surface to receive drapery hooks that are used with traverse rods (not shown). This allows drapery that is hung from the traverse rod to also be hung across the face and around the back end of housing 104.

Figure 24:
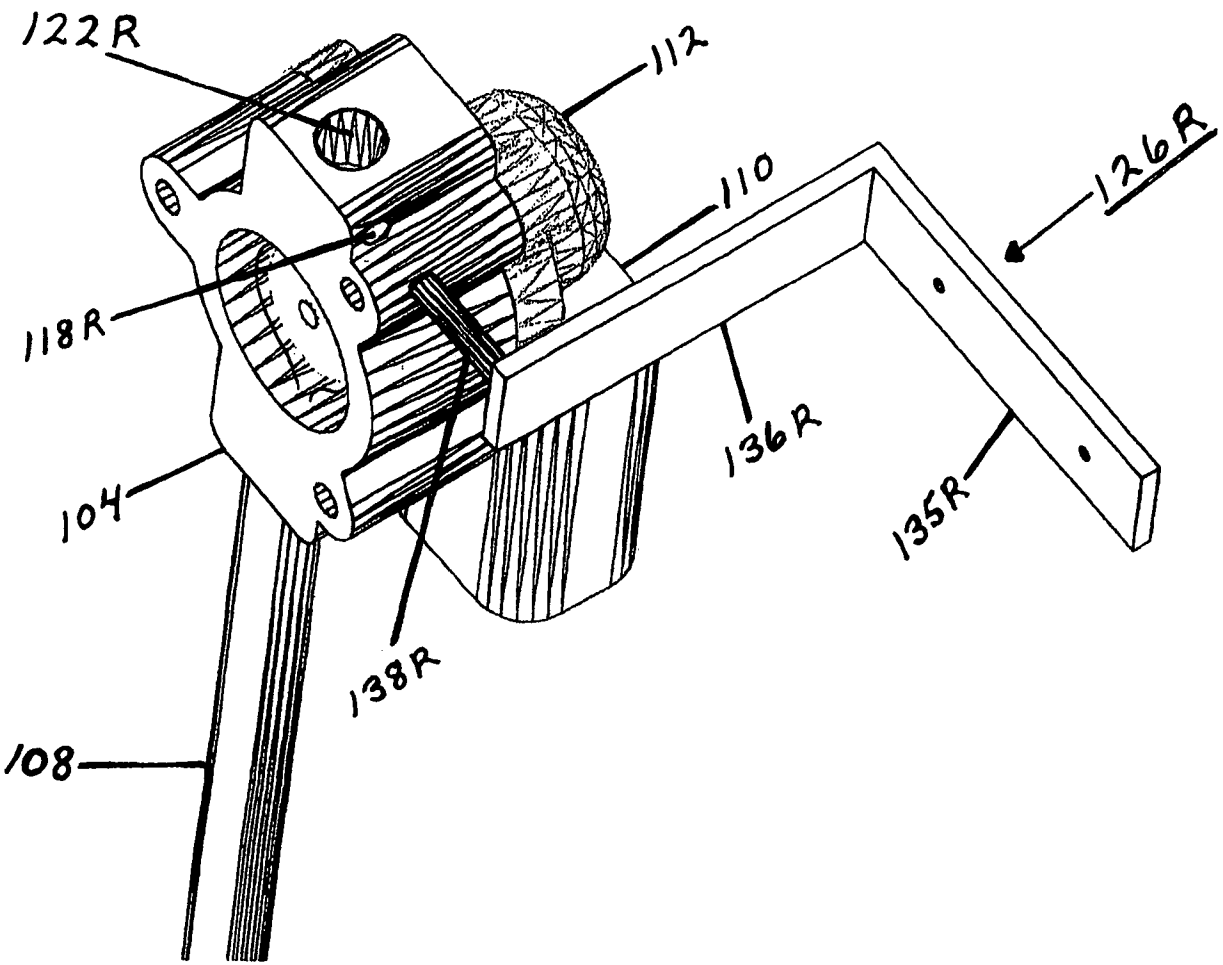
FIG. 24 is a perspective view from below and behind the drive pulley housing of FIG. 23.

FIG. 24 is a perspective view from below and behind drive pulley housing 104. Support aperture 118R penetrates the bottom surface of 104 at an angle substantially perpendicular to traverse rod 108. 118R is sized to receive third member 138R of 126R while second member 136R engages the bottom surface of 104 and 135R engages a wall. Aperture 122R is sized to receive a dual-drapery rod (see FIG. 25) and may be capped when not in use.

Figure 25:
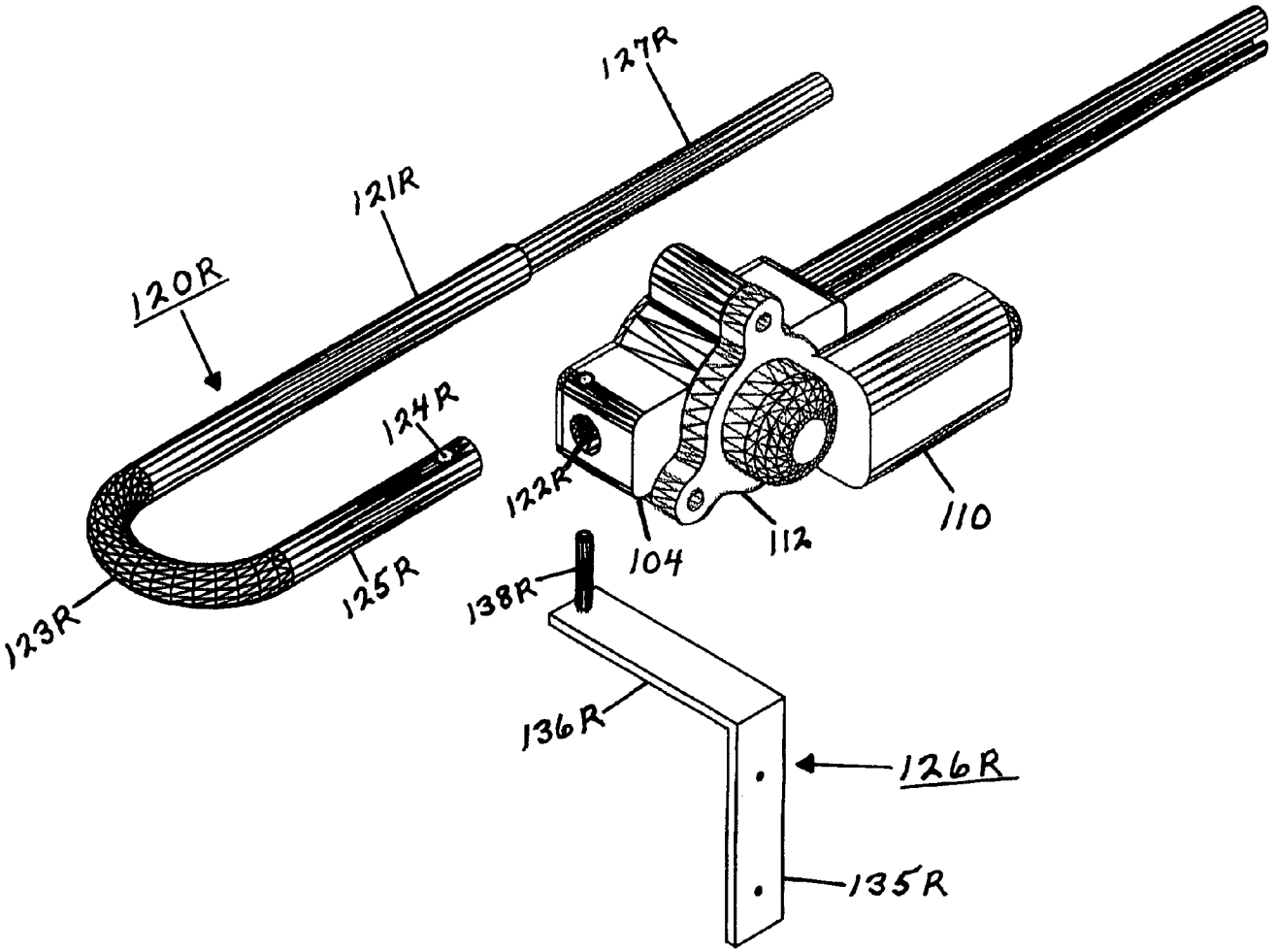
FIG. 25 is a back perspective partial view of a motorized dual-drapery rod conversion assembly with cooperating traverse rod and right dual-drapery rod.

FIG. 25 is a back perspective partial view of a motorized dual-drapery rod conversion assembly with cooperating traverse rod and right dual-drapery rod. Dual-drapery rod 120R is comprised of segment 123R curved 180 degrees and sandwiched between substantially straight front and back segments 121R and 125R. Substantially straight front rod 127R telescopically engages with 121R to provide an adjustable support for accent drapery (not shown). Housing 104 is shown assembled with electric motor 110 and right angled drive 112. Right dual-rod housing aperture 122R is sized to receive 125R and penetrates the back end of 104 a distance greater than the diameter of back segment 125R. In-rod aperture 124R in turn penetrates through the top and bottom surfaces of 125R at an angle substantially perpendicular to the plane of 120R and is sized and shaped to receive third member 138R. 125R is inserted into aperture 122R and third member 138R is inserted through apertures 118R (see FIG. 24) and 124R. Apertures 118R (FIG. 24) and 122R penetrate into 104 far enough to intersect and leave rigid surrounding surfaces beyond the intersection. Third member 138R is long enough to engage rigid surrounding surfaces above as well as below the intersection so that it secures dual-drapery rod 120R in a substantially horizontal plane and prevents 104 from rotating while second member 136R engages the bottom surface of 104 to prevent vertical movement.

Conversion to a motorized dual-drapery rod requires a second housing and dual-drapery rod. FIG. 26 provides a front view of take-up pulley housing 129 and drive pulley housing 104 with traverse rod 108 in between. Traverse rod 108 is separated in the middle to better show transmission cord 132, which wraps around take-up pulley 130 and drive pulley 105. Mounting brackets 126L and 126R are also separated from the housings, as are face plates 115 and 116 and cord guard 128 for take-up pulley 130. Cord guard 128 keeps transmission cord 132 from slipping off pulley 130. The ends of cord 132 are not shown, but are drawn tight and tied off at the traverse rod carriers as described in standard instructions accompanying the rods. A tension spring (not shown) is used at one end to maintain tension on the cord.

FIG. 27 is a left front perspective partial view of take-up pulley housing 129 attached to traverse rod 108 but separated from dual-drapery rod 120L and mounting bracket 126L. Transmission-cord guard 128 has also been separated from pulley 130 and front surface plate 116 has been removed to better display the take-up pulley. Aperture 114L (not shown) is sized like 114R shown in FIG. 23 to receive the end of traverse rod 108 while the traverse rod's transmission cord winds around take-up pulley 130 (see FIG. 26). Dual-drapery rod 120L is comprised of segment 123L curved 180 degrees and sandwiched between substantially straight front and back segments 121L and 125L. Left dual-rod housing aperture 122L penetrates the back end of 129 and is sized to receive 125L. In-rod aperture 124L in turn penetrates through the top and bottom surfaces of 125L and is sized to receive third member 138L. 125L is inserted into aperture 122L and third member 138L is inserted through apertures 118L penetrating the bottom of 129 (not shown) and 124L. Apertures 118L and 122L penetrate far enough into 129 to intersect. Third member 138L is long enough to engage rigid surrounding surfaces above as well as below the intersection so that it secures dual-drapery rod 120L in a substantially horizontal plane and prevents housing 129 from rotating while second member 136L engages the bottom surface of 129 to prevent vertical movement. A substantially straight front rod (not shown) may be telescopically engaged with the front segment of the dual drapery rod as shown in FIG. 25.

FIG. 28 is a perspective front exploded view of a second embodiment of the drive pulley apparatus with other key components and a partial view of a cooperating traverse rod. The second embodiment is more complex than the first, incorporating additional parts designed to deal with the cord slippage problem common with motorized drapery rod assemblies. Traverse rod aperture 114R penetrates the front surface of drive pulley housing 107 containing a drive pulley with a large-diameter portion 109 and a smaller-diameter groove portion 111. 111 receives transmission cord 132 from traverse rod 108. Reverse electric motor 110 is again positioned in front of and coupled with right-angled drive 112. Traverse rod aperture 114R (not shown) is sized to receive the left end of 108 while transmission cord 132 is wound around 111. Friction wheel 140 and tension bushing 142 have holes in their centers which allow 140 and 142 to fit tightly around 111. 111 is threaded at its end to receive tension nut 146. 140 is first fitted over 111 and up against 132, then 142 is fitted over 111 and up against 140. A tension spring 144 is then slipped over 111 and held in place by 146, which is tightened to create desired tension to prevent slippage of 132. Tension cap 148 attaches to 107 with screws and includes a tension cap crown 149 which provides clearance for 111. As before, right dual-rod housing aperture 122R receives the end of the back segment of dual drapery rod 120R (see FIG. 25). Wall mounting bracket 126R supports the assembly, third member 138R engaging the surrounding surfaces of support aperture 118R (see FIG. 24) while second member 136R engages the bottom surface of 107 (not shown) and 135R engages a wall.

The invention claimed is:

1. A dual-drapery rod assembly includes a drapery rod having rigid top and bottom surfaces and comprised of back, intermediate, and front sections;

a. said back section being comprised of an engageable left and right back section, said intermediate section being comprised of an engageable left and right intermediate section, and said front section being comprised of an engageable left and right front section;

b. said left and right intermediate sections being sandwiched between said engageable left and right back and left and right front sections;

i. said left and right back and front sections of the rod are substantially straight;

ii. said left and right intermediate sections are curved toward each other in substantially the same plane approximately 180° over a predetermined distance, leaving said left and right front sections substantially parallel to each other at a predetermined distance from said left and right back sections;

iii. an aperture penetrates through opposing surfaces of said back section of said drapery rod substantially adjacent to said intermediate section and at a predetermined angle to the plane of said intermediate section;

b. said dual-drapery rod assembly further includes a mounting bracket, said mounting bracket being comprised of a first member base plate, a second member extending away from said base plate, and a third member comprised of an element having a base and a distal end extending away from said second member;

i. said base plate being adapted to engage a support surface and including connecting means to attach said base plate to said support surface;

ii. the extending element of said third member being sized and shaped to fit through and engage inside surfaces surrounding said aperture and said extending element being disposed at said pre-determined angle when said base plate is attached to said support surface;

whereby said dual-drapery rod is adapted to 1) be secured in a substantially horizontal plane when said base plate is attached to said support surface and said extending element is engaged with the surrounding inside surfaces of said aperture, and is adapted to 2) be attached to two sets of drapery, layering one in front of the other in the desired spatial relationship by supporting the first set on said back section and the second set on said front and intermediate sections of said drapery rod; and whereby length of said left and right front sections can be limited to only that required to support said second set, thereby allowing the front sections to meet and form a continuous front rod or a gap to be left between said left and right front sections to provide a view of said first set of drapery unobstructed by a bare front rod;

said gap being appropriate when using drapery as an accent in front of back drapery, and said continuous front rod being appropriate when layering sheer drapery in back of opaque drapery designed to be closable across said continuous front rod.

2. The dual-drapery rod assembly of claim 1 wherein said base plate includes holes adapted to receive screws, said screws providing said connecting means to attach said base plate to said support surface.

3. The dual-drapery rod of claim 1 wherein said drapery rod is comprised of a plurality of inter-engaging rods;

a. said inter-engaging rods include curved rods comprised of said left and right intermediate sections and adjacent portions of said left and right back sections; and b. said aperture penetrates through said opposing surfaces of said curved rods.

4. The dual-drapery rod assembly of claim 1 wherein;

a. said aperture penetrates said top and bottom surfaces of said drapery rod; and b. said extending element of said third member is disposed upwardly and engages said inside surrounding surfaces of said aperture while said second member engages said bottom surface of said rod when said base plate is attached to said support surface;

i. said base of said extending element engaging said inside surrounding surfaces of said aperture where said aperture penetrates said bottom surface of said rod; and ii. said distal end of said extending element engaging the surrounding surfaces where said aperture penetrates said top surface of said rod.

5. The dual-drapery rod assembly of claim 4 wherein said third member of said mounting bracket is cylindrically shaped.

6. The dual-drapery rod assembly of claim 4 wherein a. said support surface is a substantially vertical support surface; and b. said aperture penetrates said top and bottom surfaces of said drapery rod at a substantially perpendicular angle to said plane of said intermediate section.

7. The dual-drapery rod assembly of claim 4 wherein a. said back section of said drapery rod includes a non-slip bracket with a rigid top and bottom surface located substantially adjacent to said intermediate section;

b. said aperture is formed by said non-slip bracket arching away and back into said drapery rod in a plane substantially parallel to said back section;

c. said second member engages said bottom surface of said non-slip bracket while said extending element engages said inside surrounding surfaces of said aperture, thereby securing said rod in a substantially horizontal plane when said base plate is attached to said support surface.

8. The dual-drapery rod assembly of claim 1 wherein a. said aperture penetrates said top and bottom surface of said drapery rod;

b. said third member is also comprised of a removable collar or pin on said distal end of said extending element;

c. said extending element of said third member engages said inside surrounding surfaces of said aperture while the collar of said third member engages said bottom surface of said drapery rod when said base plate is attached to said support surface;

i. said base of said extending element engaging said surrounding surfaces where said aperture penetrates said top surface of said drapery rod; and ii. said distal end of said extending element engaging said surrounding surfaces where said aperture penetrates said bottom surface of said drapery rod.

9. The dual-drapery rod assembly of claim 8 wherein said extending element of said third member is cylindrically shaped.

10. The dual-drapery rod assembly of claim 8 wherein said aperture penetrates said top and bottom surfaces of said drapery rod at a substantially perpendicular angle to said plane of said intermediate section.

11. The dual-drapery rod assembly of claim 8 wherein a. said back section of said drapery rod includes a non-slip bracket with a rigid top and bottom surface located substantially adjacent to said intermediate section;

b. said aperture is formed by said non-slip bracket arching away and back into said drapery rod in a plane substantially parallel to said back section;

c. said collar engages said bottom surface of said non-slip bracket while said extending element engages said surrounding surfaces of said aperture, thereby securing said drapery rod in a substantially horizontal plane when said base plate is attached to said support surface.

12. The dual-drapery rod assembly of claim 1 wherein said extending element is disposed in substantially the same plane as said intermediate section when said base plate is attached to said support surface and said extending element engages said surrounding surfaces of said aperture.

13. The dual-drapery rod assembly of claim 12 wherein said third member of said mounting bracket is cylindrically shaped.

14. The dual-drapery rod assembly of claim 12 wherein a. said back section of said drapery rod includes a non-slip bracket located substantially adjacent to said intermediate section;

b. said aperture is formed by said non-slip bracket arching away and back into said drapery rod in a plane substantially parallel to said back section;

c. said extending element engages said surrounding surfaces of said aperture, thereby securing said drapery rod in a substantially horizontal plane when said base plate is attached to said support surface.

* * * * *